US008297428B2

(12) United States Patent
Renz et al.

(10) Patent No.: US 8,297,428 B2
(45) **Date of Patent: *Oct. 30, 2012**

(54) ANGLED CURRENCY PROCESSING SYSTEM

(75) Inventors: Mark B. Renz, Arlington Heights, IL (US); Alan T. Lynch, Elk Grove Village, IL (US); Robert B. Fitzgerald, Lombard, IL (US); Stanley P. Sakowski, Hanover Park, IL (US); Curtis W. Hallowell, Palatine, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 76 days.

This patent is subject to a terminal disclaimer.

(21) Appl. No.: 12/687,583

(22) Filed: Jan. 14, 2010

(65) Prior Publication Data

US 2010/0108463 A1 May 6, 2010

Related U.S. Application Data

(63) Continuation of application No. 11/809,621, filed on Jun. 1, 2007, now Pat. No. 7,686,151.

(60) Provisional application No. 60/810,232, filed on Jun. 1, 2006, provisional application No. 60/864,334, filed on Nov. 3, 2006.

(51) Int. Cl.
*G07F 7/04* (2006.01)
*G07F 9/10* (2006.01)

(52) U.S. Cl. ..... 194/206; 194/344; 194/350

(58) Field of Classification Search ..... 194/206, 194/344, 350; 271/185, 186; 209/534; 235/379; 902/8, 9, 10, 17, 30

See application file for complete search history.

(56) References Cited

U.S. PATENT DOCUMENTS

| | | | | |
|---|---|---|---|---|
| 3,362,532 | A | 1/1968 | Riddle et al. | 209/3.1 |
| 3,671,035 | A | 6/1972 | Reist | 271/202 |
| 3,972,520 | A | 8/1976 | McKeefry | 270/52.11 |

(Continued)

FOREIGN PATENT DOCUMENTS

CA 2 624 638 A1 12/2007

(Continued)

OTHER PUBLICATIONS

PCT/US2007/012996 which claims priority to U.S. Appl. No. 60/810,232 and U.S. Appl. No. 60/864,334, Partial Int'l Search Report, 7 pages (Dec. 14, 2007).

(Continued)

*Primary Examiner* — Mark Beauchaine
(74) *Attorney, Agent, or Firm* — Nixon Peabody LLP

(57) ABSTRACT

An angled arrangement of a currency document handling device and a second unit and an angle arrangement of two currency document handling devices, components of the same, and methods of coupling and using the same. For example, a currency document processing system for processing currency documents including currency bills comprises a currency handling device, a first currency document receiving unit, and a first angular transport unit. The first currency document receiving unit is adapted to receive at least some bills processed by the currency handling device. The first angular transport unit is adapted to receive bills from the currency handling device and transport bills to the first currency document receiving unit. The angular transport unit is adapted to be coupled between the currency handling device and the first currency document receiving unit such that the currency handling device and the first currency document receiving units are angled relative to each other such as by ninety degrees (90°).

135 Claims, 27 Drawing Sheets

U.S. PATENT DOCUMENTS

| | | | | |
|---|---|---|---|---|
| 3,976,198 | A | 8/1976 | Carnes et al. | 209/534 |
| 4,025,420 | A | 5/1977 | Horino | 209/534 |
| 4,697,708 | A * | 10/1987 | Goto et al. | 209/534 |
| 4,744,468 | A | 5/1988 | Goi et al. | 209/534 |
| 5,115,918 | A | 5/1992 | DeWitt et al. | 209/3.1 |
| 5,163,672 | A | 11/1992 | Mennie | 271/187 |
| 5,207,788 | A | 5/1993 | Geib | 271/122 |
| 5,295,196 | A | 3/1994 | Raterman et al. | 382/135 |
| 5,310,062 | A | 5/1994 | Stevens et al. | 209/584 |
| 5,390,910 | A | 2/1995 | Mandel et al. | 271/296 |
| 5,467,405 | A | 11/1995 | Raterman et al. | 382/135 |
| 5,467,406 | A | 11/1995 | Graves et al. | 382/135 |
| D369,984 | S | 5/1996 | Larsen | D10/97 |
| 5,536,002 | A | 7/1996 | Yoshida et al. | 271/264 |
| 5,564,544 | A | 10/1996 | Takemoto et al. | 194/206 |
| 5,633,949 | A | 5/1997 | Graves et al. | 382/135 |
| 5,640,463 | A | 6/1997 | Csulits | 382/135 |
| 5,652,802 | A | 7/1997 | Graves et al. | 382/135 |
| 5,687,963 | A | 11/1997 | Mennie | 271/119 |
| 5,692,067 | A | 11/1997 | Raterman et al. | 382/135 |
| 5,704,491 | A | 1/1998 | Graves | 209/534 |
| 5,724,438 | A | 3/1998 | Graves | 382/135 |
| 5,740,897 | A | 4/1998 | Gauselmann | 194/206 |
| 5,751,840 | A | 5/1998 | Raterman et al. | 382/135 |
| 5,790,693 | A | 8/1998 | Graves et al. | 382/135 |
| 5,790,697 | A | 8/1998 | Munro et al. | 382/135 |
| 5,806,650 | A | 9/1998 | Mennie et al. | 194/206 |
| 5,815,592 | A | 9/1998 | Mennie et al. | 382/135 |
| 5,822,448 | A | 10/1998 | Graves et al. | 382/135 |
| 5,832,104 | A | 11/1998 | Graves et al. | 382/135 |
| 5,867,589 | A | 2/1999 | Graves et al. | 382/135 |
| 5,870,487 | A | 2/1999 | Graves et al. | 382/135 |
| 5,875,259 | A | 2/1999 | Mennie et al. | 382/135 |
| 5,905,810 | A | 5/1999 | Jones et al. | 382/135 |
| 5,909,502 | A | 6/1999 | Mazur | 382/135 |
| 5,909,503 | A | 6/1999 | Graves et al. | 382/135 |
| 5,912,982 | A | 6/1999 | Munro et al. | 382/135 |
| 5,938,044 | A | 8/1999 | Weggesser | 209/534 |
| 5,943,655 | A | 8/1999 | Jacobson | 705/30 |
| 5,960,103 | A | 9/1999 | Graves et al. | 382/135 |
| 5,966,456 | A | 10/1999 | Jones et al. | 382/135 |
| 5,982,918 | A | 11/1999 | Mennie et al. | 382/135 |
| 5,992,601 | A | 11/1999 | Mennie et al. | 194/207 |
| 6,012,565 | A | 1/2000 | Mazur | 194/207 |
| 6,021,883 | A | 2/2000 | Casanova et al. | 194/217 |
| 6,026,175 | A | 2/2000 | Munro et al. | 382/135 |
| 6,028,951 | A | 2/2000 | Raterman et al. | 382/135 |
| 6,068,194 | A | 5/2000 | Mazur | 235/492 |
| 6,072,896 | A | 6/2000 | Graves et al. | 382/135 |
| 6,073,744 | A | 6/2000 | Raterman et al. | 194/207 |
| 6,074,334 | A | 6/2000 | Mennie et al. | 493/438 |
| 6,128,402 | A | 10/2000 | Jones et al. | 382/135 |
| 6,220,419 | B1 | 4/2001 | Mennie | 194/207 |
| 6,237,739 | B1 | 5/2001 | Mazur et al. | 194/207 |
| 6,241,069 | B1 | 6/2001 | Mazur et al. | 194/207 |
| 6,256,407 | B1 | 7/2001 | Mennie et al. | 382/135 |
| 6,278,795 | B1 | 8/2001 | Anderson et al. | 382/135 |
| 6,311,819 | B1 | 11/2001 | Stromme et al. | 194/207 |
| 6,318,537 | B1 | 11/2001 | Jones et al. | 194/346 |
| 6,328,166 | B1 | 12/2001 | Sakai | 209/534 |
| 6,351,551 | B1 | 2/2002 | Munro et al. | 382/135 |
| 6,363,164 | B1 | 3/2002 | Jones et al. | 382/135 |
| 6,371,303 | B1 | 4/2002 | Klein et al. | 209/534 |
| 6,378,683 | B2 | 4/2002 | Mennie | 194/207 |
| 6,381,354 | B1 | 4/2002 | Mennie et al. | 382/135 |
| 6,398,000 | B1 | 6/2002 | Jenrick et al. | 194/200 |
| 6,459,806 | B1 | 10/2002 | Raterman et al. | 382/135 |
| 6,460,705 | B1 | 10/2002 | Hallowell | 209/534 |
| 6,493,461 | B1 | 12/2002 | Mennie et al. | 382/135 |
| 6,539,104 | B1 | 3/2003 | Raterman et al. | 382/135 |
| 6,560,355 | B2 | 5/2003 | Graves et al. | 382/135 |
| 6,588,569 | B1 | 7/2003 | Jenrick et al. | 194/206 |
| 6,601,687 | B1 | 8/2003 | Jenrick et al. | 194/206 |
| 6,603,872 | B2 | 8/2003 | Jones et al. | 382/135 |
| 6,621,919 | B2 | 9/2003 | Mennie et al. | 382/135 |
| 6,628,816 | B2 | 9/2003 | Mennie et al. | 382/135 |
| 6,636,624 | B2 | 10/2003 | Raterman et al. | 382/135 |
| 6,647,136 | B2 | 11/2003 | Jones et al. | 382/137 |
| 6,650,767 | B2 | 11/2003 | Jones et al. | 382/135 |
| 6,654,486 | B2 | 11/2003 | Jones et al. | 382/135 |
| 6,659,258 | B2 | 12/2003 | Otsuka | 194/206 |
| 6,661,910 | B2 | 12/2003 | Jones et al. | 382/135 |
| 6,665,431 | B2 | 12/2003 | Jones et al. | 382/135 |
| 6,676,127 | B2 | 1/2004 | Johnson et al. | 273/149 R |
| 6,678,401 | B2 | 1/2004 | Jones et al. | 382/135 |
| 6,678,402 | B2 | 1/2004 | Jones et al. | 382/135 |
| 6,705,470 | B2 | 3/2004 | Klein et al. | 209/534 |
| 6,721,442 | B1 | 4/2004 | Mennie et al. | 382/135 |
| 6,724,926 | B2 | 4/2004 | Jones et al. | 382/135 |
| 6,724,927 | B2 | 4/2004 | Jones et al. | 382/135 |
| 6,731,785 | B1 | 5/2004 | Mennie et al. | 382/135 |
| 6,731,786 | B2 | 5/2004 | Jones et al. | 382/135 |
| 6,748,101 | B1 | 6/2004 | Jones et al. | 382/135 |
| 6,772,886 | B2 | 8/2004 | Werner et al. | 209/534 |
| 6,778,693 | B2 | 8/2004 | Jones et al. | 382/135 |
| 6,798,899 | B2 | 9/2004 | Mennie et al. | 382/135 |
| 6,810,137 | B2 | 10/2004 | Jones et al. | 382/135 |
| 6,811,016 | B2 | 11/2004 | Blair | 209/534 |
| 6,843,418 | B2 | 1/2005 | Jones et al. | 235/462.01 |
| 6,860,375 | B2 | 3/2005 | Hallowell et al. | 194/328 |
| 6,866,134 | B2 | 3/2005 | Stromme et al. | 194/207 |
| 6,868,954 | B2 | 3/2005 | Stromme et al. | 194/207 |
| 6,880,692 | B1 | 4/2005 | Mazur et al. | 194/207 |
| 6,896,116 | B2 | 5/2005 | Deaville et al. | 194/206 |
| 6,913,130 | B1 | 7/2005 | Mazur et al. | 194/207 |
| 6,913,260 | B2 | 7/2005 | Maier et al. | 271/265.04 |
| 6,915,893 | B2 | 7/2005 | Mennie | 194/207 |
| 6,929,109 | B1 | 8/2005 | Klein et al. | 194/206 |
| 6,955,253 | B1 | 10/2005 | Mazur et al. | 194/207 |
| 6,957,733 | B2 | 10/2005 | Mazur et al. | 194/215 |
| 6,959,800 | B1 | 11/2005 | Mazur et al. | 194/207 |
| 6,962,247 | B2 | 11/2005 | Maier et al. | 194/207 |
| 6,980,684 | B1 | 12/2005 | Munro et al. | 382/135 |
| 6,994,200 | B2 | 2/2006 | Jenrick et al. | 194/206 |
| 6,996,263 | B2 | 2/2006 | Jones et al. | 382/135 |
| 7,000,828 | B2 | 2/2006 | Jones | 235/379 |
| 7,016,767 | B2 | 3/2006 | Jones et al. | 700/224 |
| 7,036,651 | B2 | 5/2006 | Tam et al. | 194/217 |
| 7,082,216 | B2 | 7/2006 | Jones et al. | 382/137 |
| 7,092,560 | B2 | 8/2006 | Jones et al. | 382/135 |
| 7,103,206 | B2 | 9/2006 | Graves et al. | 382/135 |
| 7,103,438 | B2 | 9/2006 | Hallowell et al. | 700/116 |
| 7,146,245 | B2 | 12/2006 | Jones et al. | 700/224 |
| 7,149,336 | B2 | 12/2006 | Jones et al. | 382/135 |
| 7,158,662 | B2 | 1/2007 | Chiles | 382/135 |
| 7,171,032 | B2 | 1/2007 | Jones et al. | 382/135 |
| 7,187,795 | B2 | 3/2007 | Jones et al. | 382/135 |
| 7,191,657 | B2 | 3/2007 | Maier et al. | 73/587 |
| 7,197,173 | B2 | 3/2007 | Jones et al. | 382/135 |
| 7,200,255 | B2 | 4/2007 | Jones et al. | 382/135 |
| 7,201,320 | B2 | 4/2007 | Csulits et al. | 235/462.01 |
| 7,219,083 | B2 | 5/2007 | Bellucci et al. | 705/43 |
| 7,232,024 | B2 | 6/2007 | Mazur et al. | 194/207 |
| 7,248,731 | B2 | 7/2007 | Raterman et al. | 382/135 |
| 7,256,874 | B2 | 8/2007 | Csulits et al. | 356/71 |
| 7,269,279 | B2 | 9/2007 | Chiles | 382/135 |
| 7,349,566 | B2 | 3/2008 | Jones et al. | 382/139 |
| 7,362,891 | B2 | 4/2008 | Jones et al. | 382/135 |
| 7,366,338 | B2 | 4/2008 | Jones et al. | 382/135 |
| 7,391,897 | B2 | 6/2008 | Jones et al. | 382/135 |
| 7,505,831 | B2 | 3/2009 | Jones et al. | 700/224 |
| 7,510,182 | B2 * | 3/2009 | Bobrow | 271/185 |
| 7,536,046 | B2 | 5/2009 | Raterman et al. | 382/135 |
| 7,542,598 | B2 | 6/2009 | Jones et al. | 382/135 |
| 7,551,764 | B2 | 6/2009 | Chiles et al. | 382/135 |
| 7,590,274 | B2 | 9/2009 | Raterman et al. | 382/135 |
| 7,591,428 | B2 | 9/2009 | Freeman et al. | 235/449 |
| 7,599,543 | B2 | 10/2009 | Jones et al. | 382/137 |
| 7,600,626 | B2 | 10/2009 | Hallowell et al. | 194/206 |
| 7,602,956 | B2 | 10/2009 | Jones et al. | 382/135 |
| 7,619,721 | B2 | 11/2009 | Jones et al. | 356/71 |
| 7,620,231 | B2 | 11/2009 | Jones et al. | 382/137 |
| 7,628,326 | B2 | 12/2009 | Freeman et al. | 235/450 |
| 7,635,082 | B2 | 12/2009 | Jones | 235/379 |
| 7,647,275 | B2 | 1/2010 | Jones | 705/40 |
| 7,650,980 | B2 | 1/2010 | Jenrick et al. | 194/206 |
| 7,672,499 | B2 | 3/2010 | Raterman et al. | 382/135 |

| | | | | |
|---|---|---|---|---|
| 7,686,151 | B2 | 3/2010 | Renz et al. | 194/206 |
| 7,726,457 | B2 | 6/2010 | Maier et al. | 194/206 |
| 7,735,621 | B2 | 6/2010 | Hallowell et al. | 194/206 |
| 7,753,189 | B2 | 7/2010 | Maier et al. | 194/206 |
| 7,762,380 | B2 | 7/2010 | Freeman et al. | 194/210 |
| 7,778,456 | B2 | 8/2010 | Jones et al. | 382/135 |
| 7,779,982 | B2 | 8/2010 | Fitzgerald et al. | 194/206 |
| 7,817,842 | B2 | 10/2010 | Mennie | 382/137 |
| 7,849,994 | B2 | 12/2010 | Klein et al. | 194/206 |
| 2001/0006557 | A1 | 7/2001 | Mennie et al. | 382/135 |
| 2001/0015311 | A1 | 8/2001 | Mennie | 194/207 |
| 2001/0019624 | A1 | 9/2001 | Raterman et al. | 382/135 |
| 2001/0035603 | A1 | 11/2001 | Graves et al. | 271/265.01 |
| 2002/0001393 | A1 | 1/2002 | Jones et al. | 382/100 |
| 2002/0020603 | A1 | 2/2002 | Jones et al. | 194/346 |
| 2002/0056605 | A1 | 5/2002 | Mazur et al. | 194/207 |
| 2002/0085245 | A1 | 7/2002 | Mennie et al. | 358/498 |
| 2002/0085745 | A1 | 7/2002 | Jones et al. | 382/135 |
| 2002/0103757 | A1 | 8/2002 | Jones et al. | 705/45 |
| 2002/0104785 | A1 | 8/2002 | Klein et al. | 209/534 |
| 2002/0107801 | A1 | 8/2002 | Jones et al. | 705/45 |
| 2002/0118871 | A1 | 8/2002 | Jones et al. | 382/137 |
| 2002/0122580 | A1 | 9/2002 | Jones et al. | 382/137 |
| 2002/0126885 | A1 | 9/2002 | Mennie et al. | 382/135 |
| 2002/0126886 | A1 | 9/2002 | Jones et al. | 382/135 |
| 2002/0131630 | A1 | 9/2002 | Jones et al. | 382/137 |
| 2002/0136442 | A1 | 9/2002 | Jones et al. | 382/135 |
| 2002/0145035 | A1 | 10/2002 | Jones | 235/379 |
| 2002/0153290 | A1* | 10/2002 | Otsuka | 209/534 |
| 2002/0154804 | A1 | 10/2002 | Jones et al. | 382/135 |
| 2002/0154805 | A1 | 10/2002 | Jones et al. | 382/135 |
| 2002/0154806 | A1 | 10/2002 | Jones et al. | 382/135 |
| 2002/0154807 | A1 | 10/2002 | Jones et al. | 382/135 |
| 2002/0154808 | A1 | 10/2002 | Jones et al. | 382/135 |
| 2002/0186876 | A1 | 12/2002 | Jones et al. | 382/135 |
| 2003/0009420 | A1 | 1/2003 | Jones | 705/39 |
| 2003/0015395 | A1 | 1/2003 | Hallowell et al. | 194/206 |
| 2003/0015396 | A1 | 1/2003 | Mennie | 194/206 |
| 2003/0059098 | A1 | 3/2003 | Jones et al. | 382/135 |
| 2003/0062242 | A1 | 4/2003 | Hallowell et al. | 194/302 |
| 2003/0081824 | A1 | 5/2003 | Mennie et al. | 382/135 |
| 2003/0108233 | A1 | 6/2003 | Raterman et al. | 382/135 |
| 2003/0121752 | A1 | 7/2003 | Stromme et al. | 194/207 |
| 2003/0121753 | A1 | 7/2003 | Stromme et al. | 194/207 |
| 2003/0132281 | A1 | 7/2003 | Jones et al. | 235/379 |
| 2003/0139994 | A1 | 7/2003 | Jones | 705/36 |
| 2003/0168308 | A1 | 9/2003 | Maier et al. | 194/207 |
| 2003/0174874 | A1 | 9/2003 | Raterman et al. | 382/135 |
| 2003/0182217 | A1 | 9/2003 | Chiles | 705/35 |
| 2003/0198373 | A1 | 10/2003 | Raterman et al. | 382/135 |
| 2003/0202690 | A1 | 10/2003 | Jones et al. | 382/139 |
| 2004/0003980 | A1 | 1/2004 | Hallowell et al. | 194/206 |
| 2004/0016621 | A1 | 1/2004 | Jenrick et al. | 194/206 |
| 2004/0016797 | A1 | 1/2004 | Jones et al. | 235/379 |
| 2004/0028266 | A1 | 2/2004 | Jones et al. | 382/135 |
| 2004/0083149 | A1 | 4/2004 | Jones | 705/35 |
| 2004/0145726 | A1 | 7/2004 | Csulits et al. | 356/71 |
| 2004/0149538 | A1 | 8/2004 | Sakowski | 194/207 |
| 2004/0153408 | A1 | 8/2004 | Jones et al. | 705/43 |
| 2004/0154964 | A1 | 8/2004 | Jones | 209/534 |
| 2004/0164483 | A1 | 8/2004 | Focke et al. | 271/264 |
| 2004/0173432 | A1 | 9/2004 | Jones | 194/216 |
| 2004/0182675 | A1 | 9/2004 | Long et al. | 194/206 |
| 2004/0251110 | A1 | 12/2004 | Jenrick et al. | 194/207 |
| 2005/0029168 | A1 | 2/2005 | Jones et al. | 209/534 |
| 2005/0035034 | A1 | 2/2005 | Long et al. | 209/534 |
| 2005/0040225 | A1 | 2/2005 | Csulits et al. | 235/379 |
| 2005/0047642 | A1 | 3/2005 | Jones et al. | 382/137 |
| 2005/0060055 | A1 | 3/2005 | Hallowell et al. | 700/95 |
| 2005/0060059 | A1 | 3/2005 | Klein et al. | 700/213 |
| 2005/0060061 | A1 | 3/2005 | Jones et al. | 700/226 |
| 2005/0077142 | A1 | 4/2005 | Tam et al. | 194/217 |
| 2005/0086271 | A1 | 4/2005 | Jones et al. | 707/200 |
| 2005/0087422 | A1 | 4/2005 | Maier et al. | 194/207 |
| 2005/0108165 | A1 | 5/2005 | Jones et al. | 705/43 |
| 2005/0117791 | A2 | 6/2005 | Raterman et al. | 382/135 |
| 2005/0117792 | A2 | 6/2005 | Graves et al. | 382/135 |
| 2005/0150738 | A1 | 7/2005 | Hallowell et al. | 194/206 |
| 2005/0163361 | A1 | 7/2005 | Jones et al. | 382/135 |
| 2005/0163362 | A1 | 7/2005 | Jones et al. | 382/137 |
| 2005/0169511 | A1 | 8/2005 | Jones | 382/135 |
| 2005/0173221 | A1 | 8/2005 | Maier et al. | 194/207 |
| 2005/0183928 | A1 | 8/2005 | Jones et al. | 194/207 |
| 2005/0207634 | A1 | 9/2005 | Jones et al. | 382/135 |
| 2005/0213803 | A1 | 9/2005 | Mennie et al. | 382/135 |
| 2005/0241909 | A1 | 11/2005 | Mazur et al. | 194/207 |
| 2005/0249394 | A1 | 11/2005 | Jones et al. | 382/135 |
| 2005/0265591 | A1 | 12/2005 | Jones et al. | 382/135 |
| 2005/0276458 | A1 | 12/2005 | Jones et al. | 382/135 |
| 2005/0278239 | A1 | 12/2005 | Jones et al. | 705/35 |
| 2006/0010071 | A1 | 1/2006 | Jones et al. | 705/42 |
| 2006/0078186 | A1 | 4/2006 | Freeman et al. | 382/135 |
| 2006/0182330 | A1 | 8/2006 | Chiles | 382/135 |
| 2006/0195567 | A1 | 8/2006 | Mody et al. | 709/224 |
| 2006/0210137 | A1 | 9/2006 | Raterman et al. | 382/135 |
| 2006/0274929 | A1 | 12/2006 | Jones et al. | 382/135 |
| 2007/0071302 | A1 | 3/2007 | Jones et al. | 382/135 |
| 2007/0076939 | A1 | 4/2007 | Jones et al. | 382/135 |
| 2007/0078560 | A1 | 4/2007 | Jones et al. | 700/224 |
| 2007/0095630 | A1 | 5/2007 | Mennie et al. | 194/206 |
| 2007/0112674 | A1 | 5/2007 | Jones et al. | 705/45 |
| 2007/0122023 | A1 | 5/2007 | Jenrick et al. | 382/135 |
| 2007/0172107 | A1 | 7/2007 | Jones et al. | 382/137 |
| 2007/0209904 | A1 | 9/2007 | Freeman et al. | 194/210 |
| 2007/0221470 | A1 | 9/2007 | Mennie et al. | 194/216 |
| 2007/0237381 | A1 | 10/2007 | Mennie et al. | 382/135 |
| 2007/0258633 | A1 | 11/2007 | Jones et al. | 382/135 |
| 2007/0269097 | A1 | 11/2007 | Chiles et al. | 382/135 |
| 2007/0278064 | A1 | 12/2007 | Hallowell et al. | 194/206 |
| 2008/0006505 | A1 | 1/2008 | Renz et al. | 194/206 |
| 2008/0033829 | A1 | 2/2008 | Mennie et al. | 705/16 |
| 2008/0044077 | A1 | 2/2008 | Mennie et al. | 382/135 |
| 2008/0060906 | A1 | 3/2008 | Fitzgerald et al. | 194/207 |
| 2008/0123932 | A1 | 5/2008 | Jones et al. | 382/135 |
| 2008/0133411 | A1 | 6/2008 | Jones et al. | 705/42 |
| 2008/0177420 | A1 | 7/2008 | Klein et al. | 700/224 |
| 2008/0219543 | A1 | 9/2008 | Csulits et al. | 382/135 |
| 2008/0285838 | A1 | 11/2008 | Jones et al. | 382/135 |
| 2009/0001661 | A1 | 1/2009 | Klein et al. | 271/258.01 |
| 2009/0022390 | A1 | 1/2009 | Yacoubian et al. | 382/135 |
| 2009/0087076 | A1 | 4/2009 | Jenrick | 382/135 |
| 2009/0090779 | A1 | 4/2009 | Freeman | 235/450 |
| 2009/0310188 | A1 | 12/2009 | Jones et al. | 358/448 |
| 2009/0313159 | A1 | 12/2009 | Jones et al. | 705/35 |
| 2010/0034454 | A1 | 2/2010 | Jones et al. | 382/137 |
| 2010/0051687 | A1 | 3/2010 | Jones et al. | 235/379 |
| 2010/0057617 | A1 | 3/2010 | Jones et al. | 705/44 |
| 2010/0063916 | A1 | 3/2010 | Jones et al. | 705/35 |
| 2010/0092065 | A1 | 4/2010 | Jones et al. | 382/135 |
| 2010/0108463 | A1 | 5/2010 | Renz et al. | 194/206 |
| 2010/0116619 | A1 | 5/2010 | Jones | 194/217 |
| 2010/0163366 | A1 | 7/2010 | Jenrick et al. | 194/206 |
| 2010/0236892 | A1 | 9/2010 | Jones et al. | 194/206 |
| 2010/0263984 | A1 | 10/2010 | Freeman et al. | 194/206 |
| 2010/0276485 | A1 | 11/2010 | Jones et al. | 235/379 |

FOREIGN PATENT DOCUMENTS

| | | | | |
|---|---|---|---|---|
| CA | 2 684 159 | A1 | | 4/2010 |
| CA | 2624638 | C | | 8/2010 |
| EP | 0264125 | A1 | | 4/1988 |
| GB | 2 464 826 | A | | 5/2010 |
| JP | 6-219620 | A | * | 8/1994 |
| JP | 06-219620 | A | | 8/1994 |
| JP | 11-105837 | A | | 4/1999 |
| WO | WO 91/11778 | A1 | | 8/1991 |
| WO | WO 92/17394 | A1 | | 10/1992 |
| WO | WO 93/23824 | A1 | | 11/1993 |
| WO | WO 95/24691 | A1 | | 9/1995 |
| WO | WO 96/10800 | A1 | | 4/1996 |
| WO | WO 96/36933 | A1 | | 11/1996 |
| WO | WO 97/30422 | A1 | | 8/1997 |
| WO | WO 97/43734 | A1 | | 11/1997 |
| WO | WO 97/45810 | A1 | | 12/1997 |
| WO | WO 98/12662 | A1 | | 3/1998 |
| WO | WO 98/13785 | A1 | | 4/1998 |
| WO | WO 98/24052 | A1 | | 6/1998 |
| WO | WO 98/24067 | A1 | | 6/1998 |
| WO | WO 98/35323 | A2 | | 8/1998 |

| | | | |
|---|---|---|---|
| WO | WO 98/40839 | A2 | 9/1998 |
| WO | WO 98/47100 | A1 | 10/1998 |
| WO | WO 98/50892 | A1 | 11/1998 |
| WO | WO 99/09511 | A1 | 2/1999 |
| WO | WO 99/14668 | A1 | 3/1999 |
| WO | WO 99/23601 | A1 | 5/1999 |
| WO | WO 99/41695 | A1 | 8/1999 |
| WO | WO 99/48040 | A1 | 9/1999 |
| WO | WO 99/48042 | A1 | 9/1999 |
| WO | WO 00/24572 | A1 | 5/2000 |
| WO | WO 00/65546 | A1 | 11/2000 |
| WO | WO 01/08108 | A2 | 2/2001 |
| WO | WO 01/59685 | A2 | 8/2001 |
| WO | WO 01/59723 | A1 | 8/2001 |
| WO | WO 02/29735 | A2 | 4/2002 |
| WO | WO 02/054360 | A2 | 7/2002 |
| WO | WO 03/005312 | A1 | 1/2003 |
| WO | WO 03/028361 | A2 | 4/2003 |
| WO | WO 03/029913 | A2 | 4/2003 |
| WO | WO 03/030113 | A1 | 4/2003 |
| WO | WO 03/067532 | A1 | 8/2003 |
| WO | WO 03/107282 | A2 | 12/2003 |
| WO | WO 2004/010367 | A1 | 1/2004 |
| WO | WO 2004/027717 | A2 | 4/2004 |
| WO | WO 2004/036508 | A2 | 4/2004 |
| WO | WO 2004/038631 | A2 | 5/2004 |
| WO | WO 2004/068422 | A1 | 8/2004 |
| WO | WO 2005/013209 | A2 | 2/2005 |
| WO | WO 2005/017842 | A1 | 2/2005 |
| WO | WO 2005/028348 | A2 | 3/2005 |
| WO | WO 2005/029240 | A2 | 3/2005 |
| WO | WO 2005/036445 | A1 | 4/2005 |
| WO | WO 2005/041134 | A2 | 5/2005 |
| WO | WO 2005/076229 | A1 | 8/2005 |
| WO | WO 2006/039439 | A2 | 4/2006 |
| WO | WO 2006/076289 | A2 | 7/2006 |
| WO | WO 2006/076634 | A2 | 7/2006 |
| WO | WO 2007/044570 | A2 | 4/2007 |
| WO | WO 2007/120825 | A2 | 10/2007 |
| WO | WO 2007/143128 | A2 | 12/2007 |
| WO | WO 2008/030356 | A1 | 3/2008 |
| WO | WO 2008/112132 | A1 | 9/2008 |

OTHER PUBLICATIONS

PCT/US2007/012996 which claims priority to U.S. Appl. No. 60/810,232 and U.S. Appl. No. 60/864,334, Int'l Search Report, 8 pages (Mar. 6, 2008).

PCT/US2007/012996 which claims priority to U.S. Appl. No. 60/810,232 and U.S. Appl. No. 60/864,334, Written Opinion of the Int'l Searching Authority, 14 pages (Mar. 6, 2008).

Canadian Patent Application Serial No. 2,624,638 filed Jun. 1, 2007, which claims benefit from PCT/US2007/012996, which claims priority to U.S. Appl. No. 60/810,232 and U.S. Appl. No. 60/864,334, Official Action, 4 pages (Jun. 3, 2008).

Canadian Patent Application Serial No. 2,624,638 filed Jun. 1, 2007, which claims benefit from PCT/US2007/012996, which claims priority to U.S. Appl. No. 60/810,232 and U.S. Appl. No. 60/864,334, Response to Official Action, 33 pages (Dec. 2, 2008).

Canadian Patent Application Serial No. 2,624,638 filed Jun. 1, 2007, which claims benefit from PCT/US2007/012996, which claims priority to U.S. Appl. No. 60/810,232 and U.S. Appl. No. 60/864,334; Official Action; 3 pages (Apr. 1, 2009).

Canadian Patent Application Serial No. 2,624,638 filed Jun. 1, 2007, which claims benefit from PCT/US2007/012996, which claims priority to U.S. Appl. No. 60/810,232 and U.S. Appl. No. 60/864,334, Response to Official Action, 31 pages (Oct. 1, 2009).

U.S. Appl. No. 10/903,745: Office Action, 17 pages (Feb. 13, 2008).

U.S. Appl. No. 10/903,745: Office Action, 19 pages (Sep. 5, 2008).

U.S. Appl. No. 10/903,745: Office Action, 15 pages (Jan. 21, 2009).

U.S. Appl. No. 10/903,745: Office Action, 6 pages (Sep. 18, 2009).

U.S. Appl. No. 11/036,686: Office Action, 9 pages (Sep. 27, 2006).

U.S. Appl. No. 11/036,686: Office Action, 7 pages (Mar. 20, 2007).

U.S. Appl. No. 11/036,686: Office Action, 14 pages (Oct. 24, 2007).

U.S. Appl. No. 11/036,686: Office Action, 18 pages (Sep. 4, 2008).

U.S. Appl. No. 11/036,686: Office Action, 13 pages (Jan. 16, 2009).

U.S. Appl. No. 11/036,686: Office Action, 6 pages (Sep. 22, 2009).

Cummins: JetScan™ MPS Model 4100 Brochure, JetScan™MPS Multi-Pocket Currency Sorter 4100 Series, "Manage Your Entire Currency Processing in a Single Pass," (Form 023-1747), 11 pages (Jul. 10, 2007).

Cummins: JetScan™ MPS Model 4100: Global Gaming Business, Best Productivity Enhancement Technology, Honorable Mention, MPS 4100 Multi-Pocket Currency Sorter from Cummins-Allison Corp., 1 page (Nov. 18, 2008).

Cummins: JetScan™ MPS Model 4100: Press Release for Best Productivity-Enhancement Technology Honorable Mention, "Winners announced for Seventh Annual Global Gaming Business & Technology Awards," 3 pages (Nov. 10, 2008).

Cummins: JetScan™ MPS Model 4100: Gaming & Leisure, "Turning the Corner in the Count Room," 2 pages (Spring 2009).

Cummins: JetScan™ MPS Model 4100: Casino Enterprise Management, G2E Post-Show Review, "Cummins-Allison has the Right Angle," 1 page (Dec. 2007).

Cummins: JetScan™ MPS Model 4100: Indian Gaming, Product Spotlight New Product Releases, "MPS 4100 Multi-pocket Currency Sorter," 3 pages (May 2007).

Currency Systems International: CPS 1200 brochure, 4 pages, (© 1992).

G&D: BPS 1000, Banknote Processing System brochure, 4 Pages (© 2004).

G&D: BPS 2000 & BPS 3000, Banknote Processing System for Central Bank Applications brochure, 8 Pages (© 2003).

G&D: BPS M7, A New Dimension of Performance brochure, 14 Pages (© 2009).

Glory: GSA-500 Sortmaster brochure, 2 pages (estimated Jan. 14, 1994).

Opex Corporation: Opex MPE 7.5, Opex webpage Mail Opener & Extractors, Opex MPE 7.5 Modular Automated Mail Extractor, 3 pages (Aug. 2009).

Toshiba/Mosler: CS-6600—Optical Currency Counter/Sorter, "Advanced Technology Achieves One-Step Deposit Processing & Verification," 4 pages (© 1985).

Toshiba: CS-7560 Currency Sorter brochure, 2 pages (Mar. 2006).

Toshiba: CS-7560 Currency Sorter—Banking, Western Money Systems webpage, 3 pages (Aug. 2009).

European Patent Application Serial No. 07795635.7, which claims benefit from PCT/US2007/012996, which claims priority to U.S. Appl. No. 60/810,232 and U.S. Appl. No. 60/864,334, Official Action, 4 pages (Sep. 21, 2010).

European Patent Application Serial No. 07795635.7, which claims benefit from PCT/US2007/012996, which claims priority to U.S. Appl. No. 60/810,232 and U.S. Appl. No. 60/864,334, Response to Official Action, 81 pages (Jan. 28, 2011).

Glory: Autostrap 100 webpages, url: http:/www.elec-mech.com/v/elec-mec/index_html, 9 pages (Jun. 24, 2002).

Glory: Autostrap 100 webpages, url: http://www.westernmoney.com/products/glory-as-100.htm, 3 pages (Jun. 24, 2002).

Glory: Autostrap 100 webpages, url: http://www.gloryusainc.com/each/autostrap/autostrap.html, 2 pages (Jun. 24, 2002).

Glory: GSA-500 Sortmaster brochure, 4 pages (estimated Jan. 14, 1994).

* cited by examiner

ANGLED CURRENCY PROCESSING SYSTEM

CROSS-REFERENCE TO RELATED APPLICATIONS

The present application is a continuation of pending prior application U.S. patent application Ser. No. 11/809,621, filed Jun. 1, 2007 entitled "Angled Currency Processing System," which claims priority to U.S. Provisional Patent Application Ser. No. 60/810,232, entitled "Currency Processing System with Angled Transport" which was filed on Jun. 1, 2006 and U.S. Provisional Patent Application Ser. No. 60/864,334, entitled "Angled Currency Processing System" which was filed on Nov. 3, 2006, each of which is incorporated herein by reference in its entirety.

FIELD OF THE DISCLOSURE

The present disclosure relates generally to the field of currency handling systems and, more particularly, to systems, methods and apparatuses for processing currency bills.

BACKGROUND

A variety of techniques and apparatuses have been used to satisfy the requirements of automated currency handling machines. As businesses and banks grow, these businesses are experiencing a greater volume of paper currency. These businesses are continually requiring not only that their currency be processed more quickly but also processed with more options in a less expensive manner. At the upper end of sophistication in this area of technology are machines that are capable of rapidly discriminating and counting multiple currency denominations and then sorting the currency bills into a multitude of output compartments.

However, many of these high-end machines are extremely large such that they are commonly found only in large institutions. These machines are not readily available to businesses which have space constraints, but still have the need to process large volumes of currency. For example, one of these machines can cost over $500,000, and with added currency document receiving units, such as a strapping unit, additional output receptacles, or a shredder, the machines may be too large to fit within a room size found in many buildings.

Typically, in the handling of bulk currency, after the currency bills have been analyzed, denominated, authenticated, counted, and/or otherwise processed, the currency bills are sorted by denomination into separate output receptacles or cassettes. The resulting individual stacks of bills having a single denomination often must then be further processed so that the bills therein may be strapped. Bill strapping is a process whereby a stack of a specific number of bills of a single denomination are bounded together such as being secured with a paper strap. For example, one dollar bills may be segregated into stacks of one hundred $1 bills and then bound with a paper strap. Strapping facilitates the handling of currency by allowing the strapped stacks of bills to be counted rather than the individual currency bills. Traditionally, U.S. currency bills are strapped in stacks containing one hundred bills.

Some systems are capable of strapping bills while continuing to evaluate other currency bills or other currency documents. Some such systems are described in U.S. Patent Publication No. 2004/0003980, incorporated by reference herein in its entirety.

One limitation with the prior systems is the overall size of the system. While a multi-pocket document processing device may be 5 feet in length, a single additional strapping device may be 3 feet in length. Further, it is common for a multi-pocket currency document processing system to further include additional modular output receptacles, and multiple strapping devices. Thus, it is possible for a multi-pocket currency document processing system to have an overall length of, for example, 25 feet when including all of the additional currency document receiving units such as output receptacles and strapping devices. However, the depth of the multi-pocket processing system is typically less than 2 feet. Thus, a very long, narrow room may be used to house such a document processing system. However, such a long room may not be practical for many locations, thus it would be desirable to have a multi-pocket document processing device that is configured to have a shorter overall length.

SUMMARY

According to some embodiments, currency and/or document processing systems are provided that have a non-linear configuration. For example, some embodiments have a generally L-shape or U-shape configuration.

According to some embodiments, a currency processing system is provided for processing a stack of currency bills, each bill having a respective denomination, that comprises a currency handling device, a first currency document receiving unit, and a first angular transport unit. The currency handling device has an input receptacle adapted to receive bills to be processed, one or more detectors adapted to retrieve information from a passing bill which is used to judge the passing bill, a plurality of output receptacles adapted to receive at least some of the bills processed by the device. The currency handling device also has a transport mechanism that defines a transport path between the input receptacle, past the one or more detectors, and the plurality of output receptacles. The transport mechanism is adapted to transport each bill individually or serially along the transport path. The transport mechanism is adapted to sort the bills into the plurality of output receptacles or to transport the bills out of the handling device based on one or more judgments of the bills as determined from the information obtained from the one or more detectors. The first currency document receiving unit is adapted to receive at least some bills from the handling device. The first angular transport unit is adapted to receive bills from the currency handling device and transport bills to the first currency document receiving unit. The angular transport unit has a transport mechanism adapted to rotate bills about a vertical axis as the bills are transported through the angular transport unit. For example, in some embodiments, the transport mechanism of the angular transport unit rotates bills through an angle $\alpha$ about a vertical axis where $\alpha$ is from approximately 45° to approximately 135°. In some embodiments, $\alpha$ is about 90°.

According to some embodiments, a currency document processing system comprises a currency handling device and a first currency document receiving unit. The currency handling device has a cabinet that comprises a front side, a left side, and a right side. The currency handling device has one or more detectors adapted to retrieve information from a passing currency document. The information is used to make a judgment about the passing currency document. The currency document handling device has a transport mechanism that defines one or more transport paths past the one or more detectors. The transport mechanism is adapted to transport each currency document individually along the one or more transport paths. The transport mechanism is adapted to transport at least some of the currency documents out of the handling device. The detectors and the transport mechanism reside in the cabinet. The front side of the cabinet lies generally in a first generally vertical plane. The first currency document receiving unit has a transport mechanism adapted to transport currency documents individually along one or more transport paths. The first currency document receiving unit is adapted to receive at least some currency documents processed by the currency handling device and transport the received currency documents along the one or more transport paths of the first currency document receiving unit. The first currency document receiving unit has a front side. The front side of the first currency document receiving unit lies generally in a second generally vertical plane. The first and second generally vertical planes are offset from each other by an angle $\alpha$, wherein the angle $\alpha$ is between about ten degrees (10°) and about one hundred and seventy degrees (170°). For example, according to some embodiments, $\alpha$ is approximately ninety degrees (90°)

Many additional embodiments are described below and in the accompanying figures in which like reference numbers refer to like features. Accordingly, the above summary is not intended to represent each embodiment, or every aspect, of the present disclosure. Additional features and benefits of the present disclosure will become apparent from the detail description, figures, and claims set forth below.

BRIEF DESCRIPTION OF THE DRAWINGS

Other objects and advantages will become apparent upon reading the following detailed description in conjunction with the drawings in which.

DETAILED DESCRIPTION OF THE ILLUSTRATED EMBODIMENTS

Figure 1A:
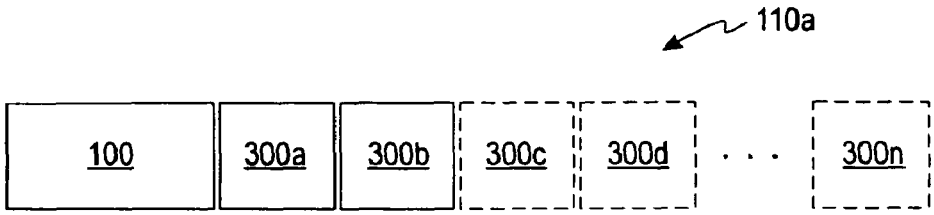
FIGS. 1*a* and 1*b* are top views of linear document processing systems.

While the inventions disclosed herein are susceptible to various modifications and alternative forms, specific embodiments thereof have been shown by way of example in the drawings and will herein be described in detail. It should be understood, however, that it is not intended to limit the inventions to the particular forms disclosed, but on the contrary, the intention is to cover all modifications, equivalents, and alternatives falling within the spirit and scope of the inventions as defined by the appended claims.

When describing various embodiments, the term "currency bills" refers to official currency bills including both U.S. currency bills, such as a $1, $2, $5, $10, $20, $50, or $100 note, and foreign currency bills.

Foreign currency bills are bank notes issued by a non-U.S. governmental agency as legal tender, such as a Euro, Japanese Yen, or British Pound note.

"Substitute currency notes" are sheet-like documents similar to currency bills but are issued by non-governmental agencies such as casinos and amusement parks and include, for example, casino script and Disney Dollars. Substitute currency notes each have a denomination and an issuing entity associated therewith such as a $5 Disney Dollar, a $10 Disney Dollar, a $20 ABC Casino note and a $100 ABC Casino note.

"Currency notes" consist of currency bills and substitute currency notes.

"Substitute currency media" are documents that represent a value by some marking or characteristic such as a bar code, color, size, graphic, or text. Examples of "substitute currency media" include without limitation: casino cashout tickets (also variously called cashout vouchers or coupons) such as "EZ Pay" tickets issued by International Gaming Technology or "Quicket" tickets issued by Casino Data Systems; casino script; promotional media such as Disney Dollars or Toys 'R Us "Geoffrey Dollars"; or retailer coupons, gift certificates, gift cards, or food stamps. Accordingly, substitute currency media includes but is not limited to substitute currency notes. Substitute currency media may or may not be issued by a governmental body.

Substitute currency media may include a barcode, and these types of substitute currency media are referred to herein as "barcoded tickets." Examples of barcoded tickets include casino cashout tickets such as "EZ Pay" tickets and "Quicket" cashout tickets, barcoded retailer coupons, barcoded gift certificates, or any other promotional media that includes a barcode.

The term "currency documents" includes both currency bills and "substitute currency media."

The term "non-currency documents" includes any type of document, except currency documents.

An "output location" is a location to which a document or bill may be sent includes an output receptacle or pocket, a strapping unit or device, and/or a particular location with a strapping device, a shredder, and other locations to which a document or bill may be delivered.

A "document receiving unit" comprises one or more output locations. In some embodiments, a document receiving unit may be a modular document receiving unit.

According to some embodiments, document processing systems may comprise one or more components designed with a "modular" construction. "Modular" units or components are designed such that they may be coupled to and/or decoupled from each other and/or additional modular units and/or other components such as a main document judgment or processing or handling device such as a device comprising a document input receptacle.

Although many embodiments refer to the "denomination" of currency bills as a criterion used in judging the currency bills, other predetermined criteria can be used to judge the currency bills or documents, such as, for example, color, size, orientation, series, fitness, condition, etc.

Various embodiments described herein can be used to judge non-currency documents and/or currency documents according to one or more predetermined criteria, such as color, size, shape, orientation, series, fitness, condition, etc.

Overview

First, some exemplary linear document processing systems will be discussed in connection with FIGS. 1*a* and 1*b*. Then an exemplary non-linear document processing system will be discussed in connection with FIG. 2. Then a number of exemplary currency handling devices and document receiving units will be described together with descriptions of various features and operating modes that may be used in conjunction therewith. These descriptions are generally related to FIGS. 3*a*-3*i*. Finally, several currency processing systems having a reduced width and/or employing angled or nonlinear arrangements and/or angular transport units will be described in conjunction with FIGS. 4*a*-10*b* and embodiments 0-167. According to some embodiments, one or more of the devices described in connection with FIGS. 3*a*-3*i* may be employed in the systems described in conjunction with FIGS. 2 and 4*a*-10*b* and embodiments 0-167.

Figure 1B:
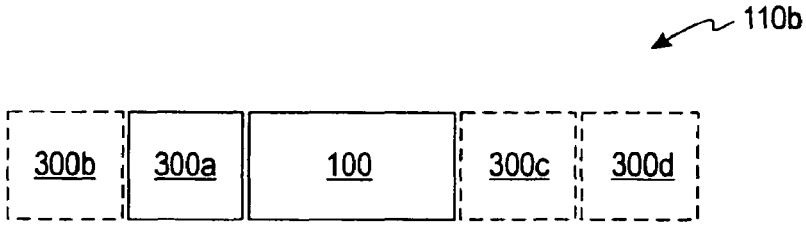

FIGS. 1*a* and 1*b* are top views of linear document processing systems. In FIG. 1*a*, linear document processing system 110*a* comprising a document judgment or handling device 100 is shown. The document judgment or handling device contains one or more sensors adapted to retrieve information from individual documents which can be used to make one or more judgments about the documents. For example, according to some embodiments, the retrieved information is used to determine the denomination, series, authenticity, orientation, and/or fitness of a currency bill. This information can be used by the system to determine how a particular document or bill is to be handled such as in determining to which output receptacle or location a document or bill should be sent, along which transport path a document or bill should be sent such as a transport path passing through a document turnover mechanism, and/or whether the system should halt its operation. The system further comprises a number of document receiving units such as document receiving units 300*a*-300*n*. In some embodiments, one or more of the document receiving units 300*a*-300*n* are modular document receiving units which may be added to or removed from the document processing system 110*a*.

The linear document processing system 110*b* shown in FIG. 1*b* comprises a document handling device 100 and a document receiving unit 300*a*. Additionally, the document processing system 110*b* may also comprise one or more of modular document receiving units 300*b*-300*d*. In some embodiments, the document receiving units 300*b*-300*d* are located both to the left and the right of document handling device 100.

Figure 2:
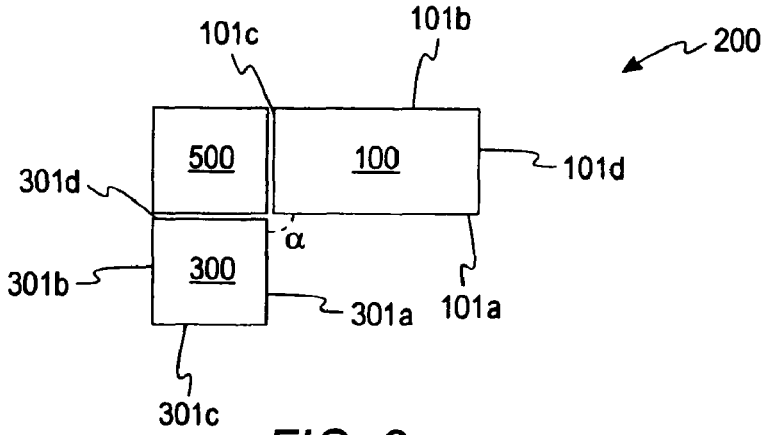
FIG. 2 is a top view of a non-linear currency document processing system according to some embodiments.

FIG. 2 is a top view of a non-linear document or currency processing system 200 according to some embodiments. As depicted in FIG. 2, document or currency processing system 200 comprises a currency or currency document handling or judgment device 100, an angular transport unit 500, and a document or currency receiving unit 300. As can be seen in FIG. 2, the currency receiving unit 300 is arranged in a non-linear fashion with respect to the currency handling or judgment device 100. In the embodiment illustrated, the document handling device 100 has a front side 101*a*, a rear side 101*b*, a left side 101*c* and a right side 101*d* and the document receiving unit 300 has a front side 301*a*, a rear side 301*b*, a left side 301*c* and a right side 301*d*. As illustrated, the front side 301*a* of the document receiving unit 300 is angled from the front side 101*a* of the document handling device 100 by an angle $\alpha$. In FIG. 2, angle $\alpha$ is depicted as being 90°. Likewise, in the illustrated embodiment, the rear side 301*b* of the document receiving unit 300 is angled from the rear side 101*b* of the document handling device 100 by an angle $\alpha$. Likewise, in the illustrated embodiment, the left side 301*c* and the right side 301*d* of the document receiving unit 300 are angled from the left side 101*c* and right side 101*d*, respectively, of the document handling device 100 by an angle $\alpha$. According to some embodiments, the front side 301*a* of the document receiving unit 300 is generally parallel to one of the left 101*c* and/or right side 101*d* of the document handling device 100. According to some embodiments, the front side 101*a* of the document handling device 100 is generally parallel to one of the left 301*c* and/or right side 301*d* of the document receiving unit 300.

Many types of currency handling devices 100 and document receiving units can be used in conjunction with the teachings of the present disclosure including those manufactured by Cummins-Allison Corp. and other companies. For example, the document and currency handling and processing devices, systems and methods and document receiving units disclosed in the following commonly-owned patents, applications, and published applications may be used in conjunction with the teachings of the present disclosure including the inclusion of the same in non-linear or angled document or currency processing systems:

U.S. patent application Ser. No. 09/502,666 filed Feb. 11, 2000 entitled "Currency Handling System Having Multiple Output Receptacles," now issued as U.S. Pat. No. 6,398,000;

U.S. patent application Ser. No. 09/688,526 filed Oct. 16, 2000 entitled "Currency Handling System Having Multiple Output Receptacles," now issued as U.S. Pat. No. 6,588,569;

U.S. patent application Ser. No. 09/688,538 filed Oct. 16, 2000 entitled "Currency Handling System Having Multiple Output Receptacles," now issued as U.S. Pat. No. 6,601,687;

PCT published Application WO 01/59723.

U.S. patent application Ser. No. 09/635,181 filed Aug. 9, 2000 entitled "Method of Creating Identifiable Smaller Stacks of Currency Bills with a Larger Stack of Currency Bills," now issued as U.S. Pat. No. 6,460,705;

U.S. patent application Ser. No. 10/068,977 filed Feb. 8, 2002 entitled "Multiple Pocket Currency Processing Device and Method," now issued as U.S. Pat. No. 6,860,375;

U.S. patent application Ser. No. 10/460,071 filed Jun. 12, 2003 entitled "Currency Processing and Strapping Systems and Methods," published as US Pat. Publication No. 2004-0003980;

U.S. patent application Ser. No. 10/256,818 filed Sep. 27, 2002 entitled "Currency Handling System Having Multiple Output Receptacles Interfaced with One or More Cash Processing Devices," published as U.S. Pat. Publication No. 2003-0062242;

U.S. patent application Ser. No. 10/664,217 filed Sep. 17, 2003 entitled "Compact Multiple Pocket Processing System," published as U.S. Pat. Publication No. 2004-0149538;

U.S. patent application Ser. No. 10/903,745 filed Jul. 30, 2004 entitled "Currency Processing Device, Method and System," published as U.S. Pat. Publication No. 2005-0029168;

U.S. patent application Ser. No. 11/036,686 filed Jan. 14, 2005 entitled "Currency Processing Device, Method and System," published as U.S. Pat. Publication No. 2005-0183928;

U.S. patent application Ser. No. 09/967,232 filed Sep. 28, 2001 entitled "System and Method for Processing Currency Bills and Substitute Currency Media In A Single Device," published as U.S. Pat. Publication No. US 2002-0020603 A1;

U.S. patent application Ser. No. 10/205,144 filed Jul. 23, 2002 entitled "System and Method for Processing Currency Bills and Documents Bearing Barcodes in a Document Processing Device," now issued as U.S. Pat. No. 6,843,418;

U.S. patent application Ser. No. 10/953,635 filed Sep. 29, 2004 and published as U.S. Pat. Publication No. US 2005-0040225 A1 entitled "System and Method For Processing Currency Bills and Documents Bearing Barcodes in A Document Processing Device"; and U.S. patent application Ser. No. 10/662,930 filed Sep. 15, 2003 entitled "System and Method For Searching And Verifying Documents In A Document Processing Device," published as U.S. Pat. Publication No. 2005-0060055 A1.

Each of the above patents, applications, and published applications is incorporated herein by reference in its entirety. These patents, applications, and published applications are hereinafter referred to as the "Cummins' patent documents."

Some examples of document handling devices 100 are illustrated in FIGS. 3*a*-3*h*.

Figure 3A:
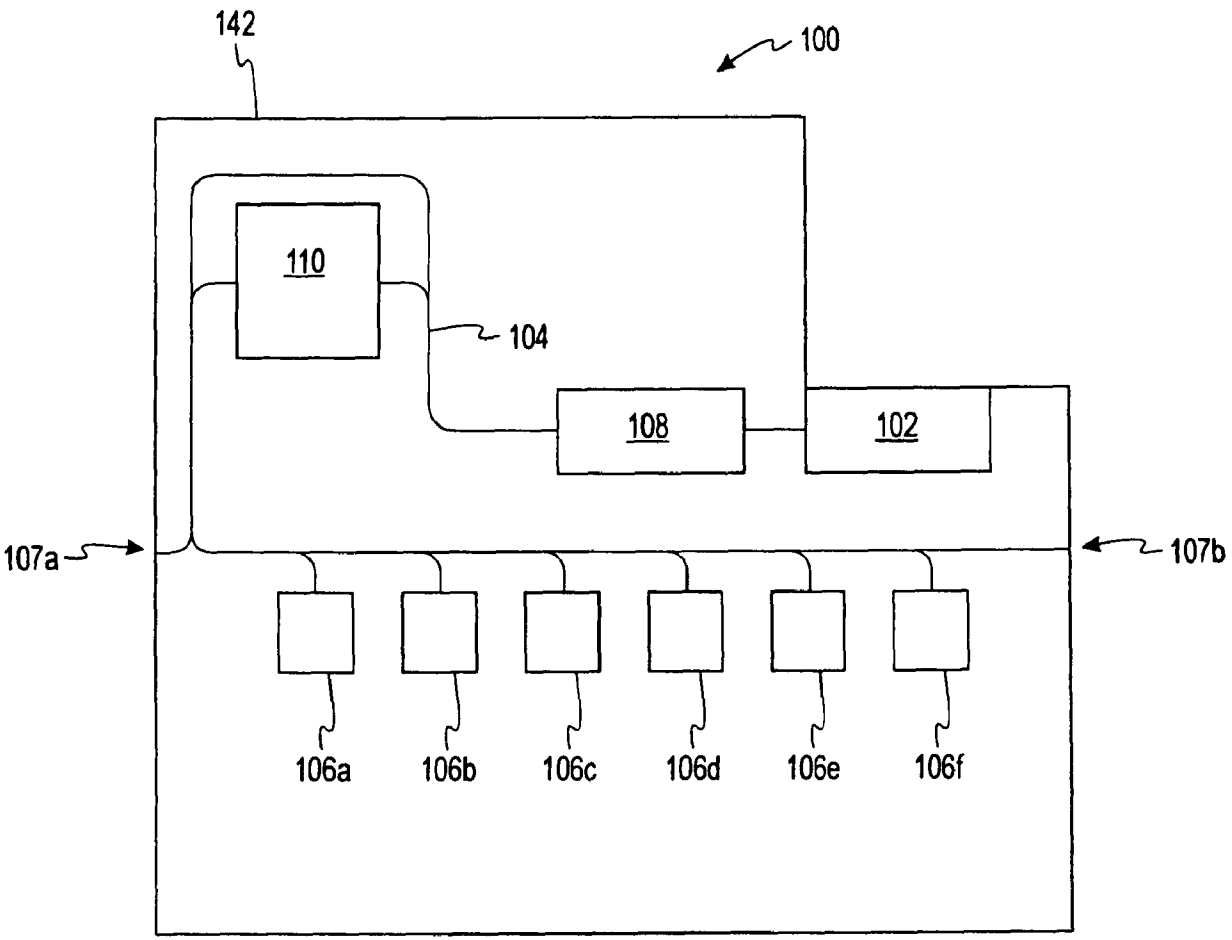
FIG. 3*a* is a conceptual view of a currency document handling device according to some embodiments.

Referring now to FIG. 3*a*, a document or currency or currency document handling device 100 according to some embodiments is illustrated. The document handling device 100 comprises an input receptacle 102, one or more of output locations or receptacles 106*a*-106*f*, a transport mechanism 104. According to some embodiments, the device 100 may comprise one or more exit ports 107*a*-107*b*. According to some embodiments comprising exit ports, the device 100 may not include any output locations or receptacles. According to some embodiments, the device 100 may also include a document or bill facing or turnover mechanism 110. According to some embodiments, the device 100 also includes one or more sensors adapted to retrieve information from passing documents or bills. According to some embodiments, some or all of these one or more sensors are located in an evaluation region 108 and may form part of an evaluation unit or a discriminating unit.

In operation, currency bills are fed, one by one (that is, individually or sequentially), from a stack of currency bills placed in the input receptacle 102 into a transport mechanism 104. The transport mechanism 104 guides currency bills past the evaluation region 108. As will be explained in more detail below, the evaluation region 108 comprises one or more sensors adapted to retrieve or detect information from passing documents or bills. The retrieved or detected information is then used to make one or more judgments about passing bills. For example, according to some embodiments, the retrieved information is used to determine along which of one or more transport paths a particular bill is to be sent and/or to which output receptacle 106*a*-106*f* or exit port 107*a*-107*b* a particular document is to be sent. For example, according to some embodiments wherein the device 100 is coupled to one or more document receiving units, the retrieved or detected information is used to determine to which internal output locations 106*a*-106*f* or external output location (via exit ports 107*a*-107*b*) to send a particular document or bill. Likewise, according to some embodiments, the retrieved information is used to determine whether to send a particular document through the facing or turn-over mechanism 110. According to some embodiments, a controller or processor coupled to the transport mechanism 104 and responsive to the information retrieved by the sensors controls the operation of the transport mechanism 104 to cause documents or bills to be directed along various transport paths and/or to different output locations.

According to some embodiments, the bill facing mechanism 110 is capable of rotating a bill 180° so that the face orientation of the bill is reversed. According to some embodiments, the leading edge of a bill (the wide dimension of the bill according to some embodiments) remains constant while the bill is rotated 180° about an axis parallel to the smaller dimension of the bill) so that the face orientation of the bill is reversed. That is, if a U.S. bill, for example, is initially presented with the surface bearing a portrait of a president facing down, it may be directed to the facing mechanism 110, whereupon it will be rotated 180° so that the surface with the portrait faces up. The decision may be taken to send a bill to the facing mechanism 110 when a selected mode of operation or other operator instruction calls for maintaining a given face orientation of bills as they are processed by the currency handling device 100. According to some embodiments, when the discriminating unit determines the face orientation of a bill does not have a desired face orientation, such a bill can be directed to the facing mechanism 110 before being delivered to an appropriate output location. Further details of examples of facing mechanisms which may be utilized for this purpose and methods and systems for employing the same are disclosed in U.S. Pat. Nos. 6,074,334 and 6,371,303, each of which is incorporated herein by reference in its entirety, and the above mentioned and previously incorporated Cummins' patent documents. Facing mechanisms such as those referred to above may be employed in conjunction with the various embodiments disclosed herein such as the devices illustrated in FIGS. 1*a*-10*b*. Alternative embodiments do not include a facing mechanism.

Evaluation Region/Discriminating Unit

According to some embodiments, the evaluation region 108 or discriminating unit comprises one or more sensors adapted to analyze, authenticate, denominate, count, image, and/or otherwise judge documents or currency bills. For example, in some embodiments of the currency handling device (currency processing or judgment device) 100, the discriminating unit can detect, for example, bill or document type, denomination, authenticity, orientation, size, color, series, fitness, tears, holes, security threads, watermarks, stiffness, barcodes, optical variable devices (OVDs) such as holograms, skewed bills or documents, and/or overlapping or doubled bills or documents. The results of the above process or processes may be used to determine to which output location a bill is directed, whether to suspend to operation of the transport mechanism, or to otherwise control the operation of the document processing system.

For example, the characteristics of the evaluation region 108 or discriminating unit may vary according to the particular application and needs of the user. According to some embodiments, the evaluation region 108 or discriminating unit can accommodate a number and variety of different types of sensors depending on a number of variables. These variables are related to whether a particular embodiment of the device is adapted to denominate, authenticate, count, and/or otherwise process bills and what distinguishing characteristics are being examined, e.g. size, thickness, color, magnetism, reflectivity, absorbability, transmissivity, electrical conductivity, etc. The evaluation region 108 or discriminating unit may employ a variety of detectors including, but not limited to, size detection sensor(s), density sensor(s), a lower and/or an upper optical scan head, a single or multitude of magnetic sensors, thread sensor(s), infrared sensor(s), ultraviolet/fluorescent light scan head(s), image sensor(s) such an image sensor adapted to retrieve a complete or partial image of a document, barcode sensor(s), MICR sensor(s), and/or other radiation sensor(s). These detectors and a host of others are disclosed in commonly owned U.S. Pat. Nos. 6,278,795 and 5,687,963, each incorporated herein by reference in its entirety as well as the above mentioned and incorporated Cummins' patent documents such as, for example, U.S. Pat. Publication No. 2005-0060055 A1.

Additionally, the systems described herein may contain fitness sensors such as density sensors, reflectance sensors, magnetic sensors, correlation, UV and soil sensors, tear detectors, etc.

In general, according to some embodiments, the one or more sensors which are employed to count, denominate, authenticate, image, and/or otherwise discriminate, evaluate, analyze, image and/or otherwise process the bills in conjunction with one or more processors associated with these sensors may be referred to as a discriminating unit and the location or locations of the sensors along a transport path may be referred to an examination or evaluation region or regions. In some embodiments, all these sensors may be located in close proximity so as to define a single examination or evaluation region while in other embodiments the sensors may be located in different regions along the transport path so that several examination regions exist.

According to some embodiments, the detected characteristics or information may then be employed in conjunction with optical character recognition (OCR) to extract alphanumeric or other information such as serial numbers and/or the retrieved document images may be stored for subsequent retrieval and display or recreation. The images, extracted data and/or detected characteristics may be stored in memory and/or used within the document processing system 200 and/or the images, extracted data and/or detected characteristic information may be sent to external devices or systems for use and/or storage in external memory devices.

The currency handling device 100 may be controlled from an integrated or a separate controller or control unit (such as controller or control unit 120 illustrated in FIG. 3*b*) which has a display and/or user-interface (e.g., 122,124 in FIG. 3*b*) coupled hereto. According to some embodiments, the document or currency processing system comprises an interface comprising, for example, a touch panel, a keyboard, a mouse, and/or physical keys or buttons. Additionally, information concerning the controller and interface and the use thereof are disclosed in the above mentioned Cummins' patent documents, all incorporated herein by reference in their entirety.

The operator can control the operation of the currency handling device 100 and/or processing system 200 through the control unit and/or user-interface. Through the control unit and/or user-interface the operator can direct the bills into specific output receptacles 106*a*-106*f* and/or other output locations by selecting various modes such as pre-programmed or user-defined modes. In alternative embodiments, the user can select pre-programmed standard or user-defined modes or create new user-defined modes based on the particular requirements of the application. For example, the operator may select a mode which instructs the currency handling device 100 to sort bills by denomination. According to such a mode, one or more detectors in the evaluation region or evaluation unit 108 would retrieve information from passing bills which is used to denominate the bills. The transport mechanism would then be controlled to route bills of different denominations to different locations such as directing one dollar bills into the first output receptacle 106*a*, five dollar bills into the second output receptacle 106*b*, ten dollar bills into the third output receptacle 106*c*, etc. A multitude of pre-programmed or user-defined modes of operation are disclosed in the above previously incorporated Cummins' patent documents and in commonly assigned U.S. Pat. No. 6,278,795, incorporated herein by reference in its entirety, which may be employed in conjunction with the present devices, methods, and systems such as the devices illustrated in FIGS. 1*a*-10*b*. The systems described herein may contain unique customization features such as user-defined keys, user-defined print outs, user-defined modes of operation, user-defined document distribution parameters, user-defined set-ups. The customization features may be controlled or changed through simple input though an interface device such as a keyboard or touch screen such as described in more detail in U.S. Pat. No. 6,311,819 B1 (incorporated herein by reference in its entirety). Also the systems described herein may utilize flash memory and $E^2$ proms for reliable storage of data, set ups, and/or operating modes.

Figure 3B:
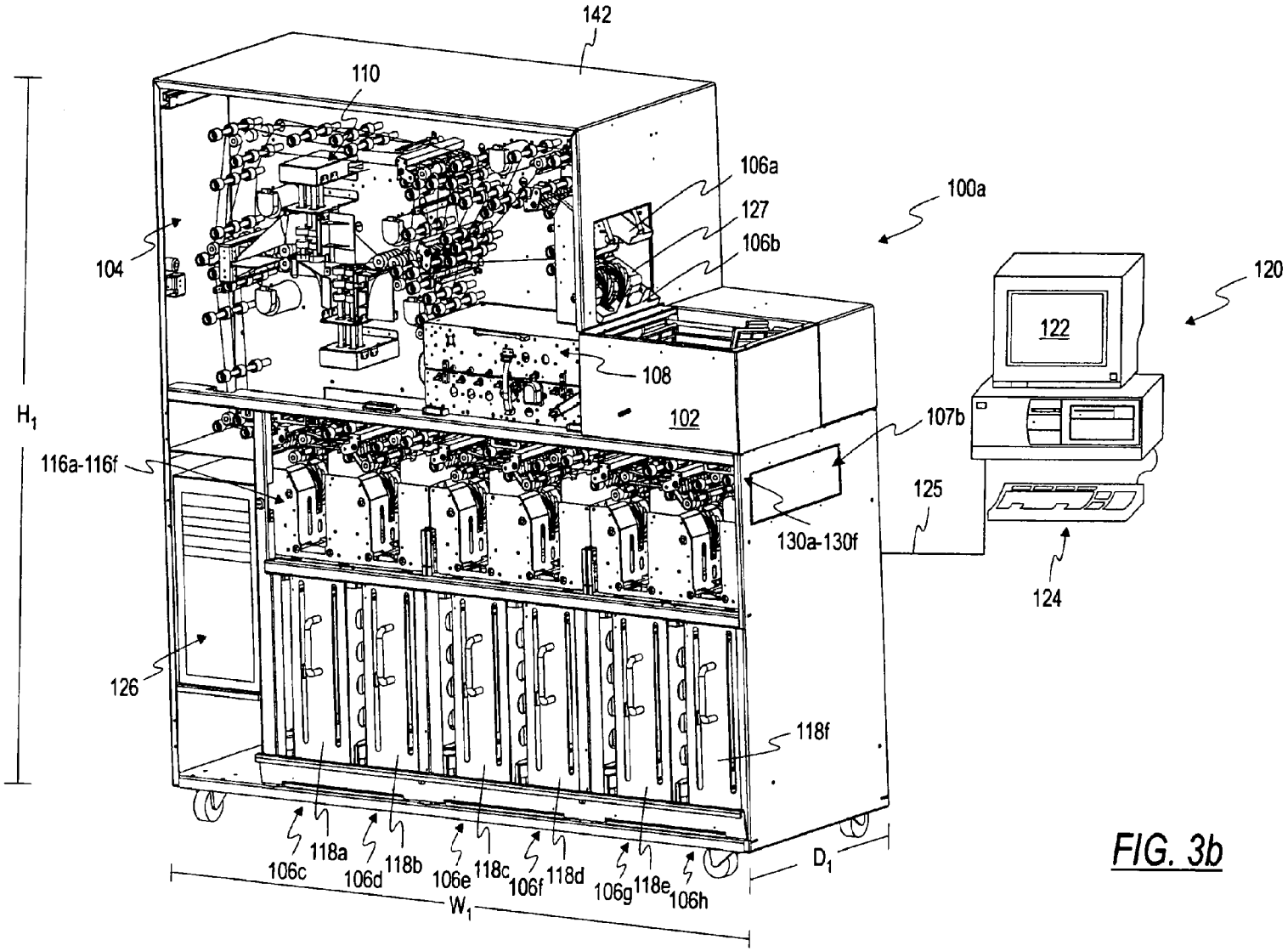
FIG. 3*b* is a perspective view of a currency document handling device according to some embodiments.
Figure 3C:
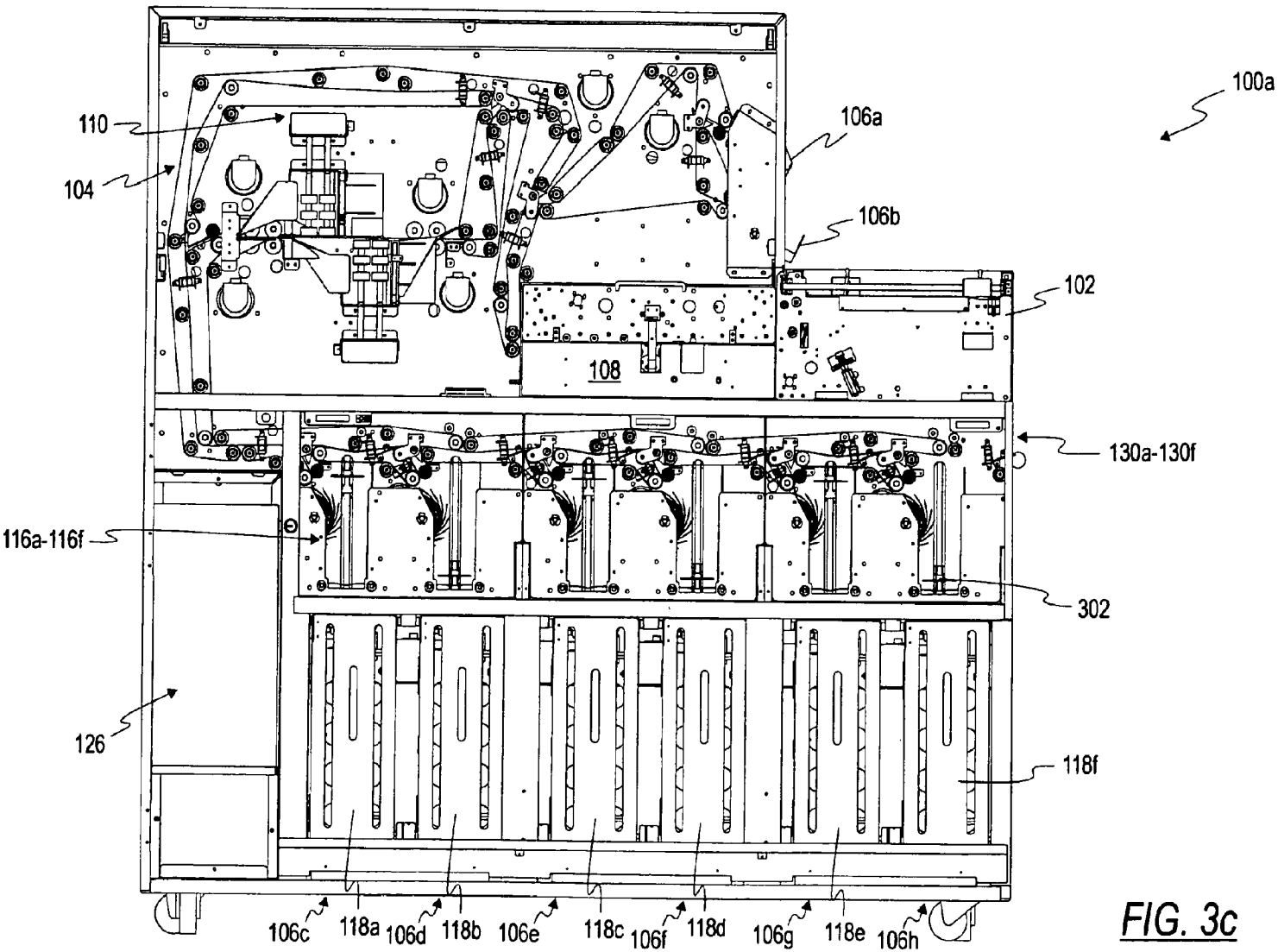
FIG. 3*c* is a front view of a currency document handling device according to some embodiments.

Referring now to FIGS. 3*b* and 3*c*, an example of a multi-pocket document handling device 100*a* such as a currency handling device according to some embodiments is illustrated. The document handling device 100*a* comprises an input receptacle 102 adapted to receive a stack of bills and a plurality of output receptacles 106*a*-106*h*. Currency bills are fed, one by one, from a stack of currency bills placed in the input receptacle 102 into a transport mechanism 104. The transport mechanism 104 guides currency bills along one or more transport paths to one of the plurality of output receptacles 106*a*-106*h*, which may include upper output receptacles 106*a*, 106*b*, as well as lower output receptacles 106*c*-106*h*. Before reaching an output receptacle 106 the transport mechanism 104 guides a bill through an evaluation region or unit 108 where a bill or document can be, for example, analyzed, authenticated, denominated, counted, and/or otherwise processed. The results of the above process or processes may be used to determine to which output receptacle 106 a bill is to be directed. According to some embodiments, a series of diverters which are a part of the transport mechanism 104, direct the bills along one or more transport paths and/or into the output receptacles 106*a*-106*h* and/or to the exits port 107*a*-107*b*. In FIGS. 3*b* and 3*c* each of the lower output receptacles 106*c*-106*h* includes a first portion designated as an escrow compartment 116*a*-116*f* and a second portion designated as a storage cassette 118*a*-118*f*. The illustrated embodiment of the currency handling device has an overall width, $W_1$, of approximately 4½ feet (1.4 meters), a height, $H_1$, of approximately 4¾ feet (1½ meters), and a depth, $D_1$, of approximately 1⅔ feet (½ meters). According to some embodiments, the currency handling device has an overall width, $W_1$, of about 58 inches (about 1½ meters).

Figure 3D:
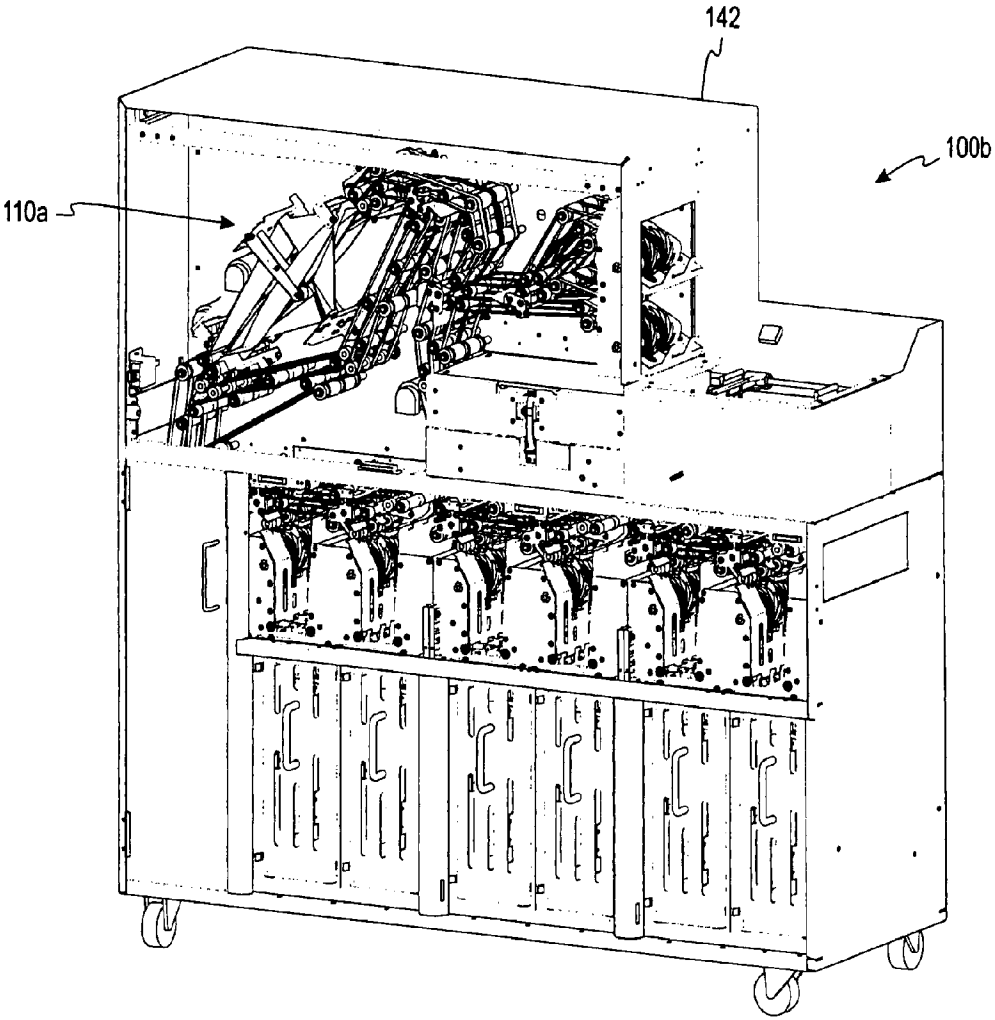
FIG. 3*d* is a perspective view of a currency document handling device according to some embodiments.

FIG. 3*d* is a perspective view of a multi-pocket document handling device 100*b* which is similar to the device 100*a* of FIGS. 3*b* and 3*c*. The device 100*b* comprises a different embodiment of a facing mechanism 110*a*.

Figure 3E:
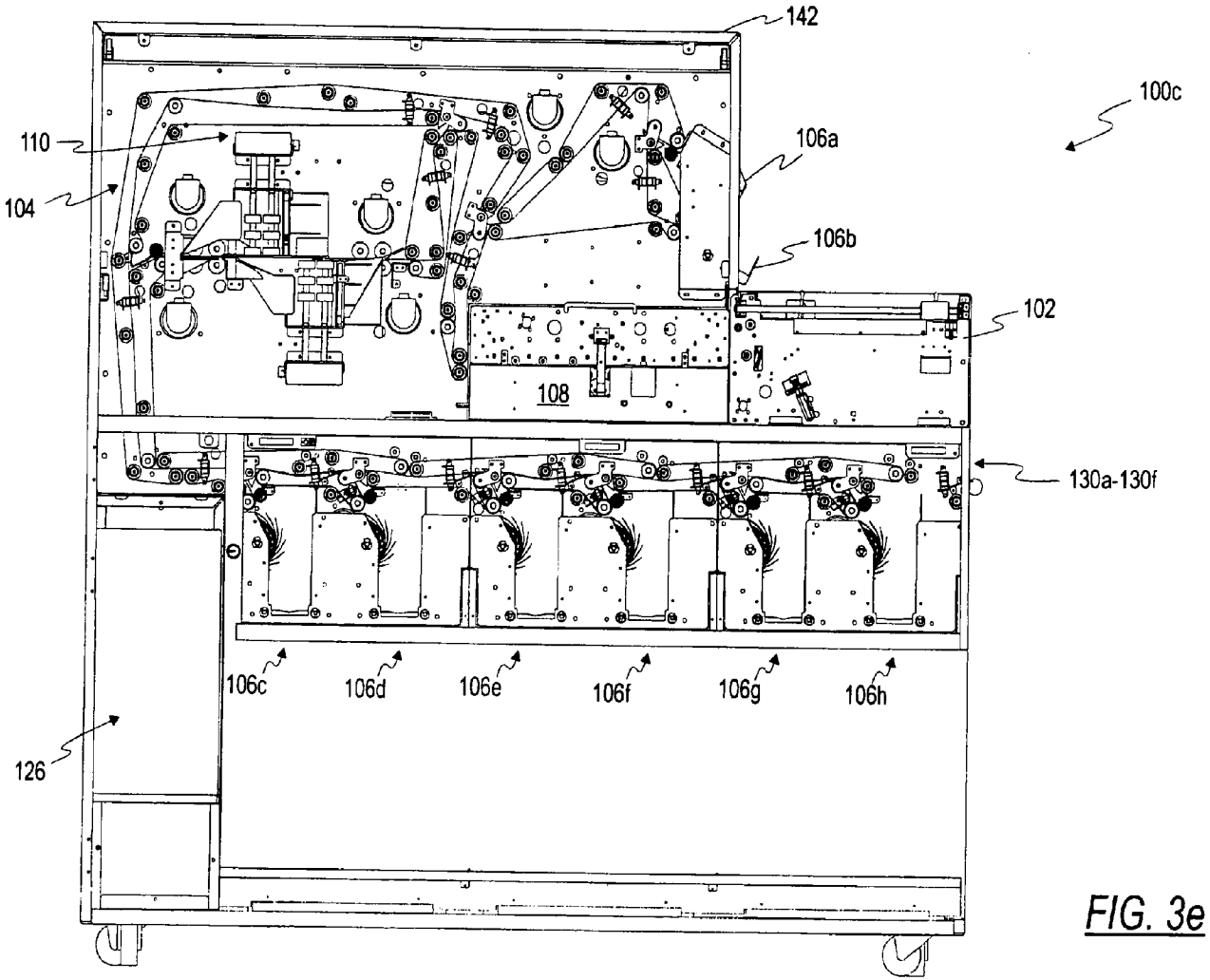
FIG. 3*e* is a front view of a currency document handling device according to some embodiments.

In FIG. 3*e* a multi-pocket document handling device 100*c* such as a currency handling device according to some embodiments is illustrated. The device of FIG. 3*e* is similar to that shown in FIGS. 3*b*-3*c* except that the lower output receptacles 106*c*-106*h* are not divided into two portions. There are no storage cassettes in the embodiment shown in FIG. 3*e*.

Additional details, modes of operation, and embodiments related or similar to those illustrated in FIGS. 3*b*-3*e* are described in many of the above mentioned and incorporated Cummins' patent documents such as, U.S. Pat. No. 6,601,687; U.S. Pat. No. 6,860,375; US Pat. Publication No. 2004-0003980; and U.S. Pat. Publication No. 2005-0060055 A1.

Figure 3F:
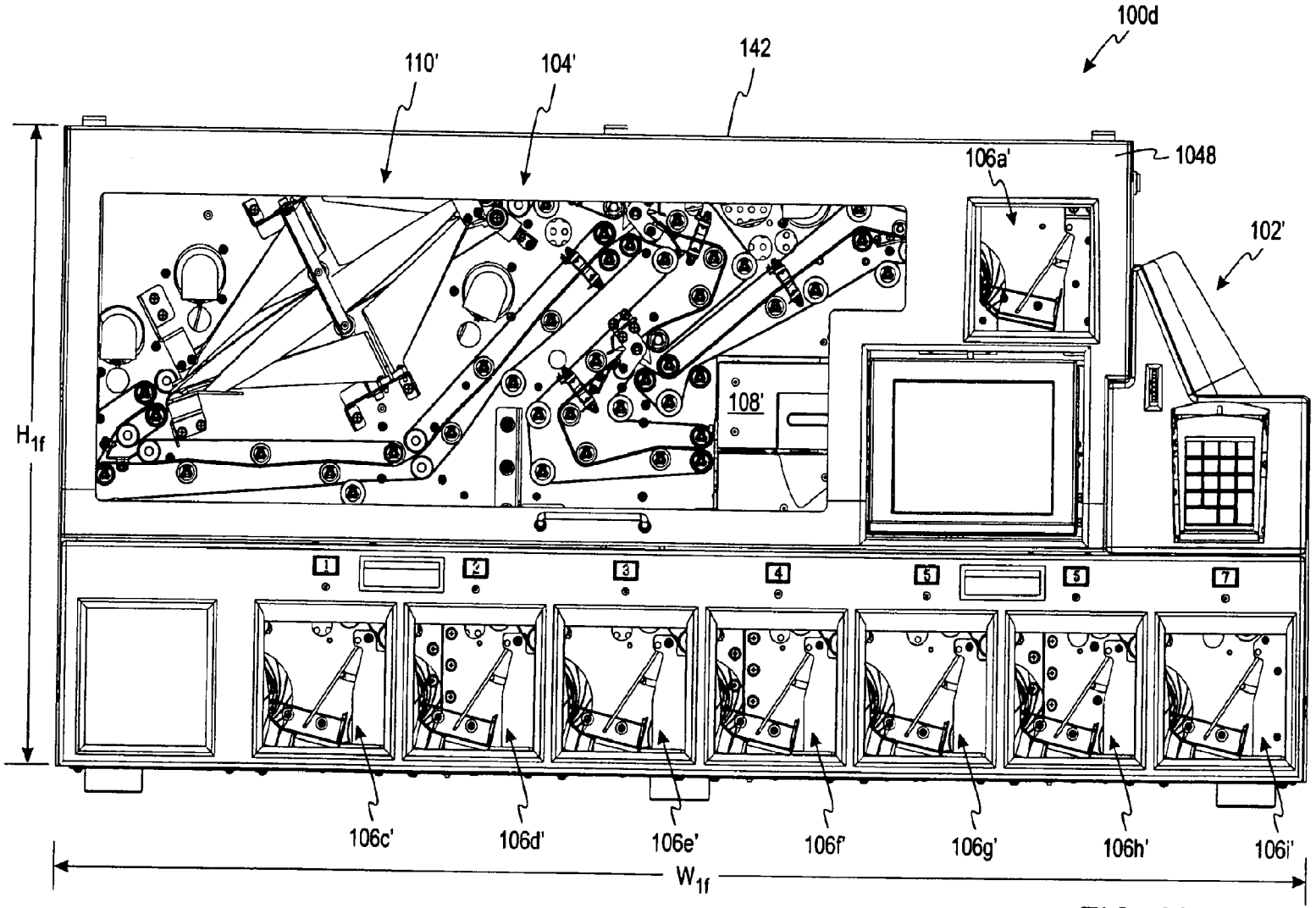
FIG. 3*f* is a front view of a currency document handling device according to some embodiments.

FIG. 3*f* illustrates an alternative currency handling device 100*d*. The currency handling device 100*d* is similar to the previously described currency handling devices depicted in FIGS. 3*b*-3*e*, however the currency handling device 100*d* has a smaller height $H_{1f}$ of approximately 2¼ feet compared to the device 100*a*. The width and depth of the device 100*d* are similar to the width and depth of the device 100*a*. The device 100*d* is described in greater detail in the above mentioned U.S. patent application Ser. No. 10/664,217 (U.S. Pat. Publication No. 2004-0149538 A1) incorporated herein by reference in its entirety. The device 100*d* has an input receptacle 102', output receptacles 106*a*'-106*i*', an evaluation region or unit 108', a transport mechanism 104', a facing mechanism 110', and a control unit.

Figure 3G:
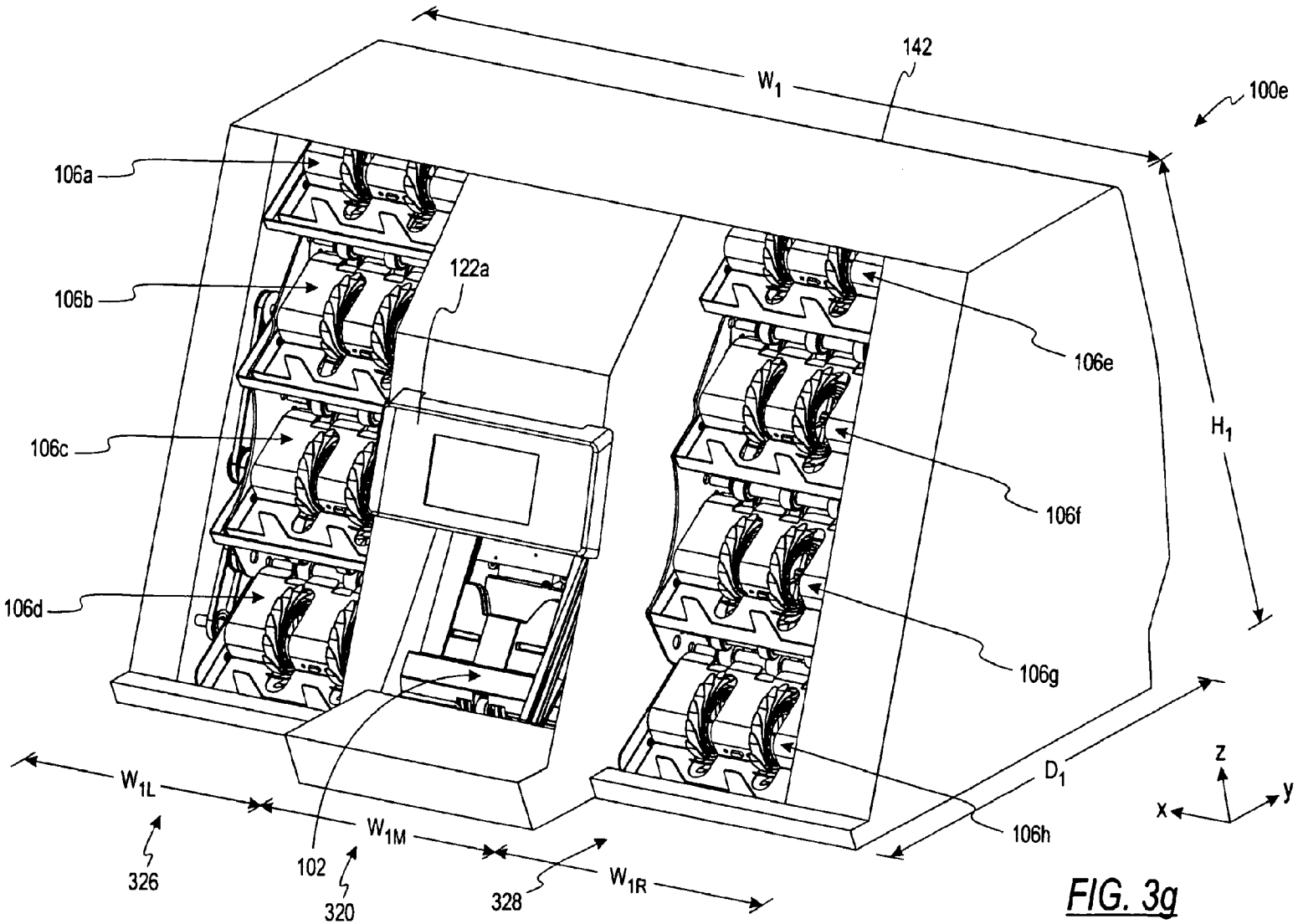
FIG. 3*g* is a perspective view of a currency document handling device according to some embodiments.

FIG. 3*g* is another exemplary document or currency handling device 100*e*. The device 100*e* has an input hopper or receptacle 102 adapted to receive a stack of currency bills to be processed, a number of output receptacles or pockets 106*a*-106*g* which are laterally offset from the input hopper 102. The device 100*e* may also comprise an operator or user interface 122*a* adapted to receive information from and/or provide information to an operator or user. In the embodiment illustrated in FIG. 3*g*, the interface 122*a* is in the form of a touchscreen. A controller causes the device to operate in a number of modes in response to the operational instructions from the user received via the user interface 122*a*. The device also comprises a transport mechanism adapted to transport bills, one at a time, from the input hopper 102 to one or more of the output receptacles 106*a*-106*g* and/or external document receiving units (not shown) based on one or more criteria. As with the devices 100 described above, the device 100*e* may comprise one or more sensors which can be employed to count, denominate, authenticate, image, and/or otherwise discriminate, evaluate, analyze, process and/or image the bills. The results of the above process or processes may be used to determine to which output receptacle or location a bill is to be directed.

For example, the device 100*e* may be adapted to determine the denomination of the bills placed into the input hopper and then sort the bills into the various output receptacles based on their denomination, e.g., $1 bills may be routed to pocket 106*a*, $2 bills to pocket 106*b*, $5 bills to pocket 106*c*, etc. In some embodiments, pocket 106*h* may be used as a reject pocket and used to receive bills or documents which cannot be denominated as having one of the seven U.S. denominations, bills suspected to be counterfeit (suspect bills), and/or bills or documents meeting or failing to meet some other criterion.

According to some embodiments currency bills are placed in the input receptacle 102 with their wide edges generally parallel to the front of the machine, that is, parallel to the X-axis as indicated in FIG. 3*g*. The currency bills are fed from the input receptacle, one by one, inward wide-edge leading into the device 100*e*.

According to some embodiments, the multi-pocket sorter 100*e* is compact having a height ($H_1$) of about 27 inches (about 68 cm), width ($W_1$) of about 44 inches (about 110 cm), and a depth ($D_1$) of about 25½ inches (about 65 cm) and weighs approximately 250 lbs. (about 113 kg). A central section 320 has a width ($W_{1M}$) of about 14 inches (35 cm). A left section 326 has a width ($W_{1L}$) of about 15 inches (about 38 cm). A right section 328 has a width ($W_{1R}$) of about 15 inches (about 38 cm). Thus according to some embodiments an eight output receptacle sorter is provided which has a footprint (width×depth) of less than about 1122 $in^2$ (about 8 $ft^2$) (about 7250 $cm^2$) and a volume of less than about 30,300 $in^3$ (about 17½ $ft^3$) (about ½ $m^3$). Additionally details, embodiments, and modes of operation related or similar to FIG. 3*g* are described in the above mentioned and incorporated U.S. patent application Ser. No. 10/903,745 (U.S. Pat. Publication No. 2005-0029168) and U.S. patent application Ser. No. 11/036,686 (U.S. Pat. Publication No. 2005-0183928).

Figure 3H:
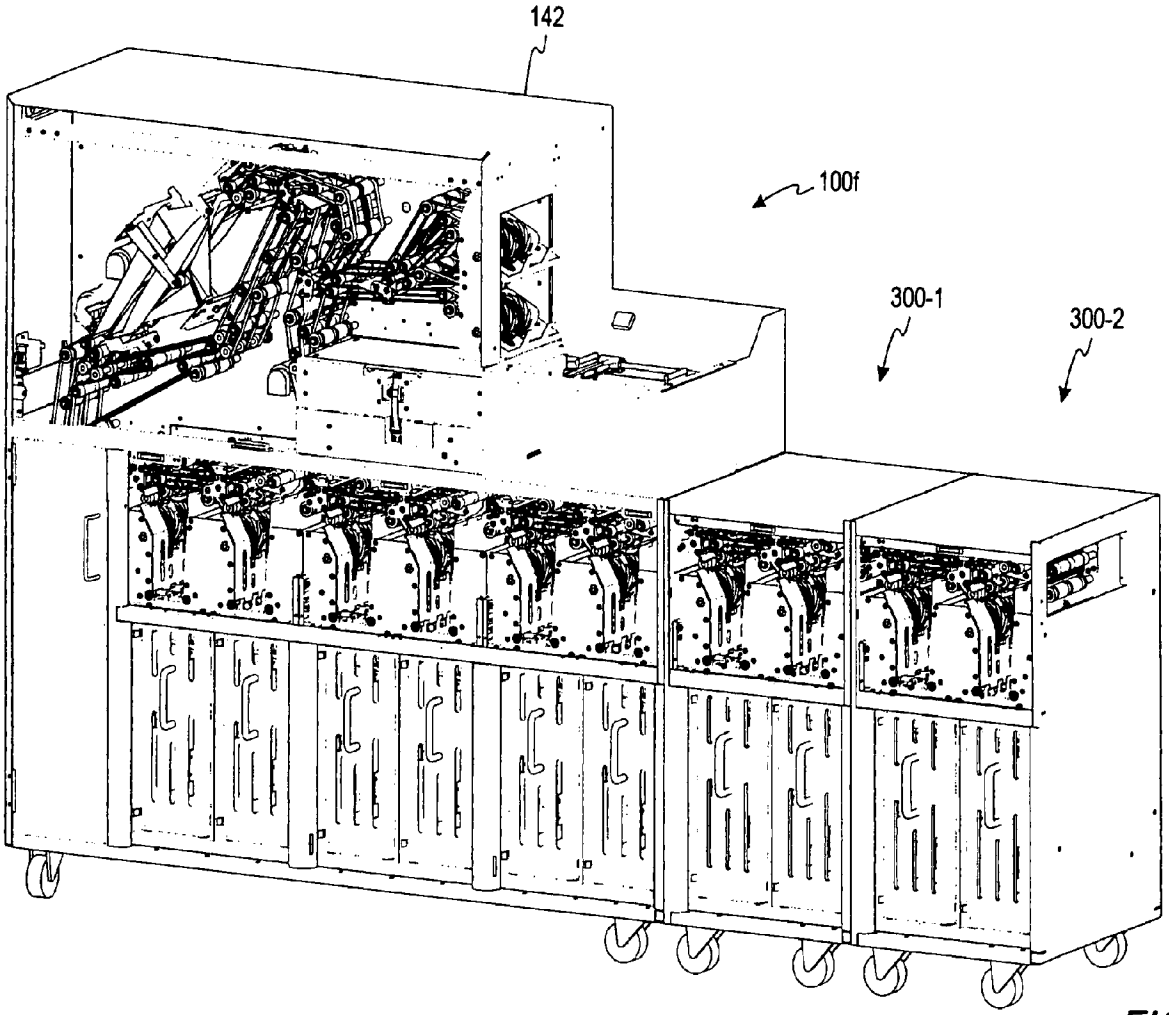
FIG. 3*h* is a perspective view of a currency document processing system comprising a document handling device and modular output receptacles according to some embodiments.

The various handling devices 100 described herein may be employed in conjunction with one or more of the document receiving units such as units comprising output receptacles and/or strapping units and/or shredders. For example, in some embodiments, modular output receptacles can be provided to add many more output receptacles to a currency processing system. Each modular unit may comprise one, two or more output receptacles. In some embodiments, several modular units may be added at one time to a currency processing system. FIG. 3*h* is a perspective view of a currency processing system comprising a currency handling device 100*f* and two modular receptacle units 300*a*, 300*b* coupled in series to the main housing 142 of the currency handling device 100*f*. In the embodiment illustrated, each modular receptacle unit comprises two output receptacles.

In general, when a modular document receiving unit is coupled directly or indirectly to a document handling device 100, the system may be adapted to permit documents such as currency bills to be sent to one or more output locations residing in the document receiving unit. When a modular document receiving unit is decoupled from a document handling device 100, documents may no longer be sent to such a removed document receiving unit. According to some embodiments, the document processing system contains sensors adapted to detect when, how many, the location(s), and/or what types of modular document receiving units are coupled directly or indirectly to a document handling device. Additionally or alternatively, an operator interface associated with a document handling device may be provided to permit an operator to indicate when, how many, the location(s), and/or what types of modular document receiving units are coupled directly or indirectly to a document handling device. According to some embodiments, the document handling device or system comprises an interface adapted to permit an operator to program the system to send documents to the various output locations present in a document processing system according to one or more criteria detected from processed documents and/or based on one or more selected modes of operation.

Strapping

In general, some embodiments of the document or currency processing systems comprise strapping systems comprising one or more strapping units in combination with a document or currency handling device comprising an input receptacle, a document or currency evaluating unit or region, and an output receptacle or a plurality of output receptacles. In some embodiment, a currency evaluating unit may be adapted to discriminate the denomination of processed bills and/or to authenticate processed bills. The handling device is adapted to count the number of documents or bills transported into each pocket. According to some embodiments, the device is adapted to stop transporting additional documents or bills into a particular output receptacle or location once the number of documents or bills has reached a strap limit. At that point, the stack of bills in an output receptacle which has reached a strap limit may be strapped by a strapping unit. The devices described in connection with FIGS. 3*a*-3*h* above and FIGS. 4*a*-10*b* and embodiments 0-167 below may be employed in conjunction with various strapping systems such as those described herein and in the Cummins' patent documents including those adapted to transport, denominate and/or authenticate, and strap bills or documents such as currency documents at speeds equal to or greater than, for example, 400, 800, 1000, 1200, and/or 1500 documents or bills per minute.

Figure 3I:
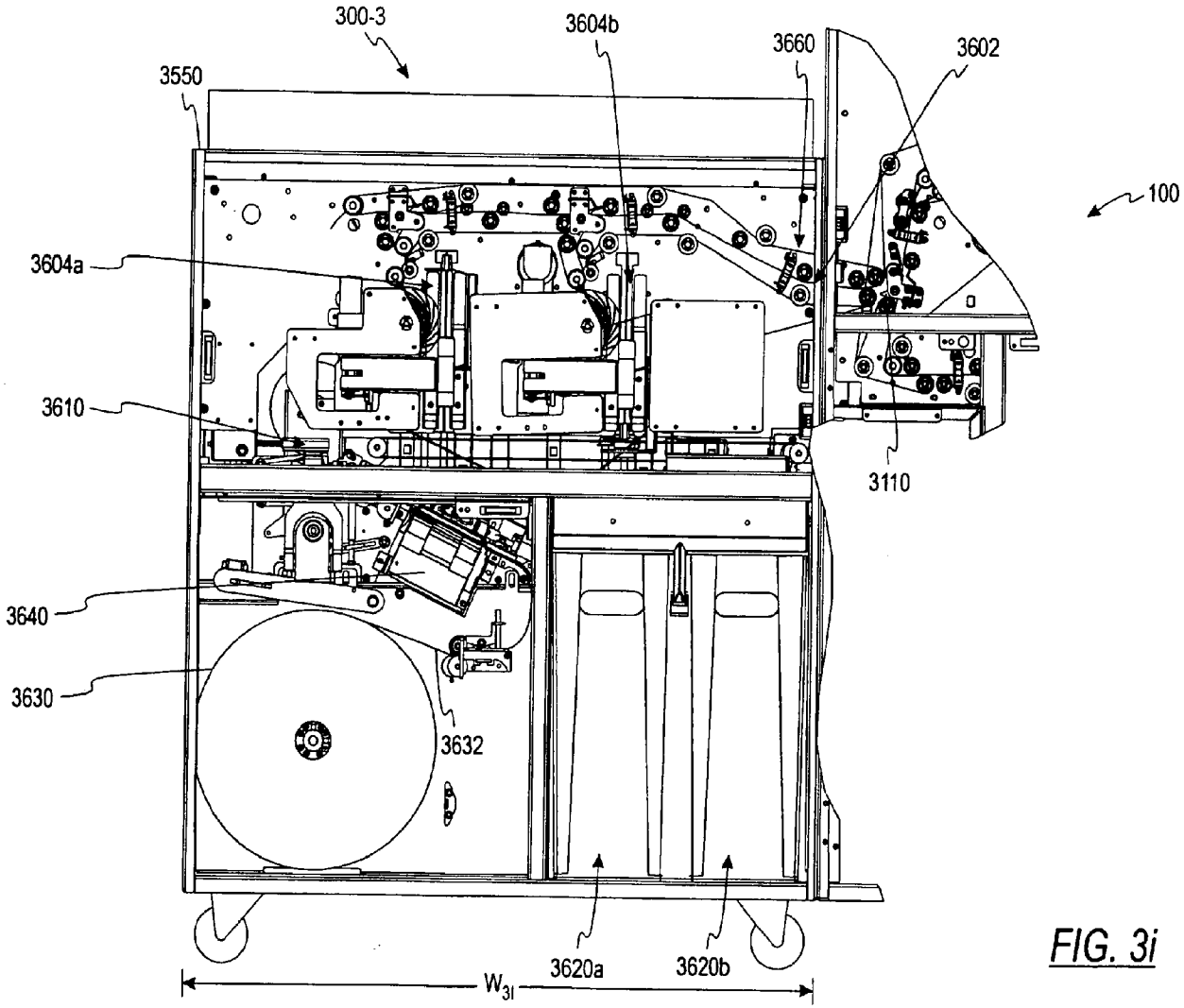
FIG. 3*i* is a front view of a strapping unit according to some embodiments.

FIG. 3*i* is a front view of an example strapping unit 300-3. As shown, the strapping unit 300-3 is coupled to the side of a document handling device 100. Bills or documents enter the strapping unit 300-3 at area 3602 and are transported to one to one of two stacking positions or receptacles 3604*a,b*. In some embodiments, bills or documents are sent to a particular one of the stacking receptacles 3604*a,b* until a strap limit is reached. When a strap limit is reached, incoming documents then begin to be delivered to the other stacking receptacle. In the meantime, the complete stack of documents (a stack having the number of documents defined by a strap limit) are then transferred to a strapping position 3610 where the stack is strapped. Once a stack has been strapped, it is then transferred into a strapped currency or document storage bin 3620*a,b*. Also illustrated in FIG. 3*i* is a spool 3630 of strapping or banding material 3632. According to some embodiments, the strapping unit 300-3 has a width, $W_{3I}$, of about 36 inches (91 cm) or less.

According to some embodiments, the strapping systems or units used in the document or currency processing systems according to the present concepts are adapted to strap bundles of strapped currencies. For example, some embodiments are adapted to place a strap around a stack of ten straps of notes, each strap containing one hundred notes. Such an arrangement of a strap about ten straps of notes, each strap having one hundred notes is referred to as a standard bundle of notes—one bundle having one thousand notes.

Additionally details, embodiments, and modes of operation of strapping systems and units such as those related or similar to that shown in FIG. 3*i* are described in the above mentioned and incorporated Cummins' patent documents such as U.S. patent application Ser. No. 10/460,071 filed Jun. 12, 2003 entitled "Currency Processing and Strapping Systems and Methods," published as US Pat. Publication No. 2004-0003980.

Additional details concerning document or currency handling devices 100, systems, and methods such as those illustrated and described in conjunction with FIGS. 3*a*-3*i* are provided in the above mentioned and incorporated Cummins' patent documents. For example, some additional details described in the above Cummins' patent documents include additional details concerning the evaluation region or unit 108, the transport mechanism, the input receptacle, the various output receptacles including escrow compartments and cassettes, and various facing mechanisms. Likewise various modes of operation are described in the above Cummins' patent documents (e.g., various strapping and stacking-for-strapping modes) and it is contemplated that such modes of operations can be used in conjunction with the various systems, devices and methods described herein.

Reduced Width Processing Systems and Angled Transport Units

Figure 4A:
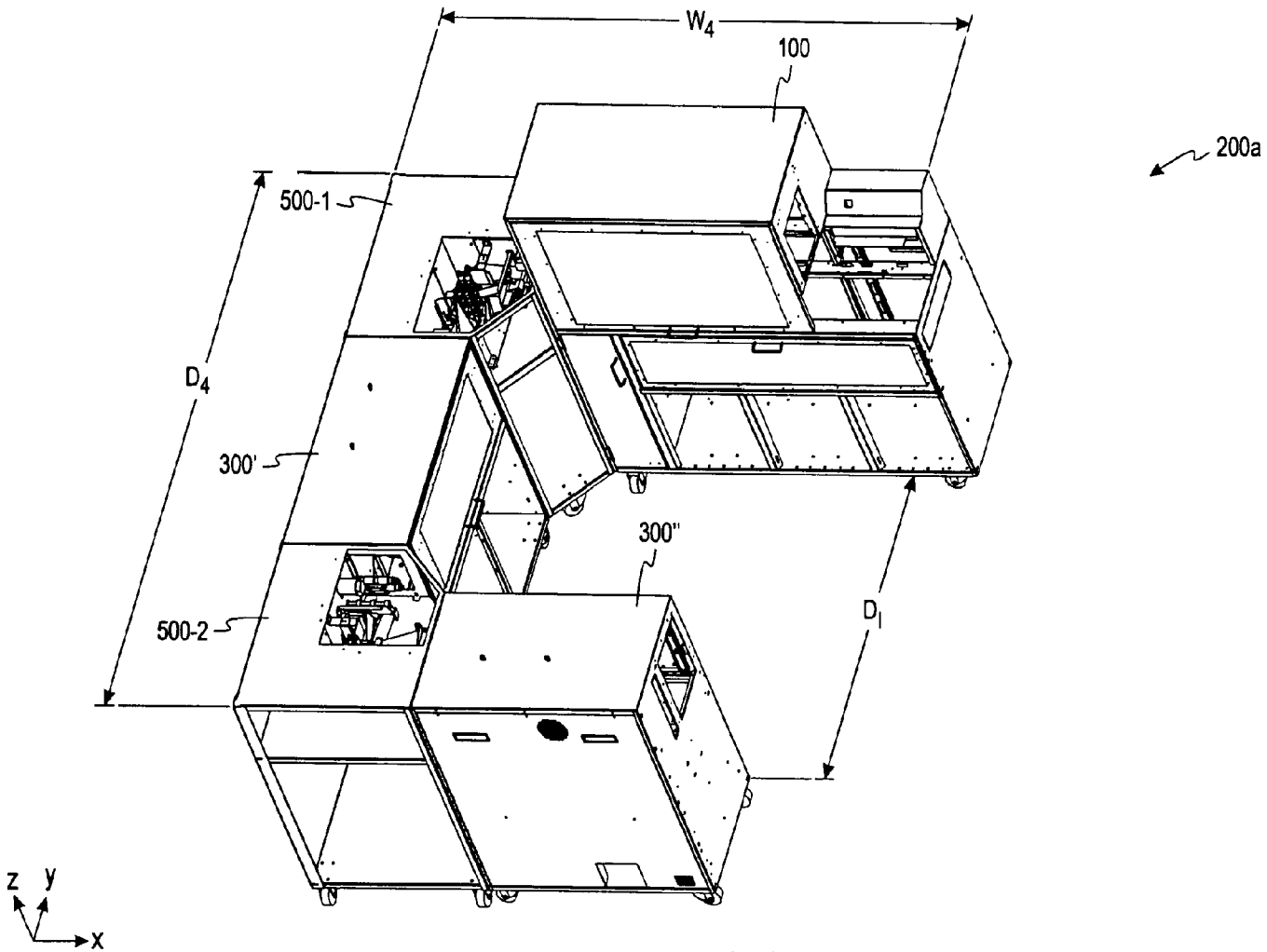
FIG. 4*a* is a perspective view of a reduced width multi-pocket currency document processing system according to some embodiments.
Figure 4B:
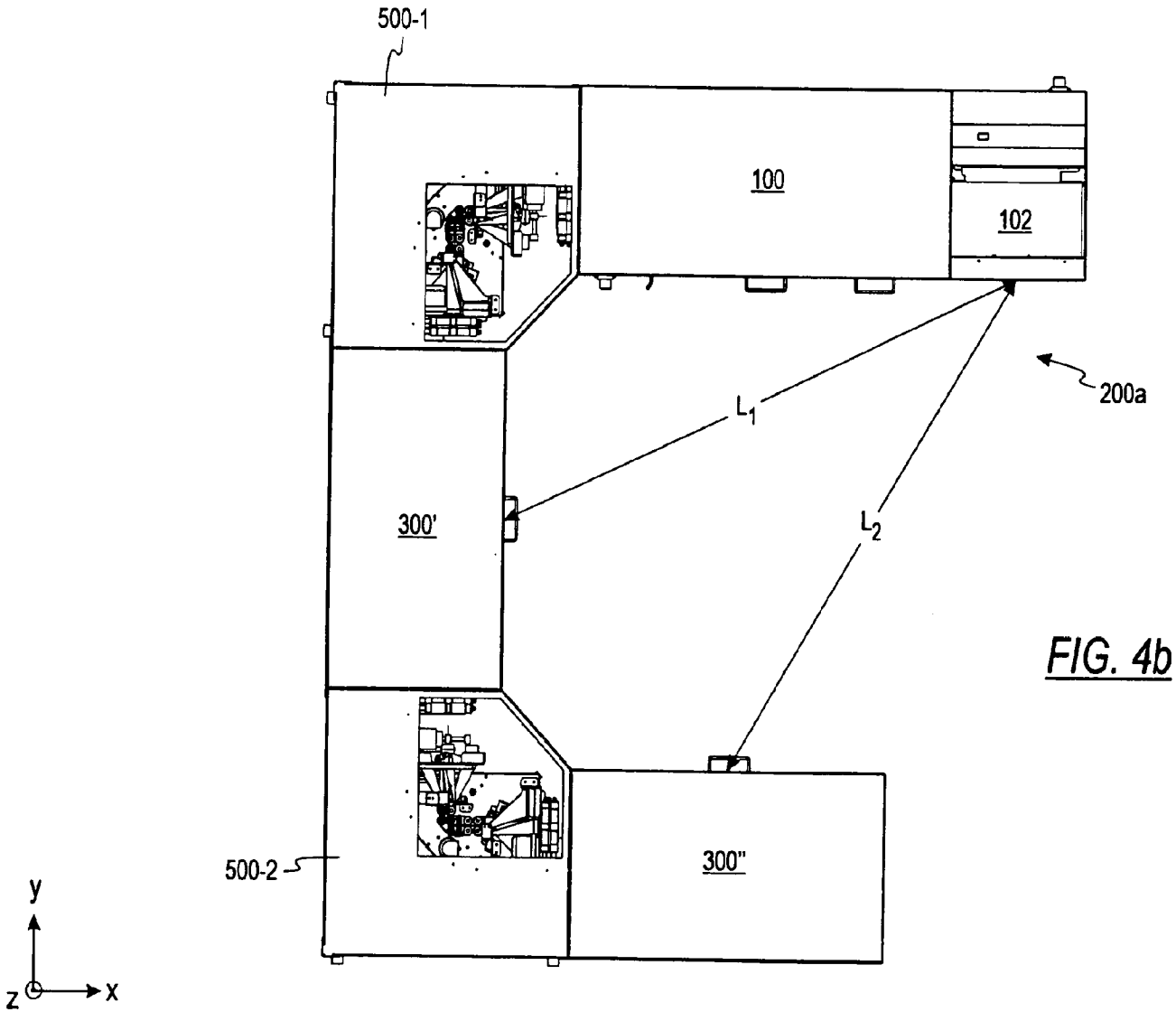
FIG. 4*b* is a top view of the system of FIG. 4*a;*

Turning now to FIGS. 4*a* and 4*b*, a perspective view (FIG. 4*a*) and a top view (FIG. 4*b*) of a reduced width multi-pocket document or currency document processing system 200*a* is shown. The reduced width multi-pocket currency document processing system 200*a* comprises a handling device 100, a first angular transport unit 500-1, a first strapping unit 300', a second angular transport unit 500-2, and a second strapping unit 300". According to some embodiments, the handling device 100 may be identical or similar to one of the handling devices 100 described above such as those described in connection with FIGS. 3*a*-3*g*. An operator may program the system 200*a* to direct bills of particular denomination to particular output receptacles or locations of the handling device 100, the first strapping unit 300', or the second strapping unit 300". For example, if it is determined that a bill, or currency document, is to be routed to an output location within the second strapping unit 300", the bill would travel through the handling device 100, through the first angular transport unit 500-1, through the first strapping unit 300', through the second angular transport unit 500-2 and into the second strapping unit 300". Similarly, if a bill, or currency document, is to be routed to an output location within the first strapping unit 300', the bill would travel through the handling device 100, through the first angular transport unit 500-1, and into the first strapping unit 300'.

As can be seen in FIGS. 4*a* and 4*b*, the processing system 200*a* is generally U-shaped. According to some embodiments, the currency handling device 100 has a length of about 58 inches (about 1.5 meters) and a depth of about 20 inches (about 1⅔ feet) (about ½ meter), the strapping units 300', 300" have a length of about 36 inches (about 0.3 feet) (about 0.9 meters) and a depth of about 20 inches (about 1⅔ feet) (about ½ meter), and the angular transport units 500-1, 500-2 have a length and depth of about 28 inches (about 2⅓ feet) (about 0.7 meters). According to some embodiments, the system 200*a* has a width $W_4$ of approximately 86 inches (about 7.2 feet) (about 2¼ m) and a depth $D_4$ of approximately 92 inches (about 7.6 feet) (about 2½ m). Thus, according to some embodiments, a currency processing system comprising a currency handling device and modular two strapping units is provided that has a width of less than about 7½ feet (about 2.3 m). The height of the system may be generally identical or similar to that of handling devices previously described in connection with FIGS. 3*b*-3*e*. The width $W_4$ of the system 200*a* is approximately 44 inches or approximately 4 feet (about 1.2 m) less than systems having a linear arrangement of a similar currency handling device and two external strapping units. The depth $D_4$ if the system 200*a* is approximately 6 feet (1.8 m) more than prior systems. Thus, the system 200*a* may be utilized in a location that does not have sufficient width to contain a prior processing and strapping system, but the location did have additional depth for the processing and strapping system. The system 200*a* also allows currency document receiving units devices to be utilized, such that a combination of devices may be arranged to comprise a currency processing system that best matches a customers needs within a particular amount of space. It is contemplated that the devices utilized in the currency document processing system may be within a common housing, or the devices may be stand-alone modularly connected units.

According to some embodiments, angled transport document or currency processing system are provided which have one or more output locations closer to the input receptacle than for corresponding linearly arranged systems. For example, in the embodiment illustrated in FIG. 4*a*, the interior distance $D_1$ between the front of the currency handling unit 100 and the front of the second document receiving unit 300" is about 52 inches (about 4⅓ feet) (about 1⅓ meters). Referring to FIG. 4*b*, according to some embodiments, the distance $L_1$ between the center of the front of the input receptacle 102 and the center of the first document receiving unit 300' is about 64 inches (about 5⅓ feet) (about 1⅔ meters) and the distance $L_2$ between the center of the front of the input receptacle 102 and the center of the second document receiving unit 300" is about 61 inches (about 5 feet) (1½ meters).

While the document handling device 100 depicted in FIGS. 4*a* and 4*b* are similar to the document handling devices depicted in FIGS. 3*b*-3*e*, other embodiments may employ other document handling devices including, for example, the document handling devices depicted in FIGS. 3*f*-3*g*. Accordingly, the height of the system 200*a* would correspond to the height of devices 100*d* and 100*e* of FIGS. 3*f*-3*g*. The height of the remaining components 300 and 500 may have a corresponding height such that the height of the overall system 200*a* is reduced. According to some such reduced height embodiments, the system 200*a* may be placed upon one or more tables, shelves, or other structures to raise the system 200*a* to a height desired for a particular application such as a comfortable height for use of the system 200*a* by one or more operators sitting in chair(s) such as, for example, chairs on casters or rollers or a comfortable height for use of the system 200*a* by one or more operators standing.

Likewise, while the angular transport units 500-1, 500-2 are depicted in FIGS. 4*a*-4*b* as being the type of angular transport unit describe below in connection with FIGS. 5*a*-5*c*, it is to be understood that other types of angular transport units may be employed in conjunction with the arrangement depicted in FIGS. 4*a*-4*b*. Likewise, while the document receiving units 300' and 300" are described as being strapping units, it is be understood that one or more of the document receiving units may be other types of document receiving units such as units containing output receptacles and/or document shredding units.

The operation of the processing system 200*a* according to some embodiments will now be described using the example wherein $20 bills have been designated to be strapped with the first strapping unit 300' and $10 bills have been designated to be strapped with the second strapping unit with reference to FIGS. 4*a* and 4*b*. A stack of bills to be processed is placed in an input receptacle 102 of the handling device 100. Bills are then fed, one by one, through a discriminating region wherein one or more detectors collects information from passing bills to, for example, denominate passing bills. Based on the information detected from a bill, that bill is directed to one of the output receptacles of the handling device 100 or to one of the strapping units 300', 300". In the present example, if the bill is determined to be a $20, it is routed to the first strapping unit 300', and if the bill is determined to be a $10, it is routed to the second strapping unit 300". According to some embodiments and with reference to FIG. 3*i*, when the first $20 bill is detected it is a routed into a stacking position 3604*a* of the first strapping unit 300'. Using a strap limit of one hundred bills as an example, the next ninety-nine $20 bills are also routed to stacking position 3604*a* of the first strapping unit 300'. However, the 101$^{st}$ $20 bill is directed to stacking position 3604*b* (of the first strapping unit. The stack of one hundred $20 bills are then transferred from the stacking position 3604*a* to the strapping position 3610 where the stack of one hundred $20 bills is strapped with strapping or banding material 3632. The strapped stack of $20 bills is then deposited into one of the strapped currency storage bins 3620*a,b*.

In the meantime, any incoming $20 bills are directed to the second stacking position 3604*b*. More specifically, the 101$^{st}$ through the 200$^{th}$ $20 bill sent to the first strapping unit 300' are stacked in stacking position 3604*b*. Once the 200$^{th}$ $20 bill has been delivered to the second stacking position 3604*b*, the now complete stack of one hundred $20 bills in stacking position 3604*b* is then transferred to the strapping position 3610 where it is strapped and then to one of the strapped currency storage bins 3620*a,b*. In the meantime, any incoming $20 bills are directed to the first stacking position 3604*a*, i.e., the 201$^{st}$-300$^{th}$ $20 bills.

Similarly, in the present example, when the first $10 bill is detected it is routed into a stacking position 3604*a* of the second strapping unit 300". Using a strap limit of one hundred bills as an example, the next ninety-nine $10 bills are also routed to stacking position 3604*a* of the second strapping unit 300". However, the 101$^{st}$ $10 bill is directed to stacking position 3604*b* of the second strapping unit 300". The stack of one hundred $10 bills are then transferred from the stacking position 3604*a* to the strapping position 3610 where the stack of one hundred $10 bills is strapped with some of the strapping or banding material 3632. The strapped stack of $10 bills is then deposited into one of the strapped currency storage bins 3620*a,b*.

In the meantime, any incoming $10 bills are directed to the second stacking position 3604*b*. More specifically, the 100 through the 200$^{th}$ $10 bill sent to the second strapping unit 300" are stacked in stacking position 3604*b*. Once the 200$^{th}$ $10 bill has been delivered to the second stacking position 3604*b*, the now complete stack of one hundred $10 bills in stacking position 3604*b* is then transferred to the strapping position 3610 where it is strapped and then to one of the strapped currency storage bins 3620*a,b*. In the meantime, any incoming $10 bills are directed to the first stacking position 3604*a*, i.e., the 201$^{st}$-300$^{th}$ $20 bills.

This process is continued with each set of hundred bills being delivered to alternating ones of the stacking positions 3604*a,b* of both the first and second strapping units 300', 300". Such a procedure increases the throughput of the strapping units 300',*b* and system 200*a* as the operation the strapping units need not be suspended while one stack of bills is being strapped.

For a bill to be routed to the first strapping unit 300' the bill passes through the first angular transport unit 500-1 to be rotated so that the bill may enter the first strapping unit 300'.

For a bill to be routed to the second strapping unit 300" the bill passes through the first angular transport unit 500-1 to be rotated so that the bill may enter the first strapping unit 300'. The bill then is transported through the first strapping unit 300' to the second angular transport unit 500-2. The bill is rotated by the second angular transport unit 500-2 so that the bill may enter the second strapping unit 300".

According to some embodiments, bill location sensors are positioned throughout the transport path of the processing system 200*a* to monitor and keep track of the location of each bill along the transport paths of the system 200*a*. While the embodiment depicted in FIGS. 4*a* and 4*b* show two angular transport units 500-1, 500-2, it is contemplated that only a single angular transport unit may be used. In such an embodiment, the depth of the system would be greater, and the system would be generally L-shaped. Other embodiments may employ three or more angular transport units.

According to some alternate embodiments, it is contemplated that one or more additional output receptacle units may replace at least one of the strapping units. For example, one or both of the strapping units 300', 300" shown in FIGS. 4*a*, 4*b* may be replaced by external output receptacle units such as those depicted in FIG. 3*h*.

According to yet a further alternate embodiment, it is contemplated that a currency document shredding device may replace at least one of the strapping units.

According to a further alternate embodiment it is contemplated that a third angular transport unit may also be used in accord with the present concepts to connect another strapping unit or additional output receptacles to a document processing system. According to some such embodiments, the system has a generally G-shape.

Figure 5A:
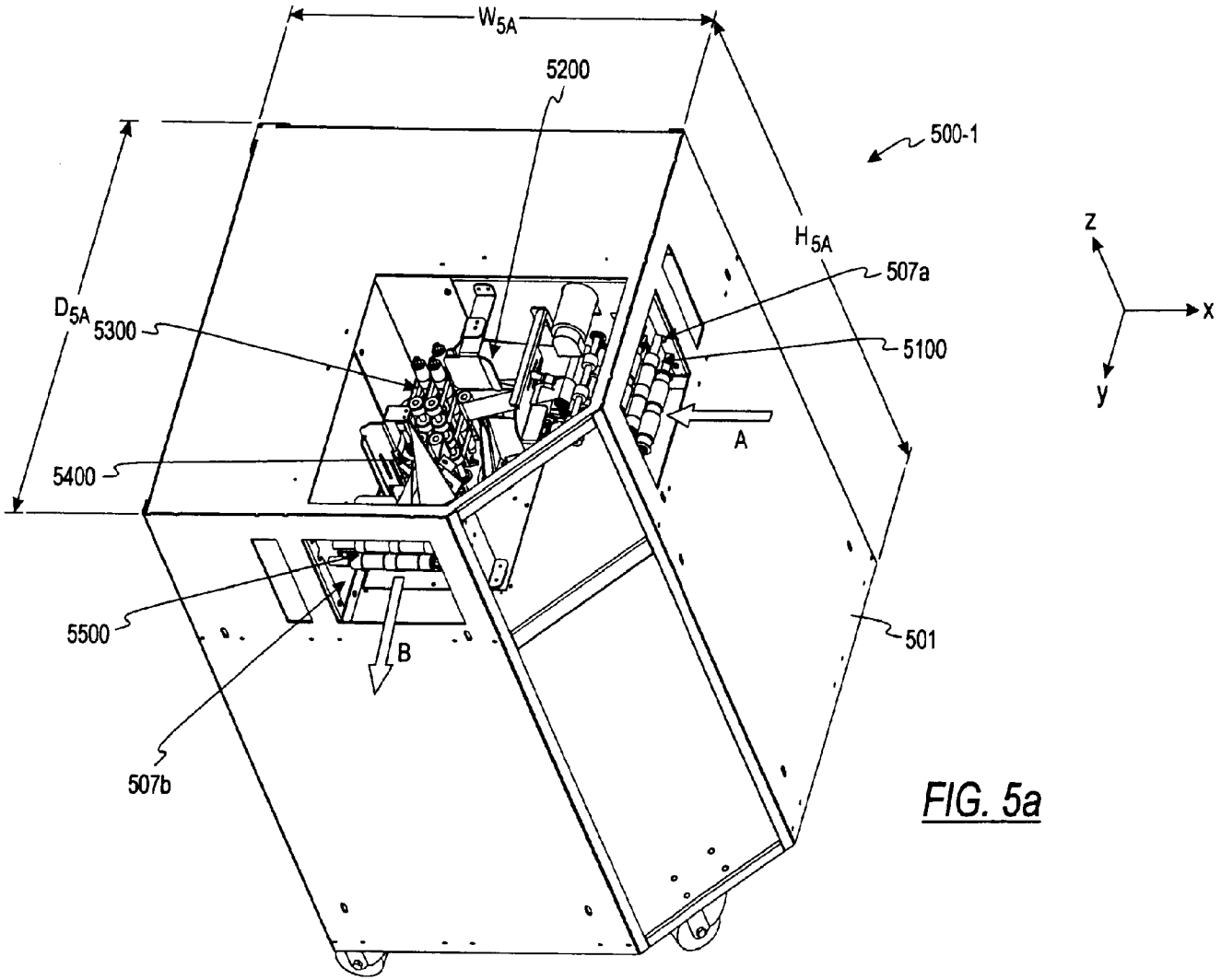
FIG. 5*a* is a perspective view of angular transport unit according to some embodiments.

Turning next to FIG. 5*a*, a perspective view of an angular transport unit 500-1 is shown according to some embodiments. According to some embodiments, the angular transport unit 500-1 comprises a first transport section or entry transport section 5100, a second transport section 5200, a third transport section 5300, a fourth transport section 5400, and a fifth transport section 5500. The first transport section 5100 is an entry transport section 5100. The fifth transport section 5500 is an exit transport section 5500. The transport sections 5100-5500 are contained within a housing 501. The housing has an entry port 507*a* and an exit port 507*b*. The angular transport unit 500-1 depicted in FIG. 5*a* is a right-angle transport unit, in that an angle formed between the direction of motion of a bill or document entering the angular transport unit 500-1 at the entry port 507*a* (see arrow A) and the direction of motion of the bill or document exiting the angular transport unit 500*b* at the exit port 507*b* is approximately 90° (See arrow B). The entry transport section 5100 is adapted to receive a bill from a first device, such as a handling device or a strapping unit. The exit transport section is adapted to transport a bill to a second device, such as a strapping unit, or an output receptacle unit, or a shredder unit, or any other currency document receiving unit known in the art.

The second, third, and fourth transport sections 5200-5400 rotate a bill approximately 90° about a generally vertical axis, such that a bill leaving fifth section 5500 of the angular transport unit 500-1 is traveling in a direction generally normal to the direction of travel of a bill entering the entry transport section 5100. According to some embodiments, the rotation of a bill or document about a generally vertical axis is accomplished using a rotating system comprising three bill or document rotating mechanisms—a first horizontal axis document rotating mechanism, a vertical axis document rotating mechanism, and a second horizontal axis rotating mechanism.

According to some embodiments, a first horizontal axis bill rotating mechanism twists or rotates a bill or document traveling in a first generally horizontal plane to traveling in a first generally vertical plane by rotating the bill about a generally horizontal axis. A vertical axis bill rotating mechanism then rotates the bill or document traveling in the first generally vertical plane to traveling in a second generally vertical plane by rotating the bill about a generally vertical axis. The first and second generally vertical planes are offset from each other by angle $\alpha$. According to some embodiments, the angle $\alpha$ is about 90° and the second generally vertical plane is generally normal to the first generally vertical plane. Then a second horizontal axis bill rotating mechanism twists or rotates a bill or document traveling in the second generally vertical plane to traveling in a second generally horizontal plane by rotating the bill about a horizontal axis. According to some embodiments, the first and second horizontal planes are the same plane.

According to some embodiments, a first horizontal axis bill rotating mechanism twists or rotates a bill or document traveling in a first generally horizontal direction while lying in a first generally horizontal plane to traveling in the first generally horizontal direction while lying in a first generally vertical plane by rotating the bill about a horizontal axis. According to some embodiments, the first horizontal bill rotating mechanism rotates the document about a horizontal axis parallel to the first generally horizontal direction such that before, during, and after rotation, the forward direction of the document remains the same, that is, in the first generally horizontal direction. A vertical axis bill rotating mechanism then rotates the bill or document traveling in the first generally vertical plane in the first generally horizontal direction to traveling in a second generally vertical plane in a second generally horizontal direction by rotating the bill about a generally vertical axis. The first and second generally vertical planes and the first and second generally horizontal directions are offset from each other by angle $\alpha$. According to some embodiments, the angle $\alpha$ is about 90° and the second generally vertical plane is generally normal to the first generally vertical plane and the second generally horizontal direction is generally normal or perpendicular to the first generally horizontal direction. Then a second horizontal axis bill rotating mechanism twists or rotates a bill or document traveling in the second generally horizontal direction while lying in the second generally vertical plane to traveling in the second generally horizontal direction while lying in a second generally horizontal plane by rotating the bill about a horizontal axis. According to some embodiments, the first and second horizontal planes are the same plane. According to some embodiments, the second horizontal bill rotating mechanism rotates the document about a horizontal axis parallel to the second generally horizontal direction such that before, during, and after rotation, the forward direction of the document remains the same, that is, in the second generally horizontal direction.

Turning back to FIG. 5*a*, according to some embodiments, the second transport section 5200 is a first horizontal axis bill rotating mechanism, the third transport section 5300 is a vertical axis bill rotating mechanism, and the fourth transport section 5400 is a second horizontal axis bill rotating mechanism.

According to some embodiments, the angular transport unit 500-1 has a depth $D_{5A}$ and width $W_{5A}$ of about 28 inches (about 2⅓ feet) (about 0.7 meters) and a height of $H_{5A}$ of about 42½ inches (about 3½ feet) (about 1 meter).

Figure 5B:
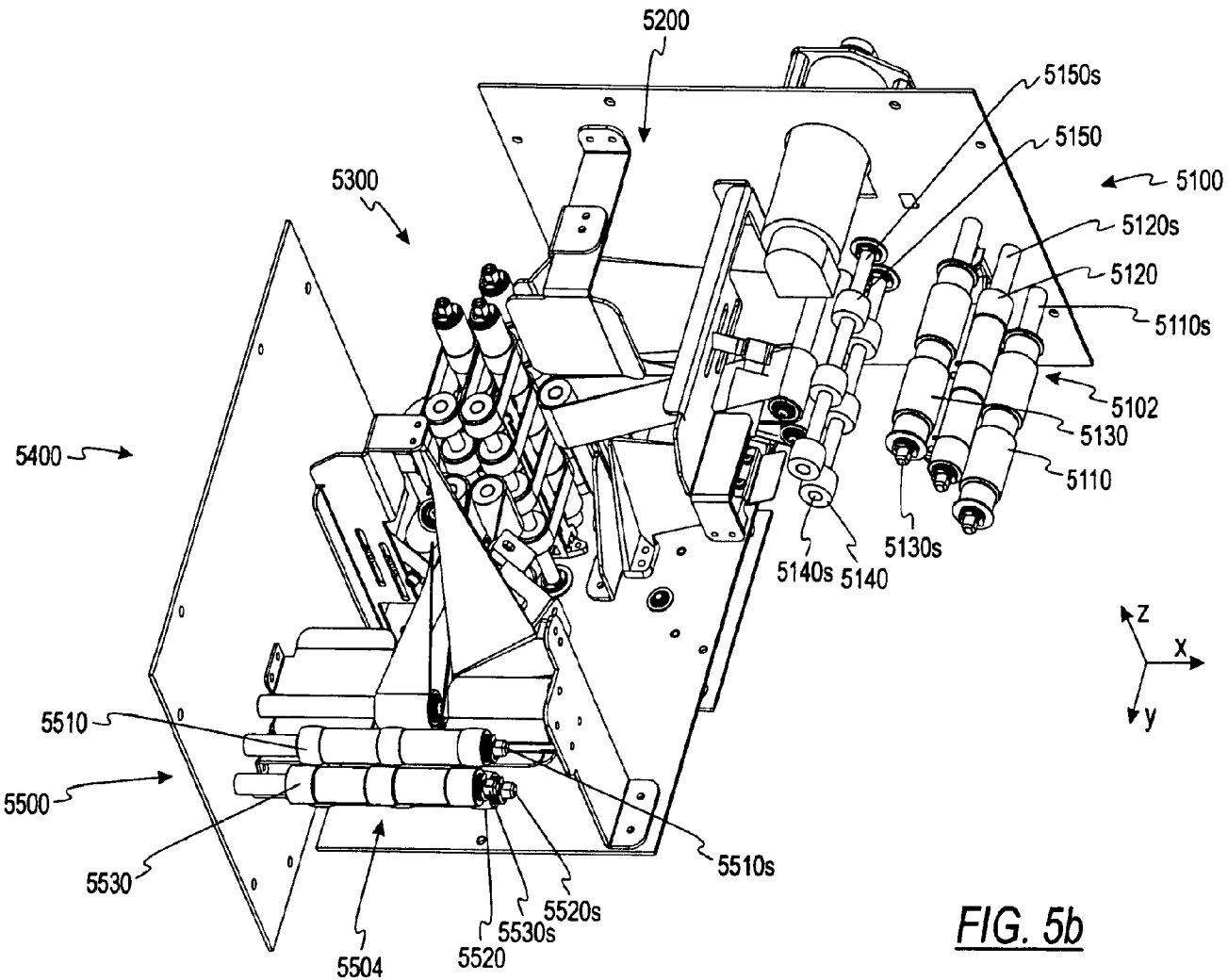
FIG. 5*b* is a perspective view of transport sections of an angular transport unit according to some embodiments.
Figure 5C:
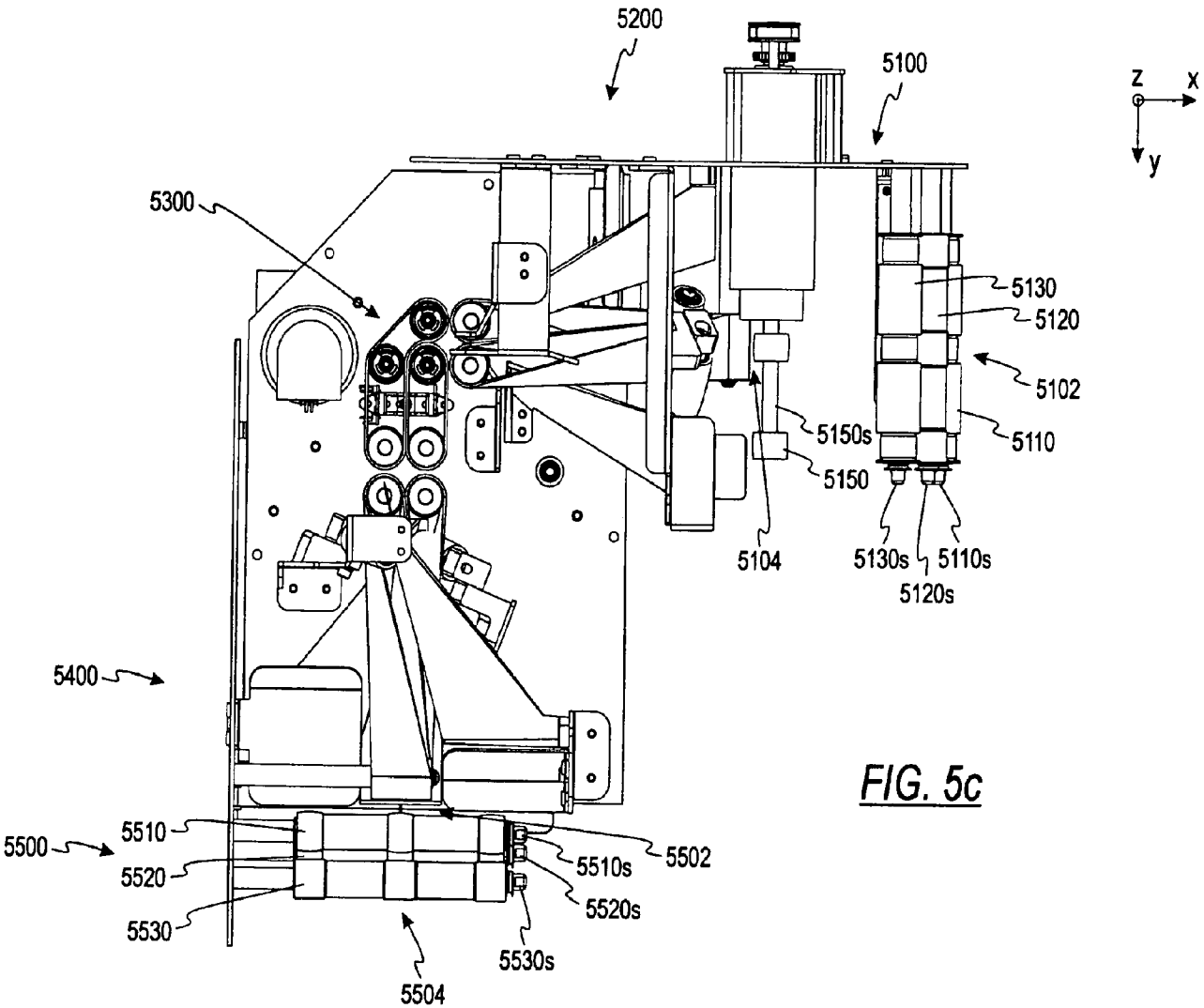
FIG. 5*c* is top view of the transport sections of the angular transport unit of FIG. 5*b;*

Referring next to FIGS. 5*b* and 5*c*, a more detailed view of the first through fifth transport sections 5100-5400 of the angular transport unit 500-1 is shown. FIG. 5*b* is a perspective view and FIG. 5*c* is a top view of transport sections 5100-5500. Sections 5200-5400 are illustrated in more detail in FIGS. 5*d*-5*h*.

Referring to FIGS. 5*b*-5*c*, the entry transport section 5100 has a first roller 5110, a second roller 5120, and a third roller 5130 at a first end 5102 of the entry transport section 5100. The first, second, and third rollers 5110, 5120, 5130 are connected to and rotate about respective shafts 5110*s*, 5120*s*, 5130*s*. The entry transport section 5100 further has a fourth roller 5140 and a fifth roller 5150 at a second end 5104. The fourth and fifth rollers are connected to and rotate about respective shafts 5140*s*, 5150*s*. Two set of belts, not shown, are adapted to each form a continuous loop. The belts are disposed adjacent to each other such that opposing surfaces of the belts form a bill transport path therebetween to transport bills from the first end 5102 to the second end 5104. The first belt would be disposed about the first roller 5110 and the fourth roller 5140. The second belt would be disposed about the second roller 5120, the third roller 5130, and the fifth roller 5150. According to some embodiments, a bill entering the entry transport section 5100 is transported such that a wide edge of the bill is a leading edge. According to some embodiments, a bill enters and moves through the entry transport section such that the bill lies generally in the XY plane. As illustrated, a bill moves through the entry transport section 5100 such that the leading edge is generally parallel to the Y axis and the bill moves with a forward direction of motion in the negative X direction as the bill moves from the first end 5102 to the second end 5104.

Figure 5E:
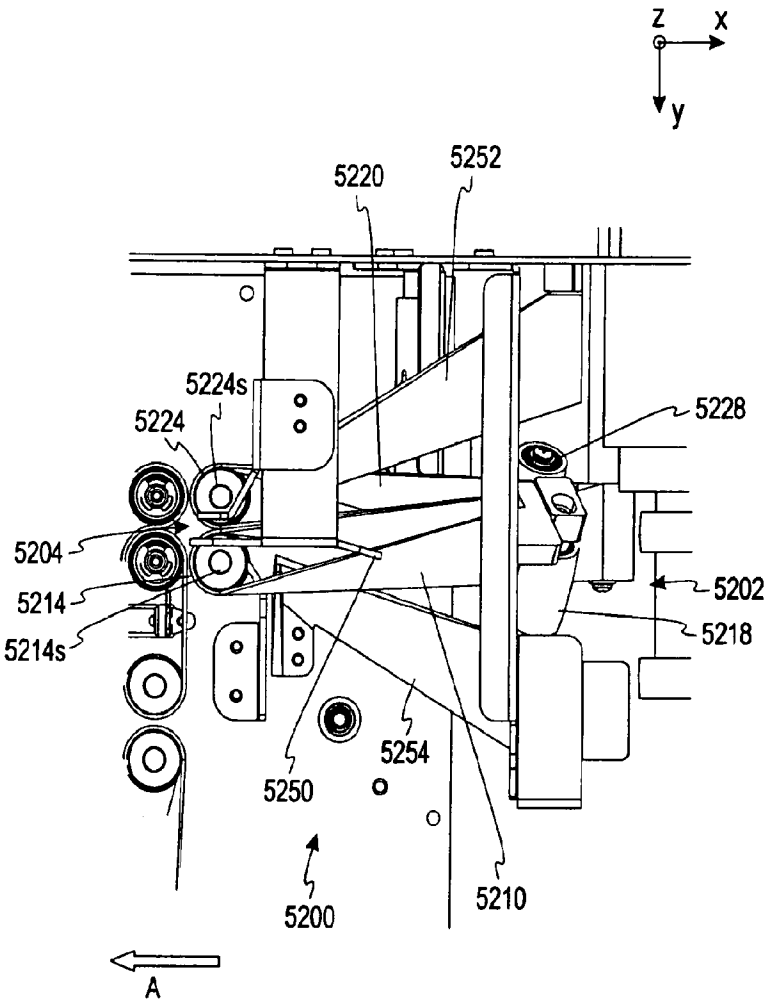
FIG. 5*d* is a perspective view and FIG. 5*e* is a top view of a horizontal axis currency document rotating mechanism according to some embodiments.
Figure 5D:
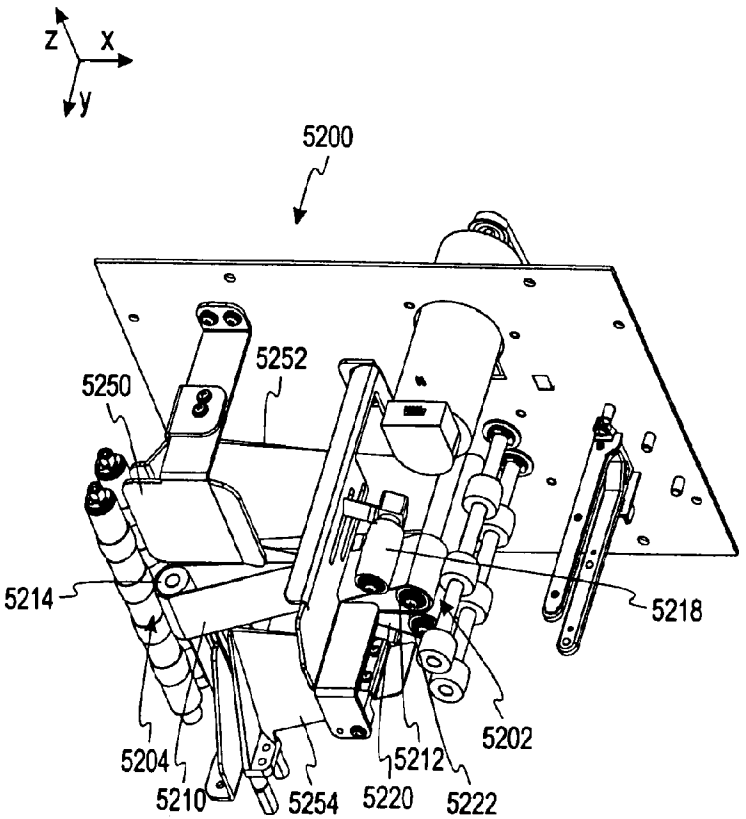

FIG. 5*d* is a perspective view and FIG. 5*e* is top view of the second transport section or bill rotating mechanism 5200. In the illustrated embodiment, the second transport mechanism is a horizontal axis bill rotating mechanism. The bill rotating mechanism of the second section 5200 is in the form of a two-belt rotating mechanism having a first belt 5210 and a second belt 5220. Each of the first and second belts 5210, 5220 forms a continuous loop. The belts 5210, 5220 are disposed adjacent to each other such that the opposing surfaces form a transport path there between. The second section 5200 has a first end 5202 and a second end 5204. Starting from the first end 5202, the first belt 5210 is disposed about a first roller 5212 and the second belt 5220 is disposed about a second roller 5222. The first roller 5212 is disposed adjacent to the second roller 5222. Each roller is connected to and rotates about a respective shaft. At the second end 5204 of the second transport section 5200, a second end of the first belt 5210 is disposed about a third roller 5214 and a second end of the second belt 5220 is disposed about a fourth roller 5224. The third roller 5214 is disposed adjacent to the fourth roller 5226. Each roller 5214, 5224 is connected to and rotates about respective shafts 5214*s*, 5224*s*.

As shown in FIGS. 5*d* and 5*e* the rollers 5212, 5222 are oriented parallel to the Y-axis and the shafts 5214*s*, 5224*s* and rollers 5214, 5224 of the second end 5204 of the second transport section 5200 are oriented generally parallel to the Z-axis. Accordingly, the orientation at the second end 5204 is rotated approximately 90° with respect to the first end 5202 of the second transport section 5200. Thus, a bill entering the first end is rotated approximately 90° about the X-axis as the bill moves through the second transport section 5200 in the negative X-direction. The leading edge of a bill is generally parallel to the Y-axis at the first end 5202 of the bill rotating mechanism 5200 and generally parallel to the Z-axis at the second end 5204 of the bill rotating mechanism 5200. According to some embodiments, a bill enters the second transport section 5200 with the bill lying generally in the XY plane and exits the second transport section 5200 with the bill lying generally in the XZ plane. According to some embodiments, the transport section 5200 is a first horizontal axis bill rotating mechanism that twists or rotates a bill or document traveling in a first generally horizontal direction, namely, the negative X direction, while lying in a first generally horizontal plane to traveling in the negative X direction while lying in a first generally vertical plane, namely, a XZ plane, by rotating the bill about a horizontal axis, namely, the X-axis. According to some embodiments, the bill rotating mechanism 5200 rotates the document about the X-axis such that before, during, and after rotation, the forward direction of the document remains the same, that is, in the negative X direction. According to some embodiments, the forward speed of the document and the leading edge of the document remain constant during the rotation of the document from the first end 5202 to the second end 5204 of the bill rotating mechanism 5200.

According to some embodiments, the first belt 5210 is further maintained in an appropriate position by a first belt guide roller 5218. The first belt guide roller 5218 presses against a side of the first belt 5210 opposite a side of the first belt 5210 that contacts a document. The first belt guide roller 5218 places tension on the first belt 5210 to help to maintain the position of the first belt 5210 during operation. Similarly, the second belt 5220 is further maintained in an appropriate position by a second belt guide roller 5228. The second belt guide roller 5228 presses against a side of the second belt 5220 opposite a side of the second belt 5220 that contacts a document. The second belt guide roller 5228 places tension on the second belt 5220 to help to maintain the position of the second belt 5220 during operation. The first and second belt guide rollers 5218, 5228 help to alleviate the need for rollers on each side of the first and second belt 5210, 5220 as used in certain prior bill rotating mechanisms.

According to some embodiments, the angular transport unit comprises guides 5250, 5252, 5254 to assist in maintaining the end of documents during the twisting of the documents as they are transported through the bill rotating or twisting mechanism 5200.

Figure 5F:
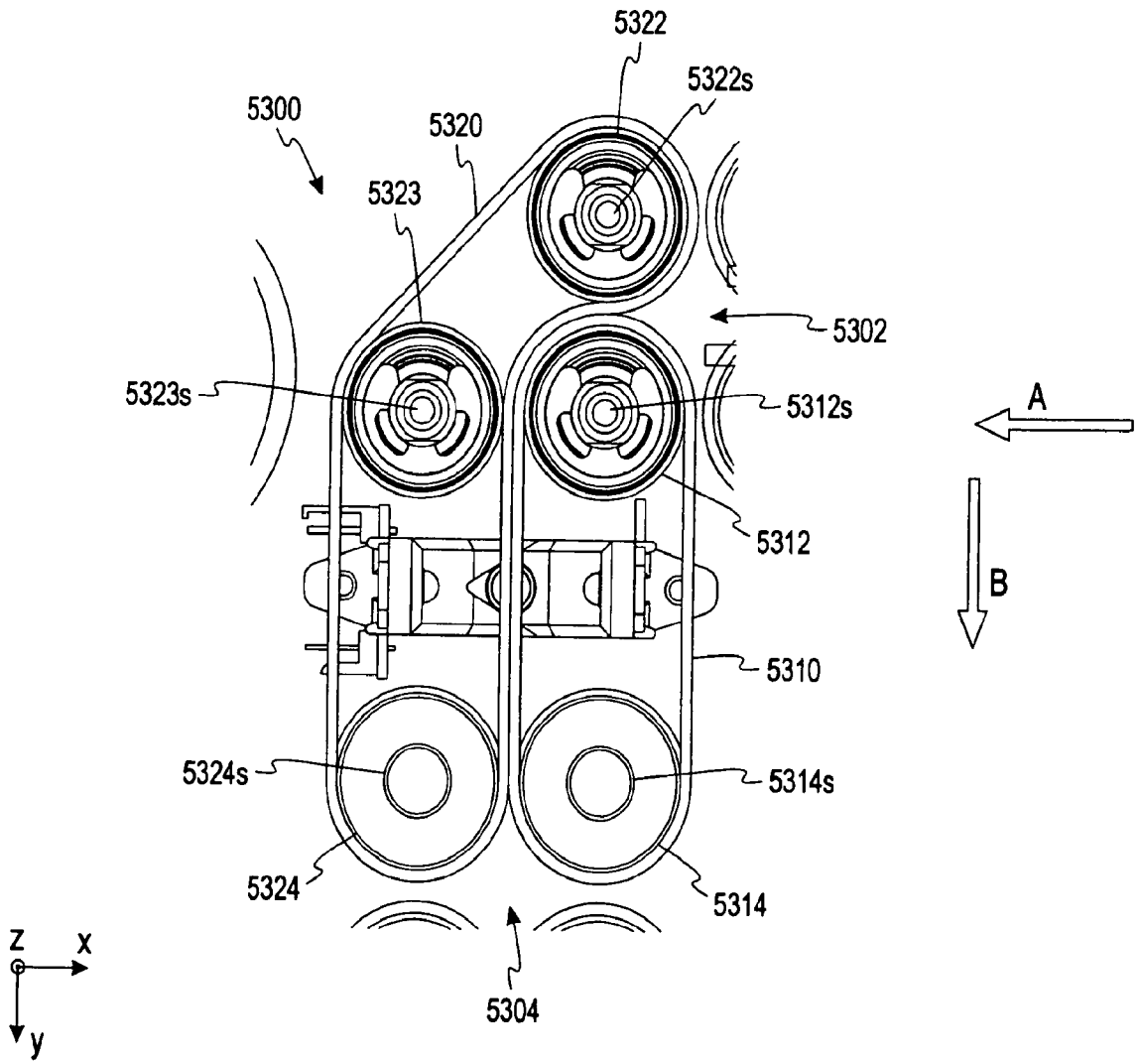
FIG. 5*f* is a top view of a vertical axis currency document rotating mechanism according to some embodiments.

FIG. 5*f* is a top view of the third transport section or bill rotating mechanism 5300. As illustrated, the third transport section is a vertical axis bill rotating mechanism 5300. The third transport section 5300 is adapted to rotate a bill about the Z-axis as the bill moves from a first end 5302 to a second end 5304 of the third transport section 5300. As shown in FIGS. 5*b*, 5*c*, 5*f* the third transport section rotates a bill approximately 90°. The third transport section 5300 has a first belt set 5310 and a second belt set 5320. The belts 5310, 5320 are disposed adjacent to each other such that opposing surfaces of the belts 5310, 5320 form a bill transport path therebetween to transport bills from the first end 5302 to the second end 5304. The first belt 5310 is disposed about a first roller 5312, at the first end 5302 and a third roller 5314 in the second end 5304 of the third transport section 5300. The second belt 5320 is disposed about a second roller 5322 at the first end 5302 and a fourth roller 5324 at the second end 5304. The second belt 5320 is also disposed about a fifth roller 5323. The respective first through fifth rollers 5312, 5322, 5314, 5324, 5323 are connect to and rotates about respective first through fifth shafts 5312*s*, 5322*s*, 5314*s*, 5324*s*, 5323*s*. According to some embodiments, a bill entering the third transport section 5300 is transported such that a wide edge of the bill is a leading edge. The bill moves such that the leading edge remains generally parallel to the Z-axis as the bill moves through the third transport section. 5300 from the first end 5302 to the second end 5304. The bill enters the third transport section 5300 at the first end while moving in the negative X direction (see arrow A) and the bill lying in a XZ plane. The bill is then rotated approximately 90° about the Z-axis. As illustrated in FIG. 5*f*, the bill is rotated about the first roller 5312 which is aligned generally parallel to the Z-axis. The bill is then transported such that the leading edge is generally parallel to the Z-axis and the bill lies in a YZ plane as the bill moves in the positive Y direction (see arrow B) to the second end 4402 of the third transport section 5300. According to some embodiments, the third transport section 5300 is a vertical axis bill rotating mechanism that rotates the bill or document traveling in a first generally vertical plane (e.g., the XZ plane) in a first generally horizontal direction (e.g., the negative X-direction) to traveling in a second generally vertical plane (e.g., the YZ plane) in a second generally horizontal direction (e.g., the Y-direction) by rotating the bill about a generally vertical axis (e.g., the Z-axis). The first and second generally vertical planes and the first and second generally horizontal directions are offset from each other by angle α. According to some embodiments, the angle α is about 90° and the second generally vertical plane is generally normal to the first generally vertical plane and the second generally horizontal direction is generally normal or perpendicular to the first generally horizontal direction.

Figure 5H:
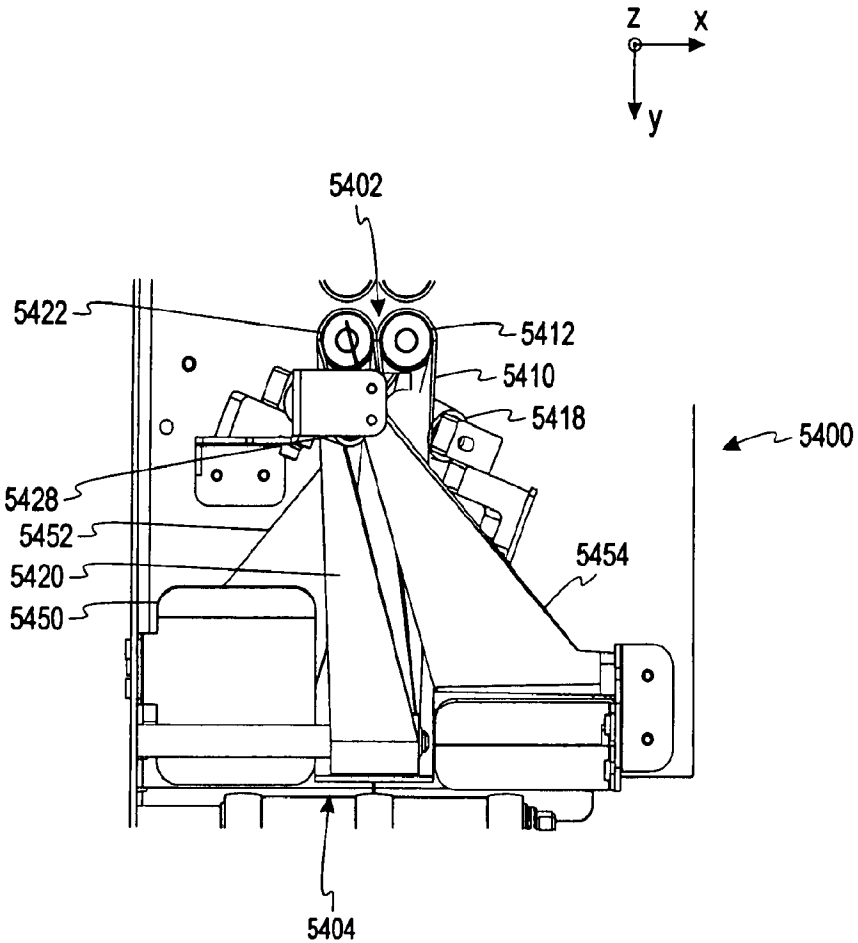
FIG. 5*g* is a perspective view and FIG. 5*h* is a top view of a horizontal axis currency document rotating mechanism according to some embodiments.
Figure 5G:
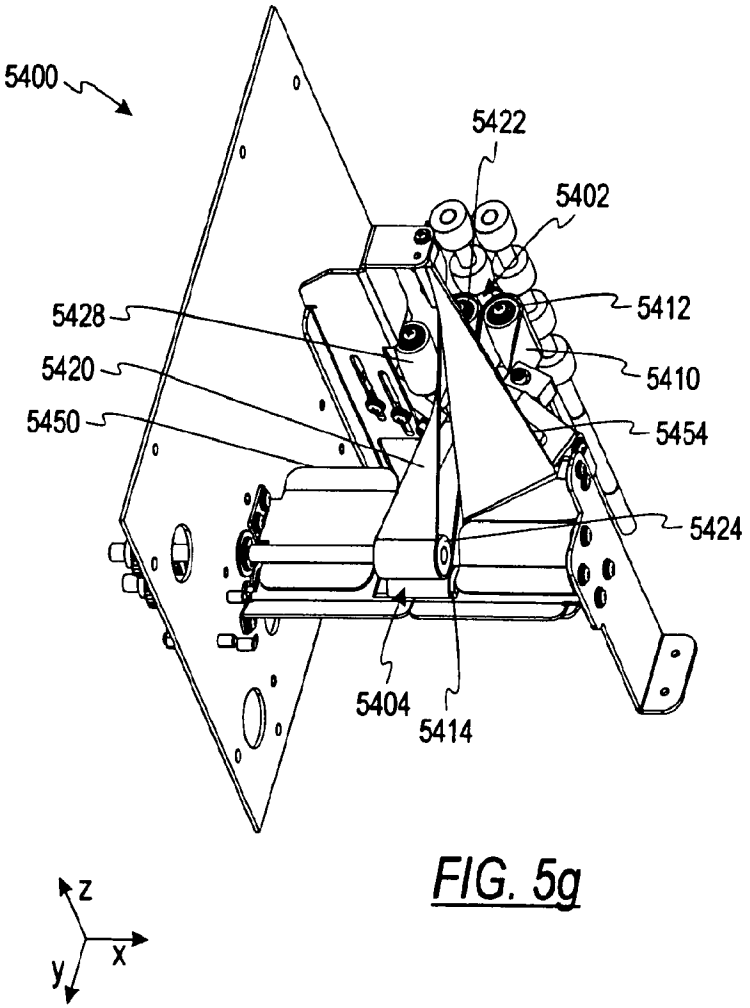

FIG. 5*g* is a perspective view and FIG. 5*h* is top view of the fourth transport section or bill rotating mechanism 5400. In the illustrated embodiment, the fourth transport mechanism is a horizontal axis bill rotating mechanism. After leaving the third transport section 5300, a bill enters the fourth transport section 5400. The bill rotating mechanism of the fourth section 5400 is in the form of a two-belt rotating mechanism having a first belt 5410 and a second belt 5420. Each of the first and second belts 5410, 5420 forms a continuous loop. The belts 5410, 5420 are disposed adjacent to each other such that the opposing surfaces form a transport path therebetween. The fourth section 5400 has a first end 5402 and a second end 5404.

Starting from the first end 5402, the first belt 5410 is disposed about a first roller 5412 and the second belt 5420 is disposed about a second roller 5422 The first roller 5412 is disposed adjacent to the second roller 5422. Each roller is connected to and rotates about a respective shaft. At the second end 5404 of the fourth transport section 5400, a second end of the first belt 5410 is disposed about a third roller 5414 and a second end of the second belt 5420 is disposed about a fourth roller 5424. The third roller 5414 is disposed adjacent to the fourth roller 5424. Each roller 5414, 5424 is connected to and rotates about respective shafts.

As shown in FIGS. 5*g*, and 5*h* the rollers 5412, 5422 of the first end 5402 are oriented parallel to the Z-axis. As shown in FIGS. 5*g*, 5*h*, the rollers 5414, 5424 of the second end 5404 of the fourth transport section 5400 are oriented generally parallel to the X-axis. Accordingly, the orientation at the second end 5404 is rotated approximately 90° with respect to the first end 5402 of the second transport section 5400. Thus, a bill entering the first end is rotated approximately 90° about the Y-axis as the bill moves through the fourth transport section 5400 in the positive Y direction. The leading edge of the bill is generally parallel to the Z-axis at the first end 5402 and is generally parallel to the X-axis at the second end 5404 of the bill rotating mechanism 5400. A bill enters the bill rotating mechanism 5400 lying generally in the YZ plane and exits the bill rotating mechanism 5400 lying generally in the XY plane at the second end 5404. According to some embodiments, fourth transport section 5400 is a second horizontal axis bill rotating mechanism that twists or rotates a bill or document traveling in the second generally horizontal direction (e.g., Y-direction) while lying in a generally vertical plane (e.g., YZ plane) to traveling in the second generally horizontal direction (e.g., the Y-direction) while lying in a second generally horizontal plane (e.g., the XY plane) by rotating or twisting the bill about a horizontal axis (e.g., the Y-axis). According to some embodiments, the first and second horizontal planes are the same plane. According to some embodiments, the second horizontal bill rotating mechanism rotates the document about the Y-axis such that before, during, and after rotation, the forward direction of the document remains the same, that is, in the Y-direction. According to some embodiments, the forward speed of the document and the leading edge of the document remain constant during the rotation of the document from the first end 5402 to the second end 5404 of the bill rotating mechanism 5400.

According to some embodiments, the first belt 5410 is further maintained in an appropriate position by a first belt guide roller 5418. The first belt guide roller 5418 presses against a side of the first belt 4510 opposite the side of the first belt 4510 that contacts a document. The first belt guide roller 5418 places tension on the first belt 4510 to help to maintain the position of the first belt 4510 during operation. Similarly, the second belt 5420 is further maintained in an appropriate position by a second belt guide roller 5428. The second belt guide roller 5428 presses against a side of the second belt 5420 opposite the side of the second belt 5420 that contacts a document. The second belt guide roller 5428 places tension on the second belt 5420 to help to maintain the position of the second belt 5420 during operation. The first and second belt guide rollers 5418, 5428 help to alleviate the need for rollers on each side of the first and second belt 5410, 5420 as used in certain prior bill rotating mechanisms.

According to some embodiments, the angular transport unit comprises guides 5450, 5452, 5454 to assist in maintaining the end of documents during the twisting of the documents as they are transported through the bill rotating or twisting mechanism 5400.

Returning to FIGS. 5*b*, 5*c*, the exit transport section 5500 has a first roller 5510 and a second roller 5520 at a first end 5502 of the exit transport section 5500. The first and second rollers 5510, 5520 are connected to and rotate about respective shafts 5510*s*, 5520*s*. The exit transport section 5500 further has a third roller 5530 at a second end 5504. The fourth roller 5530 is connected to and rotates about shaft 5530*s*. According to some embodiments, a bill entering the exit transport section 5500 is transported such that a wide edge of the bill is a leading edge. The bill moves such that the leading edge is generally parallel to the X-axis and the bill lies generally in the XY plane and the bill moves in the positive Y direction as the bill moves from the first end 5502 to the second end 5504 of the fifth section 5500.

It is contemplated according to other alternative embodiments of an angular transport unit that a bill or document may be rotated from about 45° to about 100° about the Z-axis, in that an angle formed between a line in the negative X-direction of FIGS. 5*b*-5*c* and the direction the bill travels at a second end of a third transport section is from approximately 45° to approximately 135°. In an angular transport unit that rotates a bill from abut 45° to an angle less than 90°, the rotation of a bill about the Z-axis is less than that of an angular transport unit that is a right-angle transport unit. Similarly, in an angular transport unit that rotates a bill more than 90° to about 135°, the rotation of a bill about the Z-axis is greater than that of an angular transport unit that is a right-angle transport unit. An angular transport unit with an angle of rotation, α, about the Z-axis from about 45° to about 135° may be useful in certain locations or applications such as where an angled wall exists, or a certain space limitation exists that make an angle other than 90° desirable. According to some embodiments, an angular transport unit with an angle of rotation, α, about the Z-axis from about 10° to about 170° may be useful in certain locations or applications such as where an angled wall exists, or a certain space limitation exists that make an angle other than 90° desirable.

It is contemplated according to yet other alternative embodiments of an angular transport unit that a bill or document may be rotated from about 45° to about 135° or from about 10° to about 170° about a second axis that is generally normal to a first axis. The first axis is parallel to a direction of motion of the bill. It is also contemplated according to some embodiments of an angular transport unit that a bill or document may be rotated from about 45° to about 135° or from about 10° to about 170° about an axis that is generally normal to a plane in which the document generally lies upon entering the angular transport unit. It is also contemplated according to some embodiments of an angular transport unit that a bill or document may be rotated from about 45° to about 135° or from about 10° to about 170° about a generally vertical axis that is generally normal to a horizontal plane. In an angular transport unit that rotates a bill from abut 45° to an angle less than 90°, the rotation of a bill about the second axis is less than that of an angular transport unit that is a right-angle transport unit. Similarly, in an angular transport unit that rotates a bill more than 90° to about 135°, the rotation of a bill about the second axis is greater than that of an angular transport unit that is a right-angle transport unit. An angular transport unit with an angle of rotation about the second axis from about 45° to about 135° may be useful in certain locations where an angled wall exists, or a certain space limitation exists that make an angle other than 90° desirable.

It is further contemplated that the rotation described in the second section 5200 and the fourth section 5400 may use other bill rotating mechanisms, or a portion of other bill rotating mechanisms, such as those described in previously incorporated commonly-owned U.S. Pat. Nos. 6,074,334, 6,398,000, 6,588,569, 6,601,687 as well as U.S. Pat. Publication Nos. 2003-0062242, 2004-0149538, 2005-0029168, and 2005-0183928 each of which is incorporated herein by reference in its entirety.

According to some embodiments, the central portion of the bill remains at a generally identical position along the Z-axis as the bill is moved through the angular transport unit. As a bill is transported through the angular transport unit the leading edge of the bill is not changed. Further, according to some embodiments, the transport speed within the angular transport unit is identical to the transport speed of the remainder of the bill processing and strapping system 4000.

Figure 5I:
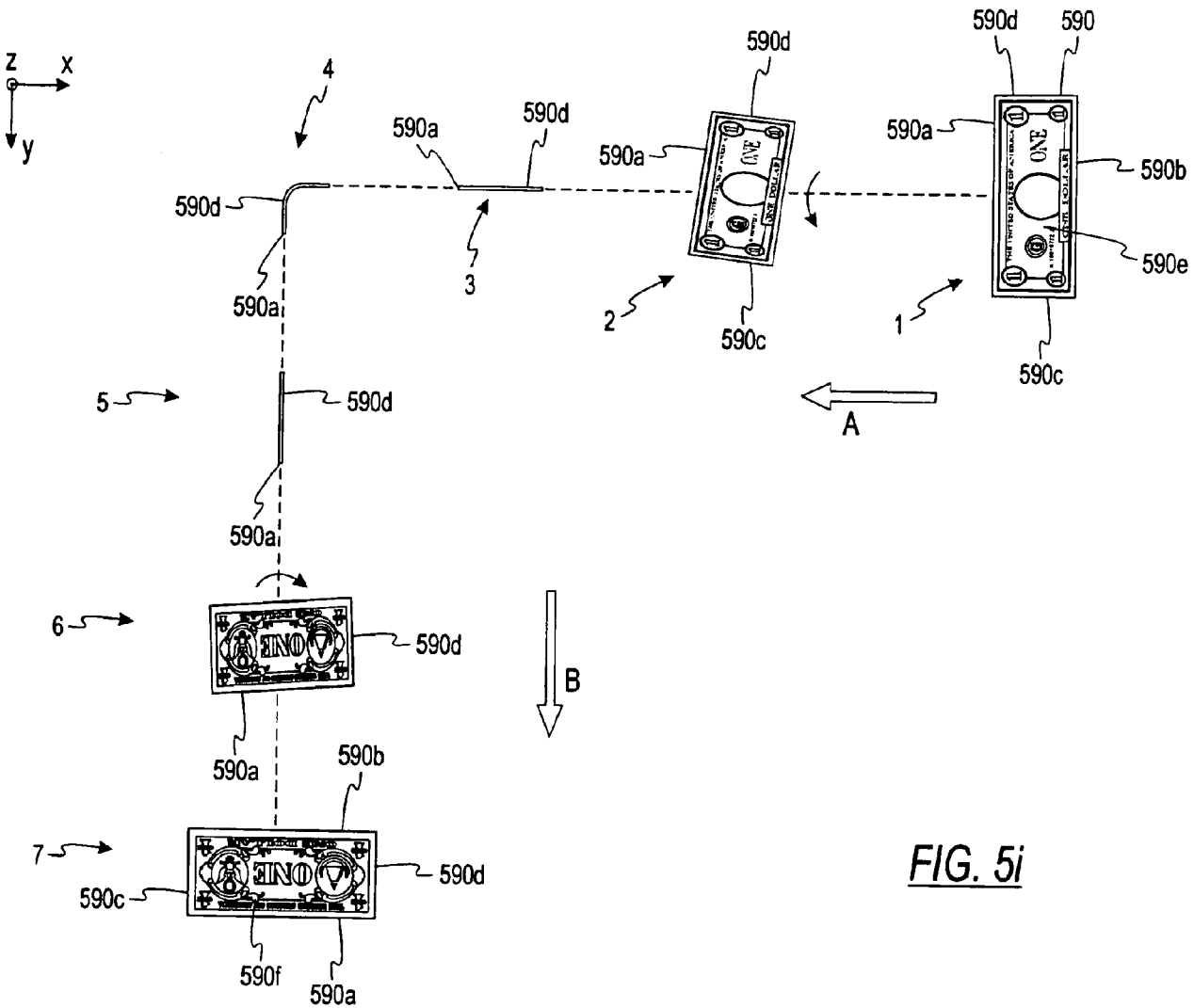
FIG. 5*i* depicts a top view of the motion of a currency document illustrating a change in the horizontal direction of motion of the currency document according to some embodiments.

FIG. 5*i* depicts a top view of the generalized motion of a document as the horizontal direction of motion of the document is changed according to some embodiments. According to some embodiments, the generalized motion depicted in FIG. 5*i* is completed as a document travels through an angular transport unit such as unit 500-1. In FIG. 5*i* a bill or document 590 is shown. The document 590 has a leading edge 590*a*, a trailing edge 590*b*, a left edge 590*c*, and a right edge 590*d* as determined by the forward direction of motion of the document 590 (see Arrow A). The document has first surface 590*e* and a second surface 590*f*. According to some embodiments, the bill or document 590 in Position 1 is moved or transported in a first generally horizontal direction (see Arrow A) while lying in a first generally horizontal plane (XY plane). As depicted, the first generally horizontal direction of motion is along the X-axis in the negative X-direction. As the bill 590 is transported in the first generally horizontal direction from Position 1 it is rotated or twisted about the first generally horizontal axis (the X-axis as depicted) (see Position 2) until it lies in a first generally vertical plane (see Position 3). As depicted, the bill 590 lies in the XZ plane in Position 3. According to some embodiments, the document is rotated about a horizontal axis parallel to the first generally horizontal direction such that before, during, and after rotation, the forward direction of the document remains the same, that is, in the first generally horizontal direction (the direction of Arrow A and the negative X-direction as depicted).

The bill or document 590 is transported in the first generally vertical plane in the first generally horizontal direction from Position 3 and is rotated about a generally vertical axis (the Z-axis as depicted) in Position 4 so that the bill or document 590 is traveling in a second generally vertical plane in a second generally horizontal direction and the bill is transported to Position 5. The first and second generally vertical planes and the first and second generally horizontal directions are offset from each other by angle $\alpha$. According to some embodiments including the depicted embodiment, the angle $\alpha$ is about 90° and the second generally vertical plane is generally normal to the first generally vertical plane and the second generally horizontal direction is generally normal or perpendicular to the first generally horizontal direction. As depicted, the second generally vertical plane is the YZ plane and the second generally horizontal axis is the Y-direction along the Y-axis. According to some embodiments, angle $\alpha$ is between about 45° and about 135°. According to some embodiments, angle $\alpha$ is between about 10° and about 170°.

As the bill or document 590 is transported from Position 5 to Position 7, it is transported in the second generally horizontal direction (the direction of Arrow B and the Y-direction) while being rotated or twisted from lying in the second generally vertical plane (YZ plane as depicted) to lying in a second generally horizontal plane by rotating the bill about a horizontal axis (the Y-axis as depicted). According to some embodiments, the first and second horizontal planes are the same plane, namely, the XY plane. According to some embodiments, the document is rotated about a horizontal axis parallel to the second generally horizontal direction such that before, during, and after rotation, the forward direction of the document remains the same, that is, in the second generally horizontal direction.

According to some embodiments, documents 590 are transported from Position 1 to Position 7 while maintaining the same leading edge 590*a* and the same forward speed. According to some embodiments, the forward direction of documents 590 is changed from being in a first horizontal direction such as the negative X-direction to a second horizontal direction such as the Y-direction while maintaining the same leading edge 590*a* and the same forward speed. According to some embodiments, the forward direction of documents 590 is changed from being in a first horizontal direction such as the negative X-direction to a second horizontal direction such as the Y-direction by first rotating the documents about a first horizontal axis, then rotating the documents about a vertical axis, and then rotating the documents about a second horizontal axis while maintaining the same leading edge 590*a* and the same forward speed.

According to some embodiments, the forward direction of documents 590 is changed from being in a first horizontal direction such as the negative X-direction to a second horizontal direction such as the Y-direction by first rotating the documents about a first horizontal axis passing orthogonally through the leading and trailing edges of the documents, then rotating the documents about a vertical axis, and then rotating the documents about a second horizontal axis passing orthogonally through the leading and trailing edges of the documents while maintaining the same leading edge 590*a*. According to some such embodiments, the first, second, and third rotations are performed while maintaining the same forward speed of each document.

According to some embodiments, the forward direction of documents 590 is changed from being in a first direction a second direction by first rotating the documents about a first axis parallel to the direction of forward movement of the document or parallel to the transport direction or the length of the transport path. For example, the transport section 5200 may be adapted to rotate documents about a first axis parallel to the direction of forward movement of the documents or parallel to the transport direction or the length of the transport path.

Documents may then be rotated about a second axis perpendicular to the direction of forward movement of the document or perpendicular to the transport direction or the length of the transport path or parallel to the width of the transport path. For example, the transport section 5300 may be adapted to rotate documents about a second axis perpendicular to the direction of forward movement of the documents or perpendicular to the transport direction or the length of the transport path or parallel to the width of the transport path. According to some embodiments, the second axis lies in a plane defined by the document or the transport path. According to some embodiments, the second axis is parallel to the leading edge of a document. For example, the transport section 5300 may be adapted to rotate documents about a second axis which is parallel to the leading edge of the documents.

Documents may then be rotated about a third axis parallel to the direction of forward movement of the document or parallel to the transport direction or the length of the transport path. For example, the transport section 5400 may be adapted to rotate documents about a third axis parallel to the direction of forward movement of the documents or parallel to the transport direction or length of the transport path.

In the embodiments depicted in FIGS. 5*a*-5*c* and 5*i* the face orientation of a bill or document is reversed while being transported through the angular transport unit. According to some embodiments, however, the face orientation may remain unchanged after being transported through the angular transport unit. For example, with respect to the embodiment depicted in FIGS. 5*b*-5*c*, the twisting or rotation imparted by transport sections 5200 and 5400 may be opposite with respect to each other. For example, if transport section 5200 is adapted to rotate a bill in a counter-clockwise direction as viewed in the direction of bill travel, the transport section 5400 can be adapted to rotate a bill in a clockwise direction.

According to some embodiments, a currency processing system is adapted to coordinate the decision whether to route a bill or document through turnover mechanism 110 in a currency handling device or not with the initial face orientation of a bill or document and the number of angular transport units a bill will traverse before reaching its final destination in the currency processing system. An example will be provided with respect to the processing system 200*a* depicted in FIG. 4*a*. Assume it is desired to deliver bills to output locations in a face-up manner and assume that the system is adapted to deliver $1 bills to output locations within the document receiving unit 300' and $5 bills to output locations with the document receiving unit 300". Also assume that each angular transport unit 500-1, 500-2 reverses the face orientation of a bill as a bill is transported through each unit. If a $1 bill is fed from an input receptacle of the currency handling device 100 in a face-down manner, such a $1 bill may be routed directly to the document receiving unit 300' without being routed through a bill turnover mechanism 110 of the currency handling device. The transport of the $1 bill through the angular transport unit 500-1 causes the bill to be turned over so that it arrives in an output location with the document receiving unit 300' in a face-up manner. Conversely, if a $1 bill is fed from the input receptacle in a face-up manner, the system 200*a* may be adapted to route the bill through the turnover mechanism 110 (turning the bill face-down) before being routed to the angular transport unit 500-1 (turning the bill face-up again) and then to the document receiving unit 300'.

Continuing the above example, for $5 bills which are routed to document receiving unit 300", these bills pass through two angular transport units which cause bills arriving at the document receiving unit 300" to have the same orientation as they did when they entered the first angular transport unit 500-1. Thus if a $5 bill is fed from an input receptacle of the currency handling device 100 in a face-up manner, such a $5 bill may be routed directly to the document receiving unit 300" without being routed through a bill turnover mechanism 110 of the currency handling device. The transport of the $5 bill through the first angular transport unit 500-1 causes the bill to be turned over so and the transport of the bill through the second angular transport unit 500-2 causes the bill to be turned over again so that it arrives in an output location with the document receiving unit 300" in a face-up manner. Conversely, if a $5 bill is fed from the input receptacle in a face-down manner, the system 200*a* may be adapted to route the bill through the turnover mechanism 110 (turning the bill face-up) before being routed to the angular transport unit 500-1 (turning the bill face-down again) and then to the second angular transport unit 500-2 (turning the bill face-up again) and then to the document receiving unit 300".

Figures 5J, 5K, 5L:
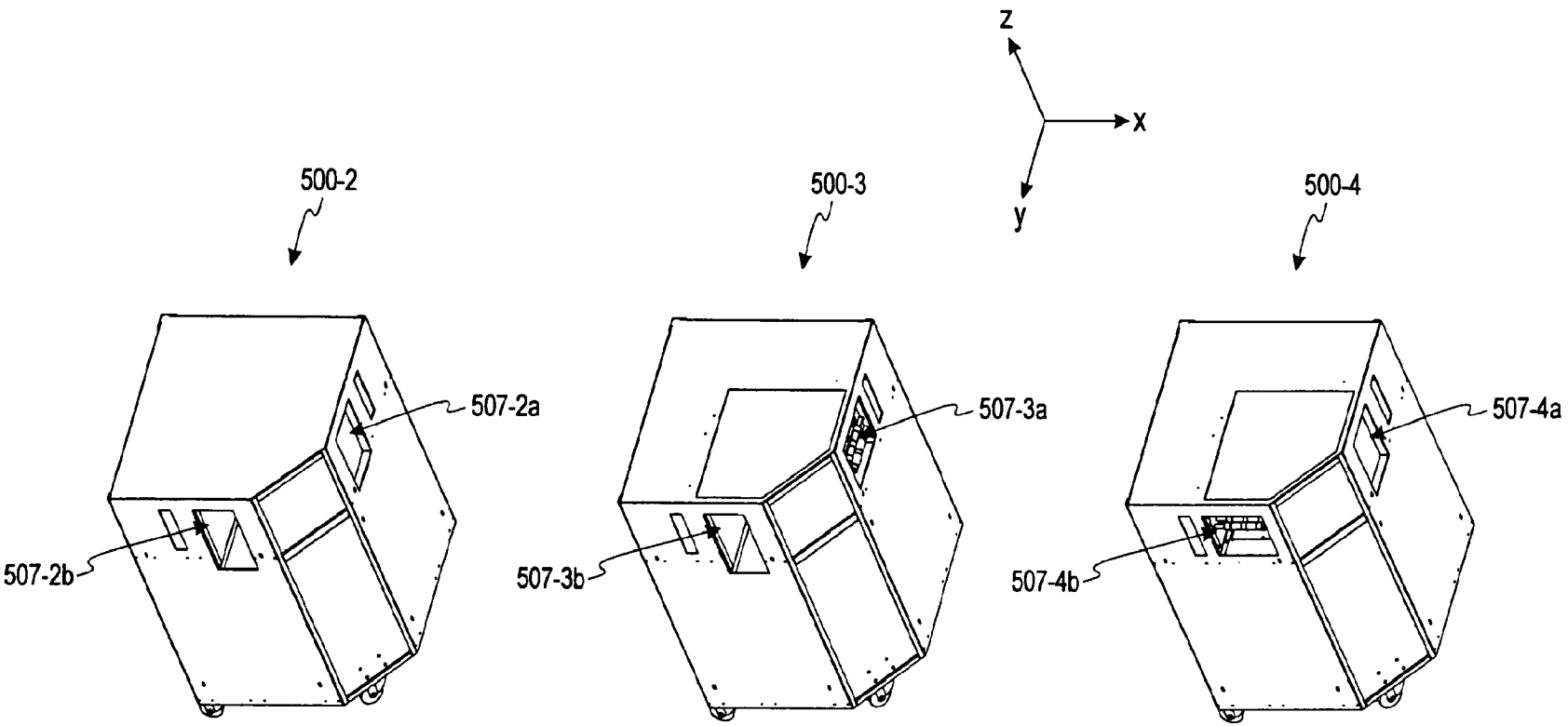
FIGS. 5*j*-5*l* are perspective views of various angular transport units according to some embodiments.

According to some embodiments, documents or bills may enter and/or exit an angular transport unit in a manner other than lying in a generally horizontal plane. For example, FIG. 5*j* is a perspective view of an angular transport unit 500-2 adapted to receive documents lying in a generally vertical plane (e.g., XZ plane) via an entry port 507-2*a* and adapted to transport documents out of the angular transport unit 500-2 with the documents lying in a second generally vertical plane (e.g., YZ plane) via an exit port 507-2*b*. According to some such embodiments, the angular transport unit 500-2 need only comprise a vertical axis bill rotating mechanism such as bill rotating mechanism 5300. According to some embodiments, document processing systems employing angular transport mechanism(s) 500-2 may comprise a horizontal axis bill rotating mechanism (e.g., rotating mechanism 5200) in a component such as a document handling device 100 or a document receiving unit 300 positioned upstream (entry port 507-2*a* side) of the angular transport mechanism 500-2 which rotates a document from lying in a horizontal plane to lying in a vertical plane. Likewise, according to some embodiments, document processing systems employing angular transport mechanism(s) 500-2 may comprise a horizontal axis bill rotating mechanism (e.g., rotating mechanism 5400) in a component such as a document receiving unit 300 positioned downstream (exit port 507-2*b* side) of the angular transport mechanism 500-2 which rotates a document from lying in a vertical plane to lying in a horizontal plane.

FIG. 5*k* is a perspective view of an angular transport unit 500-3 adapted to receive documents lying in a generally horizontal plane (e.g., XY plane) via an entry port 507-3*a* and adapted to transport documents out of the angular transport unit 500-3 with the documents lying in a generally vertical plane (e.g., YZ plane) via an exit port 507-3*b*. According to some such embodiments, the angular transport unit 500-3 may comprise a horizontal axis bill rotating mechanism (e.g., rotating mechanism 5200) and a vertical axis bill rotating mechanism such as bill rotating mechanism 5300. According to some embodiments, document processing systems employing angular transport mechanism(s) 500-3 may comprise a horizontal axis bill rotating mechanism (e.g., rotating mechanism 5400) in a component such as a document receiving unit 300 positioned downstream (exit port 507-3*b* side) of the angular transport mechanism 500-3 which rotates a document from lying in a vertical plane to lying in a horizontal plane.

FIG. 5*l* is a perspective view of an angular transport unit 500-4 adapted to receive documents lying in a generally vertical plane (e.g., XZ plane) via an entry port 507-4*a* and adapted to transport documents out of the angular transport unit 500-4 with the documents lying in a generally horizontal plane (e.g., XY plane) via an exit port 507-4*b*. According to some such embodiments, the angular transport unit 500-4 need only comprise a vertical axis bill rotating mechanism such as bill rotating mechanism 5300 and a horizontal axis bill rotating mechanism (e.g., rotating mechanism 5400). According to some embodiments, document processing systems employing angular transport mechanism(s) 500-4 may comprise a horizontal axis bill rotating mechanism (e.g., rotating mechanism 5200) in a component such as a document handling device 100 or a document receiving unit 300 positioned upstream (entry port 507-4*a* side) of the angular transport mechanism 500-4 which rotates a document from lying in a horizontal plane to lying in a vertical plane.

In document processing systems employing angular transport mechanism(s) 500-2, 500-3, 500-4, component devices positioned upstream of the angular transport mechanisms 500-2, 500-3, 500-4 may comprise exit ports adapted to mate with entry ports 507-2*a*, 507-3*a* 507-4*a* while component devices downstream of angular transport mechanisms 500-2, 500-3, 500-4 may comprise entry ports adapted to mater with exit ports 507-2*b*, 507-3*b*, 507-4*b*.

According to some embodiments, the forward speed of a document and the leading edge of the document remains constant during its movement through an angular transport unit. According to some embodiments, the forward speed of a document and the leading edge of the document remains constant during its movement through an angular transport unit including during the rotation of the document about a first horizontal axis, a vertical axis, and a second horizontal axis.

According to some embodiments, angular transport units 500 are provided that combine the movement described above in connection with two or more of the horizontal and vertical rotating mechanisms 5200-5400 into one or two transport sections. For example, according to some embodiments, the rotation of a bill about a horizontal axis such as in section 5200 is combined with the rotation of a bill about a vertical axis such as in section 5300 in a single transport section. For example, belts 5210, 5220 may be bent around a vertical axis between the entry 5202 and the exit 5204 of the transport section 5200. According to such embodiments, in addition to twisting documents about a horizontal axis as they move from the entry 5202 to the exit 5204, the transport section 5200 may also rotate the bills about a vertical axis so as to change the horizontal component of movement from being defined solely by one horizontal axis (such as the X-axis) to being defined solely or additionally by another horizontal axis (such as the Y-axis).

Figure 5M:
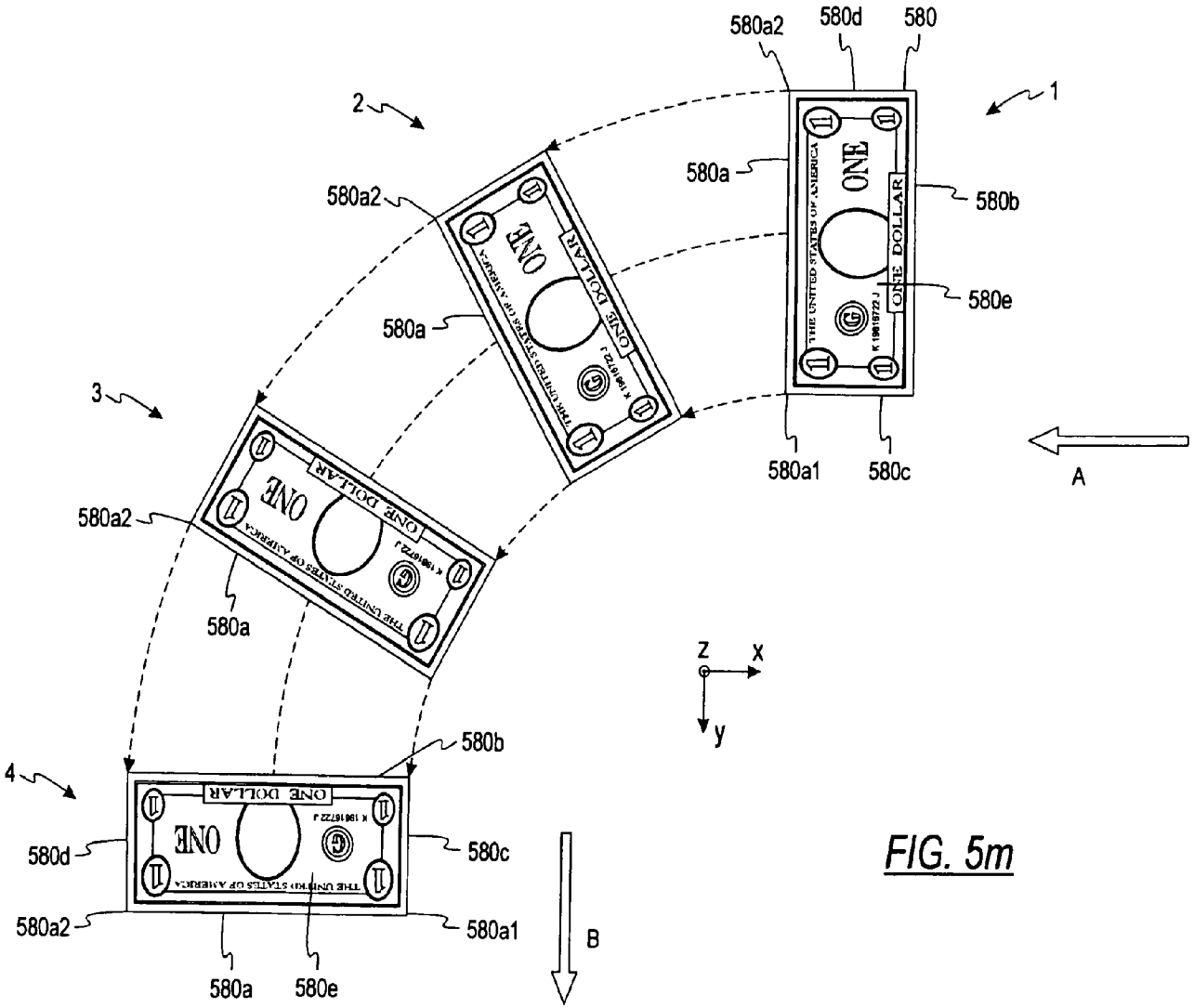
FIGS. 5*m*-5*n* depict top views of the generalized motion of a document or currency bill as the horizontal direction of motion of the document is changed according to some embodiments.

FIG. 5*m* depicts a top view of the generalized motion of a document or currency bill as the horizontal direction of motion of the document is changed according to some embodiments. In FIG. 5*m* a bill or document 580 is shown. The document 580 has a leading edge 580*a*, a trailing edge 580*b*, a left edge 580*c*, and a right edge 580*d* as determined by the forward direction of motion of the document 580 (see Arrow A). The document has first surface 580*e* and a second surface 580*f* (not shown). According to some embodiments, the bill or document 580 in Position 1 is moved or transported in a first generally horizontal direction (see Arrow A) while lying in a first generally horizontal plane (XY plane). As depicted, the first generally horizontal direction of motion is along the X-axis in the negative X-direction. As the bill 580 is transported in the first generally horizontal direction from Position 1 it is rotated about a generally vertical axis (the Z-axis as depicted) until it is moving a second horizontal direction (see Arrow B or the Y-direction) when it reaches Position 4. During the rotation of bill or document about the Z-axis, the bill or document is maintained in essentially the same plane such as a horizontal plane (e.g, the XY-plane). According to some embodiments, the document is rotated about a vertical axis such that before, during, and after rotation, the leading edge 580*a* remains the same. According to some embodiments, such as that depicted in FIG. 5*m*, and in contrast to the embodiments described above (for example, in connection with FIG. 5*i*) the forward speed of the document does not remain the same or uniform over the document. For example, the right leading corner 580*a*2 moves faster than the left leading corner 580*a*1 as the document is rotated about the Z-axis.

According to some embodiments, the document movement depicted in FIG. 5*m* is accomplished using a transport mechanism adapted to move one side of a document (e.g., the right side as defined by the forward motion and/or leading edge of the document) faster than another side (e.g., the left side as defined by the forward motion or leading edge of the document). According to some embodiments, a belt and/or roller system may be employed wherein belts and/or rollers on the outer edge of a turn move faster than belts and/or rollers on the inner edge of a turn. According to some embodiments, the motion depicted in FIG. 5*m* or similar motion is performed in an angular transport unit 500.

According to some embodiment, the document is rotated about the Z-axis by an angle $\alpha$. According to some embodiments including the depicted embodiment, the angle $\alpha$ is about 90°. According to some embodiments, angle $\alpha$ is between about 45° and about 135°. According to some embodiments, angle $\alpha$ is between about 10° and about 170°.

Figure 5N:
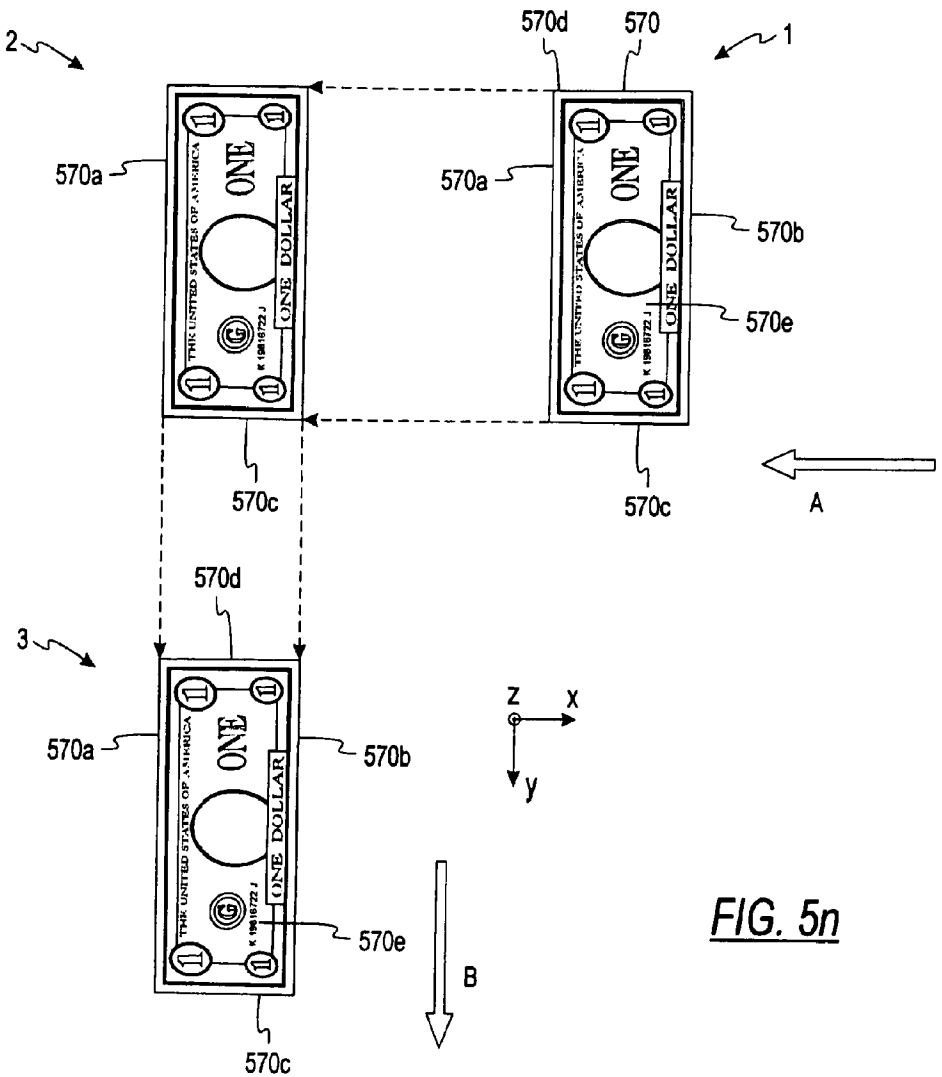

FIG. 5*n* depicts a top view of the generalized motion of a document or currency bill as the horizontal direction of motion of the document is changed according to some embodiments. In FIG. 5*n* a bill or document 570 is shown. The document 570 has an initial leading edge 570*a*, an initial trailing edge 570*b*, an initial left edge 570*c*, and an initial right edge 570*d* as determined by the initial forward direction of motion of the document 570 (see Arrow A). The document has first surface 570*e* and a second surface 570*f* (not shown). According to some embodiments, the bill or document 570 in Position 1 is moved or transported in a first generally horizontal direction (see Arrow A) while lying in a first generally horizontal plane (XY plane). As depicted, the first generally horizontal direction of motion is along the X-axis in the negative X-direction. When the bill 570 reaches Position 2, its movement in the negative X-direction is stopped and movement of the bill 570 in the Y-direction (see Arrow B) is initiated. During the movement of bill or document from being generally in a first horizontal direction such as the negative X-direction to being generally in a second horizontal direction such as the Y-direction, the bill or document is maintained in essentially the same plane such as a horizontal plane (e.g, the XY-plane).

After Position 2, the leading edge of the document becomes edge 570*c*. As depicted in FIG. 5*n*, according to some embodiments, the horizontal direction of a document is changed by changing the leading edge of the document. According to some embodiments, such as that depicted in FIG. 5*n*, and in contrast to the embodiments described above (for example, in connection with FIG. 5*i*) the forward speed of the document does not remain the same or uniform over the document or during the movement of a document through an angular transport unit. For example, according to some embodiments, the speed of the document 570 including the initial leading edge 570*a* of the document slows down as the bill reaches Position 2 while the speed of the document including subsequent leading edge 570*c* then increases as the bill moves away from Position 2.

According to some embodiments, a belt and/or roller transport system may be employed to achieve the motion depicted in FIG. 5*n*. According to some embodiments, the motion depicted in FIG. 5*n* or similar motion is performed in an angular transport unit 500.

According to some embodiment, the forward horizontal direction of motion of a document is changed as depicted in FIG. 5*n* by an angle α. According to some embodiments including the depicted embodiment, the angle α is about 90°. According to some embodiments, angle α is between about 45° and about 135°. According to some embodiments, angle α is between about 10° and about 170°.

According to some embodiments, a component of motion in a second horizontal direction (e.g., the Y-direction or along the Y-axis) is added to a document before a component of motion in a first horizontal direction (e.g., the X-direction or along the X-axis) is stopped. For example, referring to FIG. 5*n*, a transport mechanism may begin moving a document initially traveling solely in horizontal direction A to be moving in both horizontal directions A and B. According to some embodiments, the horizontal component of movement in the B-direction can be increased while the horizontal component of movement in the A-direction is reduced until there is no horizontal movement in the A-direction and solely horizontal movement in the B-direction.

Figure 6B:
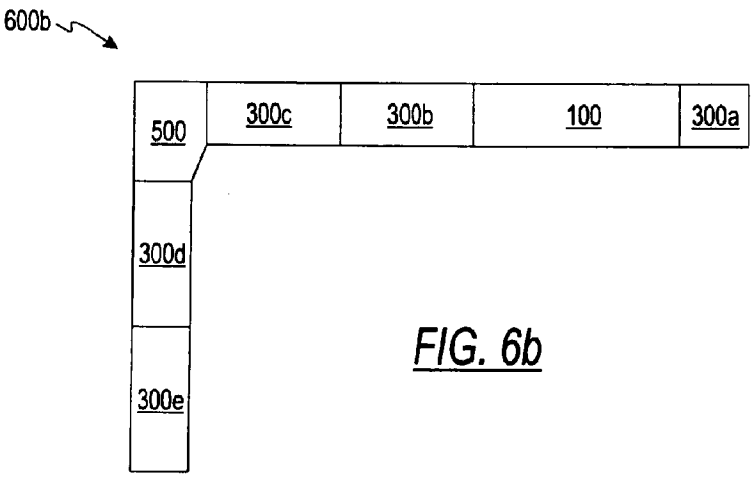
FIGS. 6*a*-6*d* and 7*a*-7*d* are top views of various alternative arrangements of components of currency document processing systems according to some embodiments.
Figure 6D:
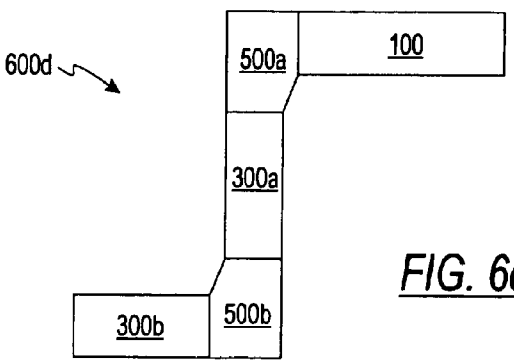
Figure 6A:
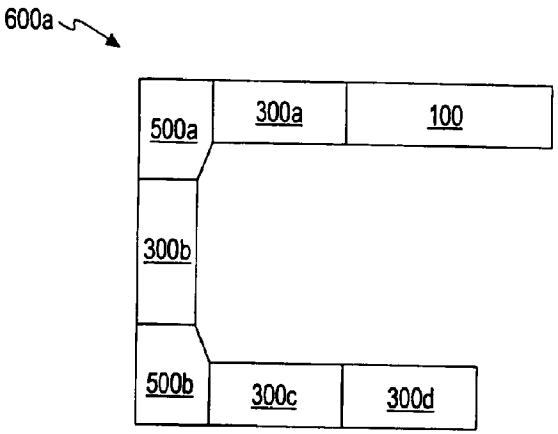

Turning now to FIGS. 6*a*-6*d*, several alternative arrangements of document or currency processing systems are shown. FIG. 6*a* depicts a document or currency processing system 600*a* comprising a document or currency handling device 100, a first document receiving unit 300*a*, a first angular transport unit 500*a*, a second document receiving unit 300*b*, a second angular transport unit 500*b*, a third document receiving unit 300*c*, and a fourth document receiving unit 300*d*. The use of two angular transport units 500*a*, 500*b* give the currency processing system 600*a* a generally U-shape. According to some embodiments, the two angular transport units rotate bills in the same direction (e.g., a clockwise direction or a counterclockwise direction) to obtain a generally U-shaped document processing system. According to some embodiments, the document receiving units 300*a*-300*d* are strapping units and according to some embodiments, the strapping units are similar or generally identical to the strapping units previously described in reference to FIG. 3*i*. According to some embodiments, the currency handling device 100 may be, for example, any one of the currency handling devices described above such as those described in connection with FIGS. 3*a*-3*g*. According to some embodiments, the angular transport units 500*a*, 500*b* may be similar or generally identical to the angular transport unit previously described above, such as, for example those described in connection with FIGS. 5*a*-5*h*. According to some embodiments, the angular transport units 500*a*, 500*b* are right angle transport units. According to other embodiments the angular transport units change the forward direction of documents by an angle other than 90° as previously described. According to other embodiments, other types of document handling devices, angular units, and/or strapping units are utilized.

FIG. 6*b* depicts a document or currency processing system 600*b* comprising a document or currency handling device 100, a first document receiving unit 300*a*, a second document receiving unit 300*b*, a third document receiving 300*c*, a first angular transport unit 500, a fourth document receiving unit 300*d*, and a fifth document receiving unit 300*e*. According to some embodiments, a single angular transport unit may be used to provide a generally L-shaped document processing system 600*b*. According to some embodiments, the first document receiving unit 300*a* is a modular output receptacle unit and the document receiving units 300*b*-300*e* are strapping units. According to some embodiments, the angular transport unit 500 is a right angle transport unit. According to other embodiments the angular transport unit changes the forward direction of documents by an angle other than 90° as previously described. According to some embodiments, the various components of the currency processing system 600*b* are similar or generally identical to those previously described herein. According to other embodiments, other types of document handling devices, angular units, modular units, output receptacle units and/or strapping units are utilized. As shown in FIG. 6*b*, it is contemplated that some currency processed by the currency handling device 100 may be transported to both the right of the device 100 and to the left of the device 100.

Figure 6C:
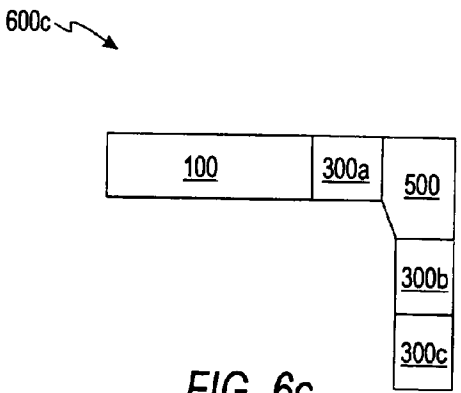

Turning now to FIG. 6*c*, a document or currency processing system 600*c* comprises a document or currency handling device 100, a first document receiving unit 300*a*, an angular transport unit 500, a second document receiving unit 300*b*, and a third document receiving unit 300*c*. According to some embodiments, the document receiving units comprise modular output receptacle units. According to some embodiments, the angular transport unit 500 is a right angle transport unit. According to other embodiments the angular transport unit changes the forward direction of documents by an angle other than 90° as previously described. According to some embodiments, the various components of the currency processing system 600*c* are similar to or generally identical to those previously described herein. As shown in FIG. 6*c*, it is contemplated that currency processed by the device 100 may be transported to the right of the device 100. According to other embodiments, other types of document handling devices, angular units, modular units, output receptacle units and/or strapping units are utilized.

As shown in FIG. 6*d*, a document or currency processing system 600*d* may have a S-shape from the use of a first angular transport unit 500*a*, and a second angular transport unit 500*b*. The document or currency processing system 600*d* comprises a document or currency handling device 100, the first angular transport unit 500*a*, a first document receiving unit 300*a*, the second angular transport unit 500*b*, and a second document receiving unit 300*b*. According to some embodiments, document receiving units 300*a*, 300*b* are first and second strapping units. According to some embodiments, the various components of the currency processing system 600*d* are similar to or generally identical to those previously described herein. According to some embodiments, the angular transport units 500*a*, 500*b* are right angle transport units. According to other embodiments the angular transport units change the forward direction of documents by an angle other than 90° as previously described. By orienting the second angular transport unit 500*b* differently than the first angular transport unit 500*a* the generally S-shape of the currency processing system 600*a* may be obtained. For example, the one angular transport unit may rotate bills in a clockwise direction and the other may rotate bills in a counterclockwise direction. According to other embodiments, other types of document handling devices, angular units, modular units, output receptacle units and/or strapping units are utilized.

Figure 7A:
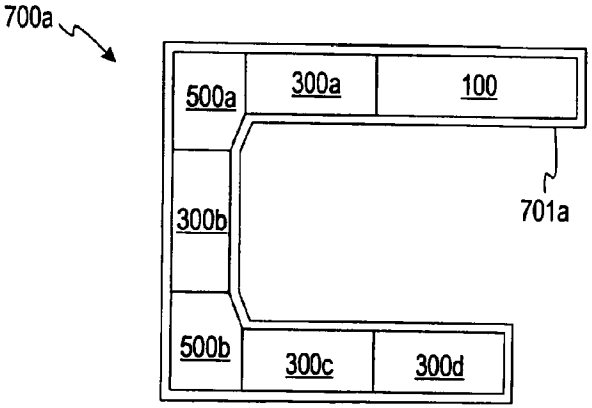
Figure 7B:
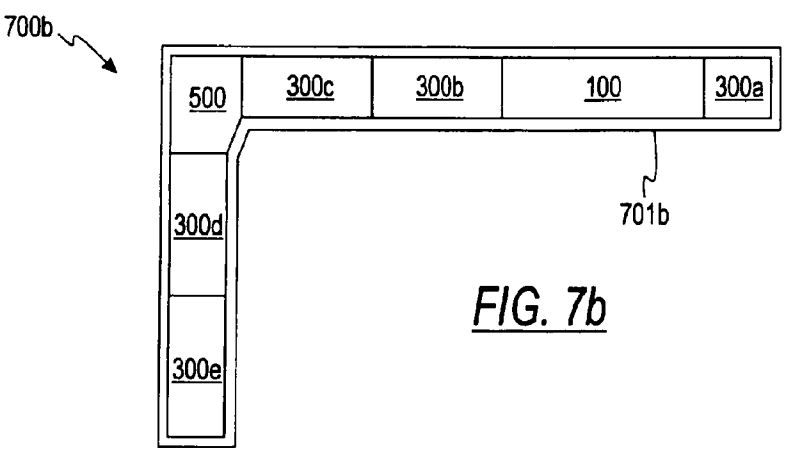
Figure 7C:
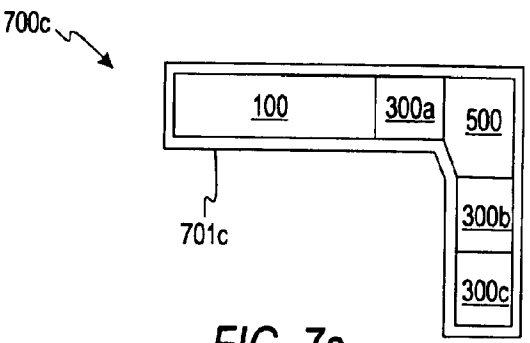
Figure 7D:
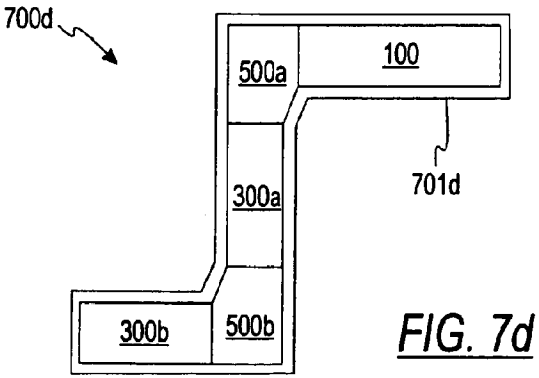

Turning now to FIGS. 7*a*-7*d* several alternative arrangements of document or currency processing systems are shown. FIGS. 7*a*-7*d* depict similar embodiments to those described in connection with FIGS. 6*a*-6*d*, however the document or currency processing systems shown in FIGS. 7*a*-7*d* contain all of the components within a single housing. In FIG. 7*a*, the components 100, 300, and 500 of a document or currency processing system 700*a* are all contained within a single housing 701*a*. In FIG. 7*b*, the components 100, 300, and 500 of a document or currency processing system 700*b* are contained within a housing 701*b*. In FIG. 7*c*, the components 100, 300, and 500 of a document or currency processing system 700*c* are contained within a housing 701*c*. In FIG. 7*d*, the components 100, 300, and 500 of a document or currency processing system 700*d* are all contained with a housing 701*d*. According to some embodiments, the various components of the document or currency processing systems 700*a*-700*d* are similar to or generally identical to those previously described herein. According to other embodiments, other types of document handling devices, angular units, modular units, output receptacle units and/or strapping units are utilized.

Figure 8:
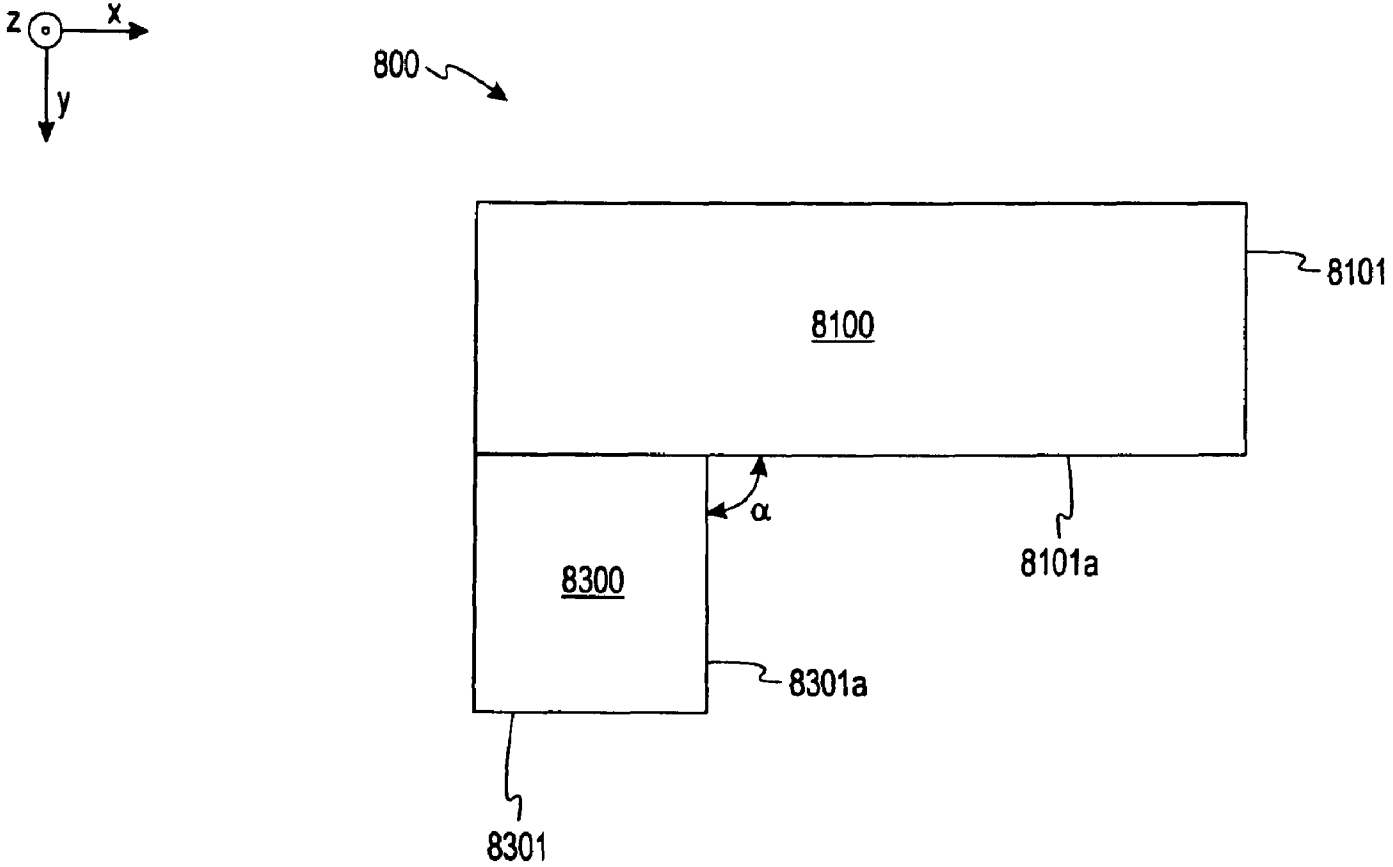
FIGS. 8 and 9 are top views of currency document processing systems according to some embodiments.

Turning now to FIG. 8 a document or currency processing system 800 is depicted. The currency processing system 800 comprises a document or currency handling device 8100. The currency handling device 8100 may be any one of the document or currency handling devices described above such as one of the currency handling devices described in connection with FIGS. 3*a*-3*g*. The currency handling device 8100 has a cabinet 8101 with a front side 8101*a*. The front side 8101*a* of the cabinet 8101 lies in a first generally vertical plane, shown generally parallel to the XZ-plane. The currency processing system 800 further comprises a currency or document or currency document receiving unit 8300. The receiving unit 8300 has a cabinet 8301 with a front side 8301*a*. The front side 8301*a* of the cabinet 8301 lies in a second generally vertical plane. An angle α exists between the first generally vertical plane and the second generally vertical plane. As shown in FIG. 8 the angle α is approximately 90°, however it is contemplated that the angle α may range from about 10° to about 170°.

According to some embodiments, the currency handling device 8100 comprises a document or currency rotating unit or mechanism adapted to change the forward motion of document from being defined by the X-axis or a combination of the X-axis and the Z-axis to being defined by the Y-axis or a combination of the Y-axis and the Z-axis. According to some embodiments, the currency handling device 8100 may comprise an angular transport unit 500. According to some embodiments, currency or documents are moved from the currency handling device 8100 to the document receiving unit 8300 by moving the documents in a direction defined by the Y-axis.

Figure 9:
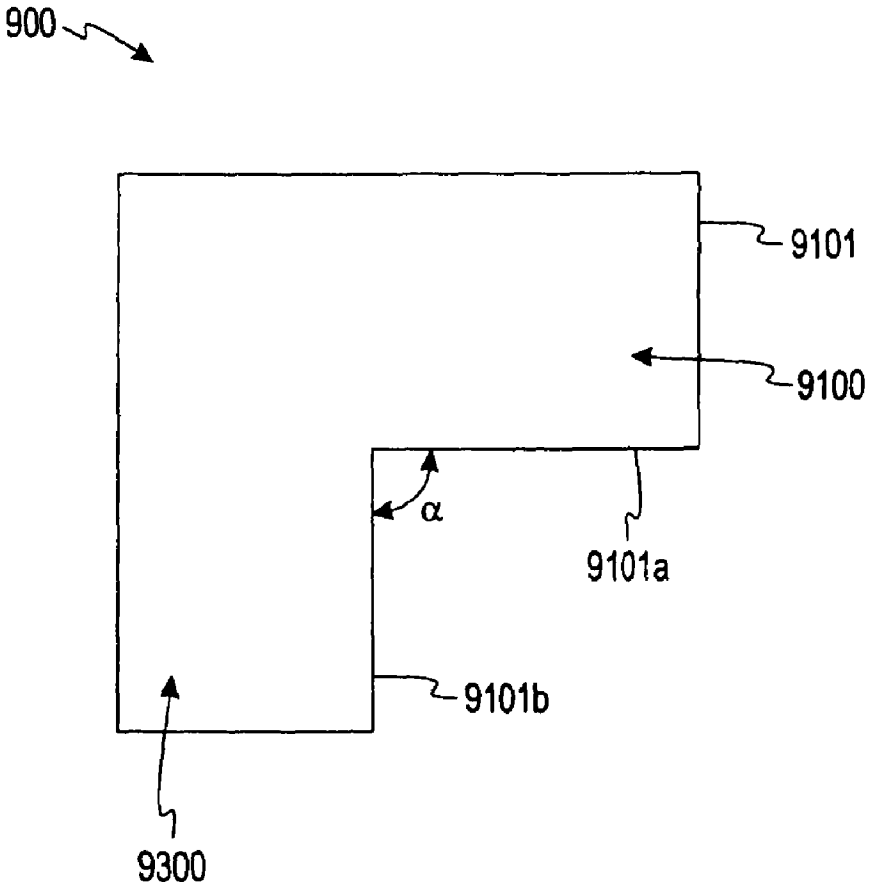

Next, as shown in FIG. 9 a document or currency processing system 900 is depicted. The document or currency processing system 900 comprises a document or currency handling device 9100. The currency handling device 9100 may be, for example, any one of the currency handling devices described above such as one of the document or currency handling devices described in connection with FIGS. 3*a*-3*g*. The currency handling device 9100 has a cabinet 9101 with a first side 9101*a*. The first side 9101*a* of the cabinet 9101*a* lies in a first generally vertical plane, shown generally parallel to the XZ-plane. The currency processing unit further comprises a document or currency or currency document receiving unit 9300. The receiving unit 9300 is contained within the cabinet 9101 which has a second side 9101*b*. The front of the document receiving unit 9300 coincides with the second side 9101*b*. For example, the document receiving unit 9300 may comprise one or more output receptacles which are accessible by an operator of the document processing system 900 from the second side 9101*b* while an input receptacle of the document or currency handling device 9100 is accessible by an operator of the document processing system 900 from the first side 9101*a*. The second side 9101*b* of the cabinet 9101 lies in a second generally vertical plane. An angle α exists between the first generally vertical plane and the second generally vertical plane. As shown in FIG. 9 the angle α is approximately 90°, however it is contemplated that the angle α may range from about 10° to about 170°.

According to some embodiments, the currency handling device 9100 comprises a document or currency rotating unit or mechanism adapted to change the forward motion of document from being defined by the X-axis or a combination of the X-axis and the Z-axis to being defined by the Y-axis or a combination of the Y-axis and the Z-axis. According to some embodiments, the currency handling device 9100 may comprise an angular transport unit 500. According to some embodiments, currency or documents are moved from the currency handling device 9100 to the document receiving unit 9300 by moving the documents in a direction defined by the Y-axis.

Figure 10B:
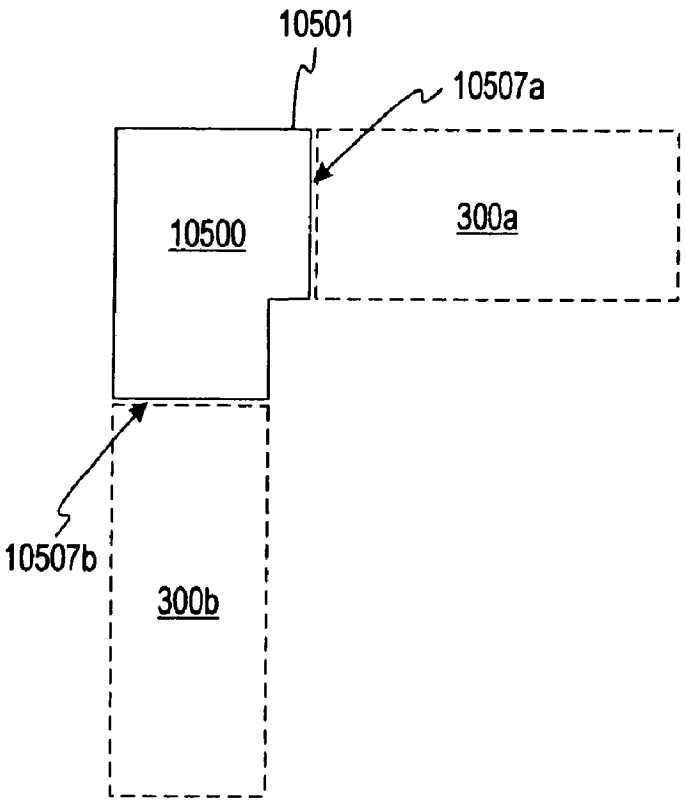
FIGS. 10*a* and 10*b* are top views of a connecting unit or angular transport unit according to some embodiments.
Figure 10A:
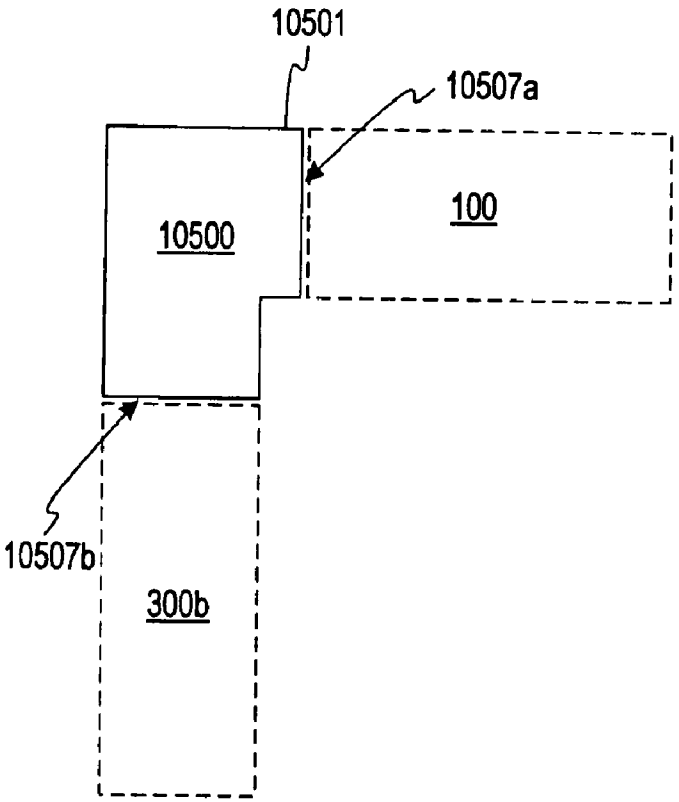

A connecting unit or angular transport unit 10500 is depicted in FIGS. 10*a* and 10*b*. The connecting unit 10500 has a cabinet 10501, input port 10507*a* to receive currency documents from another device 100 (FIG. 10*a*) or 300*a* (FIG. 10*b*) such as a currency handling device or a currency document receiving unit into the cabinet 10501. The connecting unit has an output port 10507*b* to permit currency documents to be sent out of the cabinet 10501 to another device 300*b* such as a currency document receiving unit. The connecting unit 10500 further has a transport mechanism that receives currency documents from the input port 10507*a* and transports the currency documents to the output port 10507*b*. As seen in FIGS. 10*a* and 10*b*, the connecting unit is contained within the cabinet 10501 and generally forms a right angle between the input port 10507*a* and the output port 10507*b*. Thus, the first device 100 such as a currency handling device, the connecting unit 10500, and the second device 300*b* such as a currency document receiving unit, as shown in FIG. 10*a* are configured in a generally L-shaped manner. Similarly, the currency document receiving unit 300*a*, the connecting unit 10500, and the currency document receiving unit 300*b*, as shown in FIG. 10*b*, are configured in a generally L-shaped manner.

According to some embodiments the connecting or angular transport unit 10500 is adapted to couple two other components of a document processing system such as a document handling device 100 and a document receiving unit 300 or two document receiving units 300 in a non-linear fashion. For example, according to some embodiments, the connecting or angular transport unit 10500 is a right angle transport unit and is adapted to connect to two components of a document processing system to each other in a perpendicular manner. For example, according to some embodiments, the connecting or angular transport unit 10500 is adapted to connect two components of a document processing system to each other in a manner such that the angle formed between the two components is about 90°. According to some embodiments, the connecting or angular transport unit 10500 is adapted to connect two components of a document processing system to each other in a manner such that the angle formed between the two components is an angle other than 90° (e.g., from about 10° to about 170°) as previously described. According to some embodiments, the connecting or angular transport unit 10500 is adapted to connect two components of a document processing system to each other in a manner such that the angle formed between the two components is about 45°.

According to some embodiments the connecting or angular transport unit 10500 changes the horizontal component of the forward direction of documents by about 90°. According to some embodiments the connecting or angular transport unit 10500 changes the horizontal component of the forward direction of documents by an angle other than 90° (e.g., from about 10° to about 170). According to some embodiments the connecting or angular transport unit 10500 changes the horizontal component of the forward direction of documents by about 45°.

According to some embodiments the connecting or angular transport unit 10500 changes the forward direction of documents by about 90° about a vertical axis. According to some embodiments the connecting or angular transport unit 10500 changes the forward direction of documents by an angle other than 90° (e.g., from about 10° to about 170) about a vertical axis. According to some embodiments the connecting or angular transport unit 10500 changes the forward direction of documents by about 45° about a vertical axis.

With respect to FIGS. 2, 4*a*-4*b*, 6*a*-6*d*, 7*a*-7*d*, 8-10*b* certain arrangements and combinations are provided by way of example and other arrangements and combinations of components 100, 300, and 500 are within the scope of this disclosure.

FURTHER ALTERNATIVE EMBODIMENTS

Embodiment 0

According to some embodiments, a method is provided for processing documents utilizing a document processing system having a document handling device and a first document receiving unit. The method comprises the act of receiving a plurality of documents in an input receptacle of the document handling device. The method further comprises transporting at least some of the documents, one at a time, from the input receptacle and out of the document handling device and into the first document receiving unit. The method further comprises rotating the documents by an angle α about a vertical axis in the document handling device before transporting the documents into the document receiving unit.

Embodiment 1

According to some embodiments, a method is provided for processing documents utilizing a document processing system having a document handling device, a first document receiving unit, and a first angular transport unit. The method comprises the act of receiving a plurality of documents in an input receptacle of the document handling device. The method further comprises transporting at least some of the documents, one at a time, from the input receptacle and out of the document handling device and into the first angular transport unit. The method further comprises rotating the documents transported into the first angular transport unit by an angle α about a vertical axis in the first angular transport unit. The method further comprises transporting the documents transported into the first angular transport unit out of the first angular transport unit and into the document receiving unit.

Embodiment 2

According to some embodiments, a method is provided for processing documents utilizing a document processing system having a document handling device, a first document receiving unit, and a first angular transport unit. The method comprises the act of receiving a plurality of documents in an input receptacle of the document handling device. The method further comprises transporting the documents, one at a time, from the input receptacle past one or more detectors and retrieving information from the documents using the one or more detectors. The method further comprising the act of sorting the documents based on the retrieved information and transporting at least some of the some documents out of the document handling device and into the first angular transport unit. The method further comprises rotating the documents transported into the first angular transport unit by an angle α about a vertical axis in the first angular transport unit. The method further comprises transporting the documents transported into the first angular transport unit out of the first angular transport unit and into the document receiving unit.

Embodiment 3

The method according to any of embodiments 1-2 comprising transporting documents into and out of the first angular unit such that a document enters the first angular transport unit traveling in a first generally horizontal direction and exits the first angular transport unit traveling in a second generally horizontal direction that is offset from the first generally horizontal direction by the angle α.

Embodiment 4

The method according to any of embodiments 0-3 wherein the document handling device and the document receiving unit each comprise at least one output receptacle and together comprise a plurality of output receptacles. The method further comprises transporting the bills, one at a time, from the input receptacle to one of the plurality of output receptacles.

Embodiment 5

The method according to any of embodiments 0-4 wherein the documents are currency bills and the method further comprises the act of determining the denomination of the bills within the document handling device.

Embodiment 6

The method of embodiment 5 wherein the bills are sorted into a plurality of output receptacles based on their denominations so that each output receptacles receives bills of only one denomination.

Embodiment 7

The method according to any of embodiments 0-6 wherein the documents are currency bills, the document handling device is a currency handling device and the document receiving unit is a currency receiving unit.

Embodiment 8

The method according to any of embodiments 0-6 wherein the documents are currency documents, the document handling device is a currency document handling device and the document receiving unit is a currency document receiving unit.

Embodiment 9

The method according to any of embodiments 0-6 wherein the documents are currency notes, the document handling device is a currency note handling device and the document receiving unit is a currency note receiving unit.

Embodiment 10

According to some embodiments, a method of processing currency bills utilizes a currency processing and strapping system having a currency handling device, a first currency strapping unit, and a first angular transport unit is provided. The method comprises the act of receiving a plurality of bills in an input receptacle of the currency handling device. The method further comprises the act of transporting the bills individually or one at a time from the input receptacle to one of a plurality of output receptacles or locations located within either the currency handling device or the first currency strapping unit. The method comprises the act of determining the denomination of the bills within the currency handling device. The method further comprises sorting the bills into the plurality of output receptacles or locations based on their denominations so that each output receptacle or location receives bills of only one denomination. The method comprises transporting bills to the output locations within the first strapping unit through the first angular transport unit from the currency handling device. The method further comprises rotating the bills about an vertical axis by an angle $\alpha$ in the first angular transport unit, such that a bill entering the first angular transport unit traveling in a first generally horizontal direction exits the first angular transport unit traveling in a second generally horizontal direction that is offset from the first generally horizontal direction by the angle $\alpha$.

Embodiment 11

According to some embodiments, a method is provided for processing currency bills utilizing a currency processing system having a currency processing unit or currency handling device, a first modular output receptacle unit, and a first angular transport unit. The currency handling device and the output receptacle unit comprise each have at least one output receptacle and together comprise a plurality of output receptacles. The method comprises the act of receiving a plurality of bills in an input receptacle of the currency handling device. The method further comprises the act of transporting the bills, one at a time, from the input receptacle to one of the plurality of output receptacles. The method further comprises the act of determining the denomination of the bills within the currency handling device. The method further comprises sorting the bills into the plurality of output receptacles based on their denominations so that each output receptacles receives bills of only one denomination. The method comprises routing bills from the currency handling device to the at least one output receptacle within the first modular output receptacle unit through the first angular transport unit. The method comprises rotating the bills by an angle $\alpha$ about a vertical axis in the first angular transport unit, such that a bill entering the first angular transport unit traveling in a first generally horizontal direction exits the first angular transport unit traveling in a second generally horizontal direction that is offset from the first generally horizontal direction by the angle $\alpha$.

Embodiment 12

The method according to any of embodiments 0-11 wherein the angle $\alpha$ is between about 10° and about 170°.

Embodiment 13

The method according to any of embodiments 0-12 wherein the angle $\alpha$ is between about 45° and about 135°.

Embodiment 14

The method according to any of embodiments 0-13 wherein the angle $\alpha$ is about 45°.

Embodiment 15

The method according to any of embodiments 0-13 wherein the angle $\alpha$ is about 90°.

Embodiment 16

The method according to embodiment 15 comprising rotating the bills by 90° about a vertical axis in the first angular transport unit, such that a bill entering the first angular transport unit traveling in a first generally horizontal direction exits the first angular transport unit traveling in a second generally horizontal direction that is generally normal to the first generally horizontal direction.

Embodiment 17

According to some embodiments, an angular transport unit is provided for use with a document processing system for processing documents. The angular transport unit comprises a first transport section, a second transport section, and a third transport section. The first transport section is adapted to receive documents traveling one at a time in a first generally horizontal direction along a first generally horizontal axis from a first device of the document processing system. The first transport section is further adapted to rotate the documents approximately 90° about the first generally horizontal axis as the document moves in the first generally horizontal direction. The second transport section is adapted to rotate the documents by an angle $\alpha$ about a generally vertical axis causing the documents to move in a second generally horizontal direction along a second generally horizontal axis. The first generally horizontal axis is generally normal to the generally vertical axis. The second generally horizontal axis is generally normal to the vertical axis. The third transport section is adapted to rotate documents approximately 90° about the second generally horizontal axis as the document moves in the second generally horizontal direction. The third transport section is further adapted to transport the documents in the second generally horizontal direction from the angular transport unit to a second device of the document processing system.

Embodiment 18

According to some embodiments, an angular transport unit for use with a document processing system for processing documents is provided. The angular transport unit comprises a first transport section, a second transport section, and a third transport section. The first transport section is adapted to receive documents traveling one at a time in a first direction along a first axis from a first device of the document processing system and is further adapted to rotate the documents approximately 90° about the first axis as the document moves in the first direction. The second transport section is adapted to rotate the documents by an angle $\alpha$ about a second axis causing the documents to move in a second direction along a third axis. The first axis is normal or generally normal to the second axis. The third axis is normal or generally normal to the second axis. The third transport section is adapted to rotate documents approximately 90° about the third axis as the document moves in the second direction. The third transport section is further adapted to transport the documents in the second direction from the angular transport unit to a second device of the document processing system.

Embodiment 19

According to some embodiments, an angular transport unit for use with a document processing system is provided. The angular transport unit is adapted to receive documents traveling one at a time in a first direction along a first axis from a first device of the document processing system and is further adapted to rotate the documents approximately 90° about the first axis as the document moves in the first direction. The angular transport unit is further adapted to rotate the documents by an angle α about a second axis causing the documents to move in a second direction along a third axis. The first axis is normal or generally normal to the second axis. The third axis is normal or generally normal to the second axis. The angular transport unit is further adapted to rotate documents approximately 90° about the third axis as the document moves in the second direction. The angular transport unit is further adapted to transport the documents in the second direction from the angular transport unit to a second device of the document processing system.

Embodiment 20

According to some embodiments, an angular transport unit for use with a document processing system is provided. The angular transport unit is adapted to receive documents traveling one at a time in a first direction along a first axis from a first device of the document processing system and is further adapted to rotate the documents by an angle α about a second axis causing the documents to move in a second direction along a third axis. The first and third axes are normal or generally normal to the second axis. The angular transport unit is further adapted to transport the documents in the second direction from the angular transport unit to a second device of the document processing system.

Embodiment 21

The angular transport unit of according to any of embodiments 18-20 wherein the first and third axes are generally horizontal.

Embodiment 22

According to some embodiments, an angular transport unit for use with a document processing system is provided. The angular transport unit comprises a first horizontal axis document rotating mechanism, a vertical axis document rotating mechanism, and a second horizontal axis rotating mechanism.

Embodiment 23

The angular transport unit of embodiment 22 adapted to be coupled to first and second devices and adapted receive documents from the first device and transport received documents to the second device.

Embodiment 24

The angular transport unit of embodiment 23 wherein the first device is a document handling device and the second device is a document receiving unit.

Embodiment 25

The angular transport unit of embodiment 23 wherein the first and second devices are document receiving units.

Embodiment 26

The angular transport unit according to any of embodiments 23-25 wherein the angular transport unit is adapted to be coupled to the first and second devices such that the first and second devices are offset from each other by an angle α.

Embodiment 27

The angular transport unit according to any of embodiments 17-26 wherein the documents are currency bills.

Embodiment 28

The angular transport unit according to any of embodiments 17-26 wherein the documents are currency documents.

Embodiment 29

The angular transport unit according to any of embodiments 17-26 wherein the documents are currency notes.

Embodiment 30

According to some embodiments, an angular transport unit for use with a currency processing system for processing currency documents is provided. The angular transport unit comprises a first transport section, a second transport section, a third transport section, a fourth transport section and a fifth transport section. The first transport section is adapted to receive documents traveling one at a time in a first generally horizontal direction along a first generally horizontal axis from a first device of the document processing system. The second transport section is adapted to rotate the documents approximately 90° about the first generally horizontal axis as the document moves in the first generally horizontal direction. The third transport section is adapted to rotate the documents by an angle α about a generally vertical axis causing the documents to move in a second generally horizontal direction along a second generally horizontal axis. The first generally horizontal axis is generally normal to the generally vertical axis. The second generally horizontal axis is generally normal to the vertical axis. The fourth transport section is adapted to rotate documents approximately 90° about the second generally horizontal axis as the document moves in the second generally horizontal direction. The fifth transport section is adapted to transport the documents in the second generally horizontal direction from the angular transport unit to a second device of the document processing system.

Embodiment 31

According to some embodiments, an angular transport unit for use with a currency processing system for processing currency documents is provided. The angular transport unit comprises a first transport section, a second transport section, and a third transport section. The first transport section is adapted to receive documents traveling one at a time in a first generally horizontal direction along a first generally horizontal axis from a first device of the document processing system. The first transport section is further adapted to rotate the documents approximately 90° about the first generally horizontal axis as the document moves in the first generally horizontal direction. The second transport section is adapted to rotate the documents by an angle α about a generally vertical axis causing the documents to move in a second generally horizontal direction along a second generally horizontal axis. The first generally horizontal axis is generally normal to the generally vertical axis. The second generally horizontal axis is generally normal to the vertical axis. The third transport section is adapted to rotate documents approximately 90° about the second generally horizontal axis as the document moves in the second generally horizontal direction. The third transport section is further adapted to transport the documents in the second generally horizontal direction from the angular transport unit to a second device of the document processing system.

Embodiment 32

According to some embodiments, an angular transport unit for use with a currency processing system for processing currency documents is provided. The angular transport unit comprises a first transport section, a second transport section, a third transport section, a fourth transport section and a fifth transport section. The first transport section is adapted to receive documents traveling one at a time in a first direction along a first axis from a first device of the document processing system. The second transport section is adapted to rotate the documents approximately 90° about the first axis as the document moves in the first direction. The third transport section is adapted to rotate the documents by an angle α about a second axis causing the documents to move in a second direction along a third axis. The first axis is generally normal to the second axis. The third axis is generally normal to the second axis. The fourth transport section is adapted to rotate documents approximately 90° about the third axis as the document moves in the second direction. The fifth transport section is adapted to transport the documents in the second direction from the angular transport unit to a second device of the document processing system.

Embodiment 33

According to some embodiments, an angular transport unit for use with a currency processing system for processing currency documents is provided. The angular transport unit comprises a first transport section, a second transport section, and a third transport section. The first transport section is adapted to receive documents traveling one at a time in a first direction along a first axis from a first device of the document processing system and is further adapted to rotate the documents approximately 90° about the first axis as the document moves in the first direction. The second transport section is adapted to rotate the documents by an angle α about a second axis causing the documents to move in a second direction along a third axis. The first axis is normal to the second axis. The first axis is normal to the third axis. The third axis is generally normal to the second axis. The third transport section is adapted to rotate documents approximately 90° about the third axis as the document moves in the second direction. The third transport section is further adapted to transport the documents in the second direction from the angular transport unit to a second device of the document processing system.

Embodiment 34

The transport unit according to any of embodiments 17-33 wherein the angle α is between about 10° and about 170°.

Embodiment 35

The transport unit according to any of embodiments 17-34 wherein the angle α is between about 45° and about 135°.

Embodiment 36

The transport unit according to any of embodiments 17-35 wherein the angle α is about 45°.

Embodiment 37

The transport unit according to any of embodiments 17-35 wherein the angle α is about 90°.

Embodiment 38

The transport unit according to any of embodiments 17-35 wherein angle α is approximately 90° and the first and second axes are generally horizontal axes and the first generally horizontal axis is generally normal to the second generally horizontal axis.

Embodiment 39

According to some embodiments, an angular transport unit for use with a currency processing system for processing currency documents is provided. The angular transport unit comprises a first transport section, a second transport section, a third transport section, a fourth transport section and a fifth transport section. The first transport section is adapted to receive documents traveling one at a time in a first generally horizontal direction along a first generally horizontal axis from a first device of the document processing system. The second transport section is adapted to rotate the documents approximately 90° about the first generally horizontal axis as the document moves in the first generally horizontal direction. The third transport section is adapted to rotate the documents approximately from about 45° to about 100° about a generally vertical axis causing the documents to move in a second generally horizontal direction along a second generally horizontal axis. The first generally horizontal axis is normal to the generally vertical axis. The first generally horizontal axis is normal to the second generally horizontal axis. The second generally horizontal axis is generally normal to the vertical axis. The fourth transport section is adapted to rotate documents approximately 90° about the second generally horizontal axis as the document moves in the second generally horizontal direction. The fifth transport section is adapted to transport the documents in the second generally horizontal direction from the angular transport unit to a second device of the document processing system.

Embodiment 40

According to some embodiments, an angular transport unit for use with a currency processing system for processing currency documents is provided. The angular transport unit comprises a first transport section, a second transport section, and a third transport section. The first transport section is adapted to receive documents traveling one at a time in a first generally horizontal direction along a first generally horizontal axis from a first device of the document processing system. The first transport section is further adapted to rotate the documents approximately 90° about the first generally horizontal axis as the document moves in the first generally horizontal direction. The second transport section is adapted to rotate the documents approximately from about 45° to about 100° about a generally vertical axis causing the documents to move in a second generally horizontal direction along a second generally horizontal axis. The first generally horizontal axis is normal to the generally vertical axis. The first generally horizontal axis is normal to the second generally horizontal axis. The second generally horizontal axis is generally normal to the vertical axis. The third transport section is adapted to rotate documents approximately 90° about the second generally horizontal axis as the document moves in the second generally horizontal direction. The third transport section is further adapted to transport the documents in the second generally horizontal direction from the angular transport unit to a second device of the document processing system.

Embodiment 41

According to some embodiments, a currency document connecting unit comprises a cabinet adapted to be coupled to a currency document handling device and a currency document receiving unit. When coupled to the handling device and the receiving unit, the handling device, the connecting unit, and the receiving unit are configured in a generally L-shaped manner. The connecting unit has an input port that is adapted to receive currency documents from the currency handling device when coupled thereto. The connecting unit has an output port that is adapted to permit currency documents to be sent to the currency document receiving unit when coupled thereto. The connecting unit has a transport mechanism adapted to receive currency documents from the input port and transport them serially to the output port.

Embodiment 42

According some embodiments, a currency document connecting unit comprises a cabinet adapted to be coupled to a first currency document receiving unit and a second currency document receiving unit. When coupled to the first and second currency document receiving units, the first and second currency document receiving units and the connecting unit are configured in a generally L-shaped manner. The connecting unit has an input port that is adapted to receive currency documents from the first currency document receiving unit when coupled thereto. The connecting unit has an output port adapted to permit currency documents to be sent to the second currency document receiving unit when coupled thereto. The connecting unit has a transport mechanism adapted to receive currency documents from the input port and transport them serially to the output port.

Embodiment 43

According to another embodiment, a currency document connecting unit comprises a cabinet, an input port, an output port, and a transport mechanism. The cabinet is adapted to be coupled to a currency document handling device and a currency document receiving unit such that when coupled to the handling device and the receiving unit, the document handling device and the receiving unit are oriented at approximately ninety degrees (90°) relative to each other. The input port is adapted to receive currency documents from the currency document handling device when coupled thereto. The output port is adapted to permit currency documents to be sent to the currency document receiving unit when coupled thereto. The transport mechanism is adapted to receive currency documents from the input port and transport them serially to the output port.

Embodiment 44

According some embodiments, a currency document connecting unit comprises a cabinet, an input port, an output port, and a transport mechanism. The cabinet is adapted to be coupled to a first currency document receiving unit and a second currency document receiving unit such that when coupled to the two receiving units, the two receiving units are oriented at approximately ninety degrees) (90°) relative to each other. The input port is adapted to receive currency documents from the first currency document receiving unit when coupled thereto. The output port is adapted to permit currency documents to be sent to the second currency document receiving unit when coupled thereto. The transport mechanism is adapted to receive currency documents from the input port and transport them serially to the output port.

Embodiment 45

According to another embodiment, a currency document connecting unit comprises a cabinet, an input port, an output port, and a transport mechanism. The cabinet is adapted to be coupled to a currency document handling device and a currency document receiving unit such that when coupled to the handling device and the receiving unit, the document handling device and the receiving unit are oriented relative to each other such that the document handling device and the receiving unit are offset from each other by an angle $\alpha$. The input port is adapted to receive currency documents from the currency document handling device when coupled thereto. The output port is adapted to permit currency documents to be sent to the currency document receiving unit when coupled thereto. The transport mechanism is adapted to receive currency documents from the input port and transport them serially to the output port.

Embodiment 46

According some embodiments, a currency document connecting unit comprises a cabinet, an input port, an output port, and a transport mechanism. The cabinet is adapted to be coupled to a first currency document receiving unit and a second currency document receiving unit such that when coupled to the two receiving units, the two receiving units are oriented relative to each other such that the two receiving units are offset from each other by an angle $\alpha$. The input port is adapted to receive currency documents from the first currency document receiving unit when coupled thereto. The output port is adapted to permit currency documents to be sent to the second currency document receiving unit when coupled thereto. The transport mechanism is adapted to receive currency documents from the input port and transport them serially to the output port.

Embodiment 47

The connecting unit according to any of embodiments 45-46 wherein the angle $\alpha$ is between about 10° and about 170°.

Embodiment 48

The connecting unit according to any of embodiments 45-47 wherein the angle $\alpha$ is between about 45° and about 135°.

Embodiment 49

The connecting unit according to any of embodiments 45-48 wherein the angle α is about 45°.

Embodiment 50

The connecting unit according to any of embodiments 45-48 wherein the angle α is about 90°.

Embodiment 51

According to some embodiments, a currency processing system is provided for processing a stack of currency bills, each bill having a respective denomination. The system comprises a currency handling device, a first currency receiving unit, and a first angular transport unit. The currency handling device has an input receptacle adapted to receive bills to be processed, an evaluation unit comprising one or more detectors adapted to retrieve information from a passing bill which is used to denominate a passing bill, and a transport mechanism that defines a transport path between the input receptacle, past the evaluating unit, and to an exit of the handling device. The transport mechanism is adapted to transport each bill individually along the transport path. The first currency receiving unit is adapted to receive at least some bills processed by the evaluating unit of the currency handling device. The first angular transport unit is adapted to receive bills from the currency handling device and transport bills to the first currency receiving unit. The angular transport unit has a transport mechanism adapted to rotate bills about a vertical axis as the bills are transported through the angular transport unit.

Embodiment 52

The system of embodiment 51 wherein the angular transport unit has a transport mechanism adapted to rotate bills about a vertical axis by an angle α as the bills are transported through the angular transport unit.

Embodiment 53

According to some embodiments, a currency document processing system is provided for processing a stack of currency documents. The system comprises a currency document handling device, a first currency document receiving unit, and a first angular transport unit. The currency document handling device has an input receptacle adapted to receive currency documents to be processed, one or more detectors adapted to retrieve information from passing currency documents which is used to make judgments about passing currency documents, and a transport mechanism adapted to transport at least some of the currency documents, one a time, from the input receptacle, past the one or more detectors, and to an exit of the handling device. The first currency document receiving unit is adapted to receive at least some bills processed by the currency document handling device. The first angular transport unit is adapted to receive currency documents from the currency handling device and transport currency documents to the first currency document receiving unit. The angular transport unit has a transport mechanism adapted to rotate bills about a vertical axis as the bills are transported through the angular transport unit.

Embodiment 54

The system of embodiment 53 wherein the angular transport unit has a transport mechanism adapted to rotate bills about a vertical axis by an angle α as the bills are transported through the angular transport unit.

Embodiment 55

The system according to any of embodiments 53-54 wherein the currency documents are currency bills, the currency document handling device is a currency handling device and the currency document receiving unit is a currency receiving unit.

Embodiment 56

The system according to any of embodiments 53-54 wherein the currency documents are currency notes, the currency document handling device is a currency note handling device and the currency document receiving unit is a currency note receiving unit.

Embodiment 57

According to some embodiments, a currency document processing system comprises a currency document handling device and a first currency document receiving unit. The currency document handling device has a cabinet that comprises a front side, a left side, and a right side. The currency document handling device has an input receptacle adapted to receive currency documents, and one or more detectors adapted to retrieve information from passing currency documents. The information retrieved from a passing currency document is used to make a judgment about the passing currency document. The currency document handling device has a transport mechanism that defines one or more transport paths from the input receptacle and past the one or more detectors. The transport mechanism is adapted to transport each currency document individually along the one or more transport paths. The transport mechanism is adapted to transport at least some of the currency documents out of the handling device. The detectors and the transport mechanism reside in the cabinet. The front side of the cabinet lies generally in a first generally vertical plane. The first currency document receiving unit has a transport mechanism adapted to transport currency documents individually along one or more transport paths. The first currency document receiving unit is adapted to receive at least some currency documents processed by the currency handling device and transport the received currency documents along the one or more transport paths of the first currency document receiving unit. The first currency document receiving unit has a front side. The front side of the first currency document receiving unit lies generally in a second generally vertical plane. The first and second generally vertical planes are offset from each other by an angle α.

Embodiment 58

According to some embodiments, a currency document processing system comprises a currency handling device and a first modular unit. The currency handling device has a cabinet comprising a front side, a back side, a left side and a right side. The front side lies generally in a first generally vertical plane and the back side lies in a second generally vertical plane which is generally parallel to the first generally vertical plane. The currency handling device has an input receptacle adapted to receive a stack of currency documents, one or more detectors adapted to retrieve information from passing currency documents which is used to make judgments about the passing currency documents, a plurality of output receptacles adapted to receive at least some of the currency documents, and a transport mechanism defining one or more transport paths from the input receptacle and past the one or more detectors. The transport mechanism is adapted to transport each currency document individually along the one or more transport paths. The transport mechanism is adapted to transport at least some of the currency documents into the plurality of output receptacles in the currency handling device or out of the handling device. The input receptacle, the detectors, the output receptacles and the transport mechanism reside in the cabinet. The first modular unit has one or more output locations. The first modular unit also has a transport mechanism adapted to transport currency documents individually along one or more transport paths. The first modular unit is adapted to receive at least some currency documents processed by the currency handling device and to transport the received currency documents along the one or more transport paths of the first modular unit to the one or more output locations. The first modular unit has a front side. The front side of the first modular unit lying generally in a third generally vertical plane. The first and third generally vertical planes are offset from each other by an angle $\alpha$.

Embodiment 59

According to some embodiments, a currency document processing system comprises a currency handling device and a first modular unit. The currency handling device has a cabinet comprising a front side, a back side, a left side and a right side. The front side lies generally in a first generally vertical plane and the back side lies in a second generally vertical plane which is generally parallel to the first generally vertical plane. The currency handling device has one or more detectors adapted to retrieve information from passing currency documents which is used to make judgments about the passing currency documents, a plurality of output receptacles adapted to receive at least some of the currency documents, and a transport mechanism defining one or more transport paths past the one or more detectors. The transport mechanism is adapted to transport each currency document individually along the one or more transport paths. The transport mechanism is adapted to transport at least some of the currency documents into the plurality of output receptacles or out of the handling device. The detectors, the output receptacles and the transport mechanism reside in the cabinet. The first modular unit has one or more output locations. The first modular unit also has a transport mechanism adapted to transport currency documents individually along one or more transport paths. The first modular unit is adapted to receive at least some currency documents processed by the currency handling device and transport the received currency documents along the one or more transport paths of the first modular unit to the one or more output locations. The first modular unit has a front side. The front side of the first modular unit lies generally in a third generally vertical plane. The first and third generally vertical planes are offset from each other by an angle $\alpha$.

Embodiment 60

The system according to any of embodiments 58-59 wherein the first modular unit comprises a strapping unit.

Embodiment 61

The system according to any of embodiments 58-59 wherein the first modular unit comprises one or more output receptacles.

Embodiment 62

The system according to any of embodiments 58-59 wherein the first modular unit comprises a shredder.

Embodiment 63

According to some embodiments, a currency document processing system is provided for processing a stack of currency documents. The system comprises a currency document handling device, a first currency document receiving unit, and a first angular transport unit. The currency handling device has an input receptacle adapted to receive currency documents to be processed, one or more detectors adapted to retrieve information from passing currency documents, and a transport mechanism adapted to transport at least some of the currency documents, one at a time, from the input receptacle, past the one or more detectors, and to an exit of the handling device. The first currency receiving unit is adapted to receive at least some currency documents processed by the currency document handling device. The first angular transport unit is adapted to receive bills from the currency handling device and transport bills to the first currency receiving unit. The angular transport unit has a transport mechanism adapted to rotate bills about a vertical axis by an angle $\alpha$ as the bills are transported through the angular transport unit.

Embodiment 64

The system according to any of embodiments 52, 54-63 wherein the angle $\alpha$ is between about 10° and about 170°.

Embodiment 65

The system according to any of embodiments 52, 54-64 wherein the angle $\alpha$ is between about 45° and about 135°.

Embodiment 66

The system according to any of embodiments 52, 54-65 wherein the angle $\alpha$ is about 45°.

Embodiment 67

The system according to any of embodiments 52, 54-65 wherein the angle $\alpha$ is about 90°.

Embodiment 68

According to a further embodiment, a currency document processing system comprises a currency document handling device, and a currency document receiving unit. The currency document handling device has an input receptacle adapted to receive a stack of currency documents, one or more detectors adapted to retrieve information from passing currency documents which is used to make judgments about the passing currency documents, a plurality of output receptacles adapted to receive at least some of the currency documents, and a transport mechanism defining one or more transport paths from the input receptacle and past the one or more detectors.

The transport mechanism is adapted to transport each currency document individually along the one or more transport paths, and to transport at least some of the currency documents into the plurality of output receptacles or to the currency document receiving unit. The currency document receiving unit has one or more output locations. The receiving unit also has a transport mechanism to transport currency documents individually along one or more transport paths. The currency document receiving unit is adapted to receive at least some currency documents processed by the currency document handling device and transport the received currency documents along the one or more transport paths of the currency document receiving unit to the one or more output locations. The currency document handling device and the currency document receiving unit are configured in a generally L-shaped manner.

Embodiment 69

According to some embodiments, a currency document processing system comprises a currency document handling device and a currency document receiving unit. The currency document handling device has one or more detectors adapted to retrieve information from passing currency documents which is used to make judgments about the passing currency documents, a plurality of output receptacles adapted to receive at least some of the currency documents, and a transport mechanism defining one or more transport paths past the one or more detectors. The transport mechanism is adapted to transport each currency document individually along the one or more transport paths and to transport at least some of the currency documents into the plurality of output receptacles or to the currency document receiving unit. The currency document receiving unit has one or more output locations. The receiving unit also has a transport mechanism adapted to transport currency documents individually along one or more transport paths. The currency document receiving unit is adapted to receive at least some currency documents processed by the currency document handling device and transport the received currency documents along the one or more transport paths of the currency document receiving unit to the one or more output locations. The currency document handling device and the currency document receiving unit are configured in a generally L-shaped manner.

Embodiment 70

According some embodiments, a currency document handling device comprises an input receptacle adapted to receive a stack of currency documents, one or more detectors to retrieve information from a passing currency document which is used to make a judgment about the passing currency document. The handling device further comprises a plurality of output receptacles adapted to receive at least some of the currency documents, a modular exit port, and a transport mechanism that defines one or more transport paths from the input receptacle, past the one or more detectors, and to the plurality of output receptacles and the exit port. The transport mechanism is adapted to transport each currency document individually along the one or more transport paths. The currency document handling device has a cabinet. The exit port is positioned on a side of the cabinet. The currency document handling device is adapted to be optionally coupled to a currency document receiving unit. The currency document receiving unit has one or more output locations. The receiving unit also has a transport mechanism adapted to transport currency documents individually along one or more transport paths. The currency document receiving unit is adapted to receive at least some currency documents processed by the currency handling device when coupled to the currency document handling device and transport the received currency documents along the one or more transport paths of the currency document receiving unit to the one or more output locations. The currency handling device is adapted to be coupled to the currency document receiving unit such that when coupled together the currency handling device and the currency document receiving unit are configured in a generally L-shaped manner.

Embodiment 71

According to some embodiments, a currency document handling device comprises one or more detectors adapted to retrieve information from passing currency documents which is used to make judgments about the passing currency documents. The handling device further comprises a plurality of output receptacles adapted to receive at least some of the currency documents, a modular exit port, and a transport mechanism that defines one or more transport paths past the one or more detectors, and to the plurality of output receptacles and the exit port. The transport mechanism is adapted to transport each currency document individually along the one or more transport paths. The currency document handling device has a cabinet. The exit port is positioned on a side of the cabinet. The currency document handling device is adapted to be optionally coupled to a currency document receiving unit. The receiving unit has one or more output locations. The receiving unit also has a transport mechanism adapted to transport currency documents individually along one or more transport paths. The currency document receiving unit is adapted to receive at least some currency documents processed by the currency handling device when coupled to the currency document handling device and transport the received currency documents along the one or more transport paths of the currency document receiving unit to the one or more output locations. The currency handling device is adapted to be coupled to the receiving unit such that when coupled together the currency handling device and the receiving unit are configured in a generally L-shaped manner.

Embodiment 72

The system according to any of embodiments 70-71 wherein the currency document handling device is adapted to be coupled in a generally L-shaped manner to a currency document receiving unit which is a strapping unit.

Embodiment 73

The system according to any of embodiments 70-71 wherein the currency document handling device is adapted to be coupled in a generally L-shaped manner to a currency document receiving unit which comprises one or more output receptacles.

Embodiment 74

The system according to any of embodiments 70-71 wherein the currency document handling device is adapted to be coupled in a generally L-shaped manner to a currency document receiving unit which is a shredder.

Embodiment 75

According to some embodiments, a currency document receiving unit comprises a currency document input port, one or more output locations, a first transport mechanism adapted to receive currency documents from the input port and transport the currency documents individually along one or more transport paths. The currency document receiving unit further comprises a cabinet adapted to be coupled to a currency handling device such that when coupled together the currency handling device and the currency document receiving unit are configured in a generally L-shaped manner. The currency document receiving unit is adapted to receive at least some currency documents processed by the currency handling device when coupled to the currency document handling device and transport the received currency documents along the one or more transport paths of the currency document receiving unit to the one or more output locations. The currency document handling device comprises one or more detectors adapted to retrieve information from passing currency documents which is used to make judgments about the passing currency documents, an exit port, and a second transport mechanism defining one or more transport paths past the one or more detectors to the exit port. The second transport mechanism is adapted to transport each currency document individually along the one or more transport paths.

Embodiment 76

According to some embodiments, a currency document processing system is provided for processing a stack of currency documents. The system comprises a generally rectangularly-shaped currency document handling device, a generally rectangularly-shaped currency document receiving unit, and an angular transport unit. The currency document handling device is coupled to the angular transport unit and the angular transport unit is coupled to the currency document receiving unit. The currency document handling device, the angular transport unit, and the currency document receiving unit are coupled together in a non-linear manner.

Embodiment 77

According to some embodiments, a currency document processing system is provided for processing a stack of currency documents. The system comprises a currency document handling device, a currency document receiving unit, and an angular transport unit. The currency document handling device is coupled to the angular transport unit and the angular transport unit is coupled to the currency document receiving unit. The currency document handling device, the angular transport unit, and the currency document receiving unit are coupled together in a non-linear manner.

Embodiment 78

The system according to any of embodiments 76-77 wherein the first angular transport unit is adapted to receive currency documents from the currency handling device and transport currency documents to the first currency receiving unit. The angular transport unit has a transport mechanism adapted to rotate bills about a vertical axis by an angle $\alpha$ as the bills are transported through the angular transport unit.

Embodiment 79

According to some embodiments, a currency document processing system is provided for processing a stack of currency documents. The system comprises a generally rectangularly-shaped currency document handling device and a generally rectangularly-shaped currency document receiving unit. The currency document handling device and the currency document receiving unit are coupled together in a non-linear manner.

Embodiment 80

According to some embodiments, a currency document processing system is provided for processing a stack of currency documents. The system comprises a currency document handling device and a currency document receiving unit. The currency document handling device and the currency document receiving unit are coupled together in a non-linear manner.

Embodiment 81

The system according to any of embodiments 76-80 wherein the currency document handling device has an input receptacle adapted to receive currency documents to be processed, one or more detectors adapted to retrieve information from passing currency documents, and a transport mechanism adapted to transport at least some of the currency documents, one at a time, from the input receptacle, past the one or more detectors, and to an exit of the handling device. The currency document receiving unit is adapted to receive at least some currency documents processed by the currency document handling device.

Embodiment 82

The system according to any of embodiments 76-81 wherein the currency document handling device and a currency document receiving unit are arranged in a non-linear manner such that an angle $\alpha$ is defined between the currency document handling device and a currency document receiving unit.

Embodiment 83

The system of embodiment 82 wherein the angle $\alpha$ is between about 10° and about 170°.

Embodiment 84

The system of embodiment 82 wherein the angle $\alpha$ is between about 45° and about 135°.

Embodiment 85

The system of embodiment 82 wherein the angle $\alpha$ is about 45°.

Embodiment 86

The system of embodiment 82 wherein the angle $\alpha$ is about 90°.

Embodiment 87

The system according to any of embodiments 76-86 wherein the currency document handling device is a currency handling device and the currency document receiving unit is a currency receiving unit.

Embodiment 88

The system according to any of embodiments 76-86 wherein the currency document handling device is a currency note handling device and the currency document receiving unit is a currency note receiving unit.

Embodiment 89

According to some embodiments, a currency document processing system is provided for processing a stack of currency documents. The system resides in a three-dimensional space defined by a X-axis, a Y-axis, and a Z-axis. The system comprises a currency document handling device and a currency document receiving unit. The currency document handling device is coupled to the currency document receiving unit. The currency document handling device has a transport mechanism adapted to transport currency documents, one at a time, such that the motion of the documents can be defined exclusively by changes in the X-axis and the Z-axis, the motion of the documents in the currency document handling device generally not changing along the Y-axis. The currency document receiving unit has a transport mechanism adapted to transport currency documents, one at a time, such that the motion of the documents can be defined exclusively by changes in the Y-axis and the Z-axis, the motion of the documents in the document receiving unit generally not changing along the X-axis.

Embodiment 90

The system of embodiment 89 wherein the currency document handling device is coupled to the currency document receiving unit via an angular transport unit coupled between the currency document handling device and the currency document receiving unit and wherein the angular transport unit has a transport mechanism adapted to receive currency documents from the currency document handling device having a motion defined exclusively by changes in the X-axis and Z-axis and to rotate the currency documents such that their motion can be defined exclusively by changes in the Y-axis and Z-axis and adapted to transport the rotated documents to the currency document receiving unit.

Embodiment 91

According to some embodiments, a currency document processing system is provided for processing a stack of currency documents. The system comprises a currency document handling device and a currency document receiving unit. The currency document handling device having a footprint having a front edge. The currency document receiving unit having a footprint. The currency document handling device is coupled to the currency document receiving unit such that at least part of the footprint of the currency document receiving unit is positioned in front of the front edge of the footprint of the currency document handling device. The currency document handling device having a transport mechanism adapted to transport currency documents, one at a time, to a transport mechanism of the currency document receiving unit. The transport mechanism of the currency document receiving unit is adapted to transport currency documents, one at a time, along one or more transport paths in the currency document receiving unit. The transport mechanism of the currency document receiving unit is adapted to transport currency documents received from the currency document handling device to a position in front of the front edge of the footprint of the currency document handling device.

Embodiment 92

According to some embodiments, a currency document processing system is provided for processing a stack of currency documents. The system comprises a currency document handling device and a currency document receiving unit. The currency document handling device having a footprint having a back edge. The currency document receiving unit having a footprint. The currency document handling device is coupled to the currency document receiving unit such that at least part of the footprint of the currency document receiving unit is positioned in back of the back edge of the footprint of the currency document handling device. The currency document handling device having a transport mechanism adapted to transport currency documents, one at a time, to a transport mechanism of the currency document receiving unit. The transport mechanism of the currency document receiving unit is adapted to transport currency documents, one at a time, along one or more transport paths in the currency document receiving unit. The transport mechanism of the currency document receiving unit is adapted to transport currency documents received from the currency document handling device to a position in back of the back edge of the footprint of the currency document handling device.

Embodiment 93

The system according to any of embodiments 91-92 wherein the currency document handling device is coupled to the currency document receiving unit via an angular transport unit coupled between the currency document handling device and the currency document receiving unit.

Embodiment 94

A currency document processing system for processing a stack of currency documents including currency bills, each bill having a respective denomination, the system comprising: a currency handling device having an input receptacle adapted to receive currency documents including bills to be processed, an evaluation unit comprising one or more detectors adapted to retrieve information from a passing bill which is used to denominate the passing bill, a plurality of output receptacles adapted to receive at least some of the bills processed by the evaluating unit, and a transport mechanism defining a transport path between the input receptacle, past the evaluating unit, and the plurality of output receptacles, the transport mechanism being adapted to transport each bill individually along the transport path, the transport mechanism being adapted to route the bills into the plurality of output receptacles or to transport the bills out of the handling device based on the denomination of the bills as determined from the information obtained from the one or more detectors so that an individual one of the output receptacles contains bills having the same denomination; a first currency document receiving unit adapted to receive at least some bills processed by the evaluating unit; and a first angular transport unit, the angular transport unit adapted to receive bills from the currency handling device and transport bills to the first currency document receiving unit, the angular transport unit having a transport mechanism adapted to rotate bills from approximately forty five degrees (45°) to approximately one hundred thirty-five degrees (135°) about a vertical axis as the bills are transported through the angular transport unit.

Embodiment 95

The system of embodiment 94, wherein the handling device, the first strapping unit, and the first angular transport unit form a generally L-shaped system.

Embodiment 96

The system of embodiment 94, wherein the system has a width of approximately 6.5 feet and a depth of approximately 5 feet.

Embodiment 97

The system of embodiment 94, wherein the first currency document receiving unit comprises a bill receiving assembly having a plurality of output receptacles.

Embodiment 98

The system of embodiment 94, wherein the first currency document receiving unit comprises a strapping unit for strapping stacks of bills.

Embodiment 99

The system of embodiment 98, wherein the first strapping unit comprises one or more output receptacles having a stack limit which determines how many bills will form a complete stack of bills, the first strapping unit being adapted to receive bills one at a time after the bills are transported through the currency handling device, the first strapping unit being adapted to strap stacks of bills after being placed in a strapping position, the first strapping unit having a stack moving mechanism adapted to move a stack of bills selected for strapping from any of the one or more output receptacles of the first strapping unit to the strapping position.

Embodiment 100

The system of embodiment 98 further comprising: a second strapping unit for strapping stacks of bills; and a second angular transport unit, the angular transport unit adapted to receive bills from the first stacking unit and transport bills to the second strapping unit, the angular transport unit having a transport mechanism adapted to rotate bills from approximately forty-five degrees (45°) to approximately one hundred thirty-five degrees (135°) about a vertical axis as the bills are transported through the angular transport unit.

Embodiment 101

The system of embodiment 100, wherein the handling device, the first strapping unit, the first angular transport unit, and the second strapping device, and the second angular transport unit form a generally U-shaped system.

Embodiment 102

The system of embodiment 100, wherein the system has a width of approximately 6.5 feet and a depth of approximately 6.5 feet.

Embodiment 103

The system of embodiment 94, wherein the first angular transport unit comprises a first bill rotating section, a second bill rotating section, and an intermediate section between the first and second bill rotating sections, wherein a bill is rotated approximately 90° about a first horizontal axis in the first bill rotating section, the bill is rotated from approximately 45° to approximately 135° about a vertical axis in the intermediate section, and the bill is rotated approximately 90° about a second horizontal axis in the second bill rotating section, wherein the first horizontal axis is generally normal to the second horizontal axis, and the first horizontal axis and the second horizontal axis are each generally normal to the vertical axis.

Embodiment 104

The system of embodiment 94, wherein bills are transported through the system in excess of 400 bills per minute.

Embodiment 105

The system of embodiment 94, wherein bills are transported through the system in excess of 1200 bills per minute.

Embodiment 106

A method for processing and strapping currency documents including currency bills utilizing a currency processing and strapping system having a currency processing unit, a first currency strapping unit, and an angular transport unit, the method comprising the acts of: receiving a plurality of bills in an input receptacle of the currency handling device; transporting individually the bills from the input receptacle to one or more of a plurality of output receptacles located within the currency handling device and the first currency strapping unit; determining the denomination of the bills within the currency handling device; sorting the bills into the plurality of output receptacles based on their denominations so that each output receptacles receives bills of only one denomination; routing bills to be transported to one or more output receptacles located within the first strapping unit through the angular transport unit from the currency handling device; rotating bills the act of routing sends to the angular transport unit from about 45° to about 135° about a vertical axis, such that a bill entering the angular transport unit traveling in a first generally horizontal direction exits the angular transport unit traveling in a second generally horizontal direction that is from about 45° to about 135° from the first generally horizontal direction; monitoring whether a complete stack of bills of the same denomination have been received in any of the output receptacles of the first strapping unit; moving a complete stack of bills from one of the plurality of output receptacles of the first strapping unit to a strapping position; strapping a complete stack of bills that is placed in the strapping position.

Embodiment 107

The method of embodiment 106 further comprising: using a stack carrying structure to transport a complete stack of bills to the strapping position; and using a conveyor belt adapted to support and move the carrying structure from at least one loading position to the strapping position, the conveyor belt being positioned proximate the output receptacles and the strapping position.

Embodiment 108

The method of embodiment 106, wherein the strapping position is adapted to receive stacks of bills from more than one of the plurality of output receptacles within the first strapping unit.

Embodiment 109

The method of embodiment 106, wherein the act of transporting occurs at a rate of at least 400 bills per minute.

Embodiment 110

The method of embodiment 106, wherein the act of transporting occurs at a rate of at least 1200 bills per minute.

Embodiment 111

An angular transport unit for use with a currency document processing system, the angular transport unit comprising: a first transport section adapted to receive currency documents traveling one at a time in a first generally horizontal direction along a first generally horizontal axis from a first device of the currency processing system; a second transport section adapted to rotate the documents approximately 90° about the first generally horizontal axis as the document moves in the first generally horizontal direction; a third transport section adapted to rotate the documents approximately 90° about a generally vertical axis causing the documents to move in a second generally horizontal direction along a second generally horizontal axis, the first generally horizontal axis being normal to the generally vertical axis, the first generally horizontal axis being normal to the second generally horizontal axis, the second generally horizontal axis being generally normal to the vertical axis; a fourth transport section adapted to rotate documents approximately 90° about the second generally horizontal axis as the document moves in the second generally horizontal direction; and a fifth transport section adapted to transport the documents in the second generally horizontal direction from the angular transport unit to a second device of the currency processing system.

Embodiment 112

The angular transport unit of embodiment 111, wherein the first device is a currency handling device.

Embodiment 113

The angular transport unit of embodiment 111, wherein the second device is a currency strapping unit.

Embodiment 114

The angular transport unit of embodiment 111, wherein the second transport section has a first document guide and a second document guide adapted to support a document as the document rotates about the first generally horizontal axis.

Embodiment 115

The angular transport unit of embodiment 111, wherein the fourth transport section has a first document guide and a second document guide adapted to support a document as the document rotates about the second generally horizontal axis.

Embodiment 116

A method for processing currency documents including currency bills utilizing a currency processing system having a currency processing unit, a first modular output receptacle unit, and a first angular transport unit, the method comprising the acts of: receiving a plurality of bills in an input receptacle of the currency processing unit; transporting individually the bills from the input receptacle to one of a plurality of output receptacles located within the currency processing unit and the first modular output receptacle unit; determining the denomination of the bills within the currency processing unit; sorting the bills into the plurality of output receptacles based on their denominations so that each output receptacles receives bills of only one denomination; routing bills to be transported to one or more output receptacles located within the first modular output receptacle unit through the first angular transport unit from the currency handling device; and rotating bills the act of routing sends to the first angular transport unit 90° about a vertical axis, such that a bill entering the first angular transport unit traveling in a first generally horizontal direction exits the first angular transport unit traveling in a second generally horizontal direction that is generally normal to the first generally horizontal direction.

Embodiment 117

The method of embodiment 116, wherein the act of transporting occurs at a rate of at least 400 bills per minute.

Embodiment 118

The method of embodiment 116, wherein the act of transporting occurs at a rate of at least 1200 bills per minute.

Embodiment 119

A currency processing system for processing a stack of currency documents including currency bills, each bill having a respective denomination, the system comprising: a currency handling device having an input receptacle adapted to receive bills to be processed, an evaluation unit comprising one or more detectors adapted to retrieve information from a passing bill which is used to denominate the passing bill, and a transport mechanism defining a transport path between the input receptacle, past the evaluating unit, and out of the handling device; a first currency document receiving unit adapted to receive at least some bills processed by the evaluating unit; and a first angular transport unit adapted to receive bills from the currency handling device and transport bills to the first currency document receiving unit, the angular transport unit having a transport mechanism adapted to rotate bills about a vertical axis as the bills are transported through the angular transport unit.

Embodiment 120

An angular transport unit for use with a currency document processing system, the angular transport unit comprising: a first transport section adapted to receive currency documents traveling one at a time in a first generally horizontal direction along a first generally horizontal axis from a first device of the currency processing system; a second transport section adapted to rotate the documents approximately 90° about the first generally horizontal axis as the document moves in the first generally horizontal direction; a third transport section adapted to rotate the documents from approximately 45° to approximately 135° about a generally vertical axis causing the documents to move in a second generally horizontal direction along a second generally horizontal axis, the first generally horizontal axis being normal to the generally vertical axis, the second generally horizontal axis being generally normal to the vertical axis; a fourth transport section adapted to rotate documents approximately 90° about the second generally horizontal axis as the document moves in the second generally horizontal direction; and a fifth transport section adapted to transport the documents in the second generally horizontal direction from the angular transport unit to a second device of the currency processing system.

Embodiment 121

A currency document processing system comprising: a currency handling device having a cabinet comprising a front side, a left side and a right side, having an input receptacle adapted to receive currency documents, one or more detectors adapted to retrieve information from a passing currency document which is used to make a judgment about the passing currency document, and a transport mechanism defining one or more transport paths from the input receptacle and past the one or more detectors, the transport mechanism being adapted to transport each currency document individually along the one or more transport paths, the transport mechanism being adapted to transport at least some of the currency documents out of the handling device, wherein the detectors and the transport mechanism reside in the cabinet, the front side of the cabinet lying generally in a first generally vertical plane; a first currency document receiving unit having a transport mechanism adapted to transport currency documents individually along one or more transport paths, the first currency document receiving unit adapted to receive at least some currency documents processed by the currency handling device and transport the received currency documents along the one or more transport paths of the first currency document receiving unit; the first currency document receiving unit having a front side, the front side of the first currency document receiving unit lying generally in a second generally vertical plane; wherein the first and second generally vertical planes are offset from each other by an angle $\alpha$, wherein the angle $\alpha$ is between about ten degrees (10°) and about one hundred and seventy degrees) (170°).

Embodiment 122

The currency processing system of embodiment 121 wherein the angle $\alpha$ is between about forty five degrees (45°) and about one hundred thirty-five degrees (135°).

Embodiment 123

The currency processing system of embodiment 121 wherein the angle $\alpha$ is between about eighty degrees (80°) and about one hundred degrees (100°).

Embodiment 124

The currency processing system of embodiment 121 wherein the angle $\alpha$ is about ninety degrees (90°).

Embodiment 125

A currency document processing system comprising: a currency handling device having a cabinet comprising a front side, a left side and a right side, one or more detectors adapted to retrieve information from a passing currency document which is used to make a judgment about the passing currency document, and a transport mechanism defining one or more transport paths past the one or more detectors, the transport mechanism being adapted to transport each currency document individually along the one or more transport paths, the transport mechanism being adapted to transport at least some of the currency documents out of the handling device, wherein the detectors and the transport mechanism reside in the cabinet, the front side of the cabinet lying generally in a first generally vertical plane; a first currency document receiving unit having a transport mechanism adapted to transport currency documents individually along one or more transport paths, the first currency document receiving unit adapted to receive at least some currency documents processed by the currency handling device and transport the received currency documents along the one or more transport paths of the first currency document receiving unit; the first currency document receiving unit having a front side, the front side of the first currency document receiving unit lying generally in a second generally vertical plane; wherein the first and second generally vertical planes are offset from each other by an angle $\alpha$, wherein the angle $\alpha$ is between about ten degrees (10°) and about one hundred and seventy degrees (170°).

Embodiment 126

A currency document processing system comprising: a currency handling device having a cabinet comprising a front side, a back side, a left side and a right side, the front side lying generally in a first generally vertical plane and the back side lying in a second generally vertical plane which is generally parallel to the first generally vertical plane, the currency handling device having an input receptacle adapted to receive a stack of currency documents, one or more detectors adapted to retrieve information from a passing currency document which is used to make a judgment about the passing currency document, a plurality of output receptacles adapted to receive at least some of the currency documents, and a transport mechanism defining one or more transport paths from the input receptacle and past the one or more detectors, the transport mechanism being adapted to transport each currency document individually along the one or more transport paths, the transport mechanism being adapted to transport at least some of the currency documents into the plurality of output receptacles or out of the handling device, wherein the input receptacle, the detectors, the output receptacles and the transport mechanism reside in the cabinet; a first modular unit having one or more output receptacles or strapping units, the first modular unit also having a transport mechanism adapted to transport currency documents individually along one or more transport paths, the first modular unit adapted to receive at least some currency documents processed by the currency handling device and transport the received currency documents along the one or more transport paths of the first modular unit to the one or more output receptacles or strapping units; the first modular unit having a front side, the front side of the first modular unit lying generally in a third generally vertical plane; wherein the first and third generally vertical planes are offset from each other by an angle $\alpha$, wherein the angle $\alpha$ is between about ten degrees (10°) and about one hundred and seventy degrees (170°).

Embodiment 127

A currency document processing system comprising: a currency handling device having a cabinet comprising a front side, a back side, a left side and a right side, the front side lying generally in a first generally vertical plane and the back side lying in a second generally vertical plane which is generally parallel to the first generally vertical plane, the currency handling device having one or more detectors adapted to retrieve information from a passing currency document which is used to make a judgment about the passing currency document, a plurality of output receptacles adapted to receive at least some of the currency documents, and a transport mechanism defining one or more transport paths past the one or more detectors, the transport mechanism being adapted to transport each currency document individually along the one or more transport paths, the transport mechanism being adapted to transport at least some of the currency documents into the plurality of output receptacles or out of the handling device, wherein the detectors, the output receptacles and the transport mechanism reside in the cabinet; a first modular unit having one or more output receptacles or strapping units, the first modular unit also having a transport mechanism adapted to transport currency documents individually along one or more transport paths, the first modular unit adapted to receive at least some currency documents processed by the currency handling device and transport the received currency documents along the one or more transport paths of the first modular unit to the one or more output receptacles or strapping units; the first modular unit having a front side, the front side of the first modular unit lying generally in a third generally vertical plane; wherein the first and third generally vertical planes are offset from each other by an angle $\alpha$, wherein the angle $\alpha$ is between about ten degrees (10°) and about one hundred and seventy degrees) (170°).

Embodiment 128

A currency document processing system comprising: a currency handling device having an input receptacle adapted to receive a stack of currency documents, one or more detectors adapted to retrieve information from a passing currency document which is used to make a judgment about the passing currency document, a plurality of output receptacles adapted to receive at least some of the currency documents, and a transport mechanism defining one or more transport paths from the input receptacle and past the one or more detectors, the transport mechanism being adapted to transport each currency document individually along the one or more transport paths, the transport mechanism being adapted to transport at least some of the currency documents into the plurality of output receptacles or to a currency document receiving unit; and the currency document receiving unit having one or more output receptacles or strapping units, the receiving unit also having a transport mechanism adapted to transport currency documents individually along one or more transport paths, the currency document receiving unit adapted to receive at least some currency documents processed by the currency handling device and transport the received currency documents along the one or more transport paths of the currency document receiving unit to the one or more output receptacles or strapping units; wherein the currency handling device and the currency document receiving unit are configured in a generally L-shaped manner.

Embodiment 129

The currency document processing system of embodiment 128 wherein the currency handling device and the currency document receiving unit reside in an integrated generally L-shaped cabinet.

Embodiment 130

The currency document processing system of embodiment 128 wherein the currency handling device and the currency document receiving unit reside in separate cabinets and wherein the two cabinets are coupled to each other in a generally L-shaped manner.

Embodiment 131

The currency document processing system of embodiment 130 wherein the currency handling device is adapted to be coupled to the currency document receiving unit in a modular fashion and wherein the currency handling device is adapted to operate without being coupled to currency document receiving unit such that when the currency handling device is not coupled to the currency document receiving unit the currency handling device is adapted not to route bills to the currency document receiving unit.

Embodiment 132

A currency document processing system comprising: a currency handling device having one or more detectors adapted to retrieve information from a passing currency document which is used to make a judgment about the passing currency document, a plurality of output receptacles adapted to receive at least some of the currency documents, and a transport mechanism defining one or more transport paths past the one or more detectors, the transport mechanism being adapted to transport each currency document individually along the one or more transport paths, the transport mechanism being adapted to transport at least some of the currency documents into the plurality of output receptacles or to a currency document receiving unit; and the currency document receiving unit having one or more output receptacles or strapping units, the receiving unit also having a transport mechanism adapted to transport currency documents individually along one or more transport paths, the currency document receiving unit adapted to receive at least some currency documents processed by the currency handling device and transport the received currency documents along the one or more transport paths of the currency document receiving unit to the one or more output receptacles or strapping units; wherein the currency handling device and the currency document receiving unit are configured in a generally L-shaped manner.

Embodiment 133

The currency document processing system of embodiment 132 wherein the currency handling device and the currency document receiving unit reside in an integrated generally L-shaped cabinet.

Embodiment 134

A currency document processing device comprising: an input receptacle adapted to receive a stack of currency documents; one or more detectors adapted to retrieve information from a passing currency document which is used to make a judgment about the passing currency document; a plurality of output receptacles adapted to receive at least some of the currency documents; a modular exit port; and a transport mechanism defining one or more transport paths from the input receptacle, past the one or more detectors, and to the plurality of output receptacles and the exit port; the transport mechanism being adapted to transport each currency document individually along the one or more transport paths; the currency document processing device having a cabinet; the exit port being positioned on a side of the cabinet; the currency document processing device being adapted to be optionally coupled to a currency document receiving unit, the currency document receiving unit having one or more output receptacles or strapping units, the receiving unit also having a transport mechanism adapted to transport currency documents individually along one or more transport paths, the currency document receiving unit being adapted to receive at least some currency documents processed by the currency document processing device when coupled to the currency document processing device and transport the received currency documents along the one or more transport paths of the currency document receiving unit to the one or more output receptacles or strapping units; wherein the currency document processing device is adapted to be coupled to the currency document receiving unit such that when coupled together the currency processing device and the currency document receiving unit are configured in a generally L-shaped manner.

Embodiment 135

The currency document processing system of embodiment 134 wherein the currency processing device is adapted to be coupled to the currency document receiving unit in a modular fashion and wherein the currency processing device is adapted to operate without being coupled to currency document receiving unit such that when the currency processing device is not coupled to the currency document receiving unit the currency processing device is adapted not to route bills to the exit port.

Embodiment 136

A currency document processing device comprising: one or more detectors adapted to retrieve information from a passing currency document which is used to make a judgment about the passing currency document; a plurality of output receptacles adapted to receive at least some of the currency documents; a modular exit port; and a transport mechanism defining one or more transport paths past the one or more detectors, and to the plurality of output receptacles and the exit port; the transport mechanism being adapted to transport each currency document individually along the one or more transport paths; the currency document processing device having a cabinet; the exit port being positioned on a side of the cabinet; the currency document processing device being adapted to be optionally coupled to a currency document receiving unit, the currency document receiving unit having one or more output receptacles or strapping units, the receiving unit also having a transport mechanism adapted to transport currency documents individually along one or more transport paths, the currency document receiving unit being adapted to receive at least some currency documents processed by the currency document processing device when coupled to the currency document processing device and transport the received currency documents along the one or more transport paths of the currency document receiving unit to the one or more output receptacles or strapping units; wherein the currency document processing device is adapted to be coupled to the currency document receiving unit such that when coupled together the currency document processing device and the currency document receiving unit are configured in a generally L-shaped manner.

Embodiment 137

The currency document processing system of embodiment 136 wherein the currency processing device is adapted to be coupled to the currency document receiving unit in a modular fashion and wherein the currency processing device is adapted to operate without being coupled to currency document receiving unit such that when the currency processing device is not coupled to the currency document receiving unit the currency processing device is adapted not to route bills to the exit port.

Embodiment 138

A currency document receiving unit comprising: a currency document input port; one or more output receptacles or strapping units; a transport mechanism adapted to receive currency documents from the input port and transport the currency documents individually along one or more transport paths; and a cabinet, wherein the cabinet is adapted to be coupled to a currency handling device such that when coupled together the currency handling device and the currency document receiving unit are configured in a generally L-shaped manner; the currency document receiving unit being adapted to receive at least some currency documents processed by the currency handling device when coupled to the currency document handling device and transport the received currency documents along the one or more transport paths of the currency document receiving unit to the one or more output receptacles or strapping units; wherein the currency handling device comprising one or more detectors adapted to retrieve information from a passing currency document which is used to make a judgment about the passing currency document, an exit port, and a transport mechanism defining one or more transport paths past the one or more detectors to the exit port; the transport mechanism being adapted to transport each currency document individually along the one or more transport paths.

Embodiment 139

A currency document connecting unit comprising: a cabinet adapted to be coupled to a currency handling device and a currency document receiving unit such that when coupled to the handling device and the receiving unit, the processing unit, the connecting unit, and the receiving unit are configured in a generally L-shaped manner; an input port adapted to receive currency documents from the currency processing unit when coupled thereto; an output port adapted to send currency documents to the currency document receiving unit when coupled thereto; and a transport mechanism adapted to receive currency documents from the input port and transport them serially to the output port.

Embodiment 140

An currency document connecting unit comprising: a cabinet adapted to be coupled to a first currency document receiving unit and a second currency document receiving unit such that when coupled to the two receiving units, the connecting unit and the two receiving units are configured in a generally L-shaped manner; an input port adapted to receive currency documents from the first currency document receiving unit when coupled thereto; an output port adapted to send currency documents to the second currency document receiving unit when coupled thereto; and a transport mechanism adapted to receive currency documents from the input port and transport them serially to the output port.

Embodiment 141

An currency document connecting unit comprising: a cabinet adapted to be coupled to a currency handling device and a currency document receiving unit such that when coupled to the handling device and receiving unit, the processing unit and the receiving unit are oriented at approximately ninety (90°) degrees from each other; an input port adapted to receive currency documents from the currency processing unit when coupled thereto; an output port adapted to send currency documents to the currency document receiving unit when coupled thereto; and a transport mechanism adapted to receive currency documents from the input port and transport them serially to the output port.

Embodiment 142

An currency document connecting unit comprising: a cabinet adapted to be coupled to a first currency document receiving unit and a second currency document receiving unit such that when coupled to the two receiving units, the two receiving units are oriented at approximately ninety (90°) degrees from each other; an input port adapted to receive currency documents from the first currency document receiving unit when coupled thereto; an output port adapted to send currency documents to the second currency document receiving unit when coupled thereto; and a transport mechanism adapted to receive currency documents from the input port and transport them serially to the output port.

Embodiment 143

An angular transport unit for use with a currency document processing system, the angular transport unit comprising: a first transport section adapted to receive currency documents traveling one at a time in a first direction along a first axis from a first device of the currency processing system; a second transport section adapted to rotate the documents approximately 90° about the first axis as the document moves in the first direction; a third transport section adapted to rotate the documents from approximately 45° to approximately 135° about a second axis generally normal to the first axis causing the documents to move in a second direction along a third axis; a fourth transport section adapted to rotate documents approximately 90° about the third axis as the document moves in the second direction; and a fifth transport section adapted to transport the documents in the second direction from the angular transport unit to a second device of the currency processing system.

Embodiment 144

The angular transport unit of embodiment 143, wherein the first device is a currency handling device.

Embodiment 145

The angular transport unit of embodiment 144, wherein the second device is a currency strapping unit.

Embodiment 146

The angular transport unit of embodiment 143, wherein the angular transport unit, the first device, and the second device are contained with a housing.

Embodiment 147

A currency document processing system comprising: a currency handling device having an input receptacle adapted to receive a stack of currency documents, one or more detectors adapted to retrieve information from a passing currency document which is used to make a judgment about the passing currency document, a plurality of output receptacles adapted to receive at least some of the currency documents, and a transport mechanism defining one or more transport paths from the input receptacle and past the one or more detectors, the transport mechanism being adapted to transport each currency document individually along the one or more transport paths, the transport mechanism being adapted to transport at least some of the currency documents into the plurality of output receptacles or to one or more currency document receiving units; and the one or more currency document receiving units having one or more output receptacles or strapping units, each receiving unit also having a transport mechanism adapted to transport currency documents individually along one or more transport paths, each currency document receiving unit adapted to receive at least some currency documents processed by the currency handling device and transport the received currency documents along the one or more transport paths of the currency document receiving unit to the one or more output receptacles or strapping units; wherein the currency handling device and the or more currency document receiving units are configured in a generally U-shaped manner.

Embodiment 148

The currency document processing system of embodiment 147 wherein the currency handling device and the currency document receiving unit reside in an integrated generally U-shaped cabinet.

Embodiment 149

The currency document processing system of embodiment 147 wherein the currency handling device and the one or more currency document receiving units reside in separate cabinets and wherein the cabinets are coupled to each other in a generally U-shaped manner.

Embodiment 150

The currency document processing system of embodiment 149 wherein the currency handling device is adapted to be coupled to the one or more currency document receiving units in a modular fashion and wherein the currency handling device is adapted to operate without being coupled to the one or more currency document receiving units such that when the currency handling device is not coupled to the one or more currency document receiving units the currency handling device is adapted not to route bills to the one or more currency document receiving units.

Embodiment 151

A currency document processing system comprising: a currency handling device having one or more detectors adapted to retrieve information from a passing currency document which is used to make a judgment about the passing currency document, a plurality of output receptacles adapted to receive at least some of the currency documents, and a transport mechanism defining one or more transport paths past the one or more detectors, the transport mechanism being adapted to transport each currency document individually along the one or more transport paths, the transport mechanism being adapted to transport at least some of the currency documents into the plurality of output receptacles or to one or more currency document receiving units; and the one or more currency document receiving units having one or more output receptacles or strapping units, each receiving unit also having a transport mechanism adapted to transport currency documents individually along one or more transport paths, each currency document receiving unit adapted to receive at least some currency documents processed by the currency handling device and transport the received currency documents along the one or more transport paths of the currency document receiving unit to the one or more output receptacles or strapping units; wherein the currency handling device and the one or more currency document receiving units are configured in a generally U-shaped manner.

Embodiment 152

The currency document processing system of embodiment 151 wherein the currency handling device and the one or more currency document receiving units reside in an integrated generally U-shaped cabinet.

Embodiment 153

A currency document processing device comprising: an input receptacle adapted to receive a stack of currency documents; one or more detectors adapted to retrieve information from a passing currency document which is used to make a judgment about the passing currency document; a plurality of output receptacles adapted to receive at least some of the currency documents; a modular exit port; and a transport mechanism defining one or more transport paths from the input receptacle, past the one or more detectors, and to the plurality of output receptacles and the exit port; the transport mechanism being adapted to transport each currency document individually along the one or more transport paths; the currency document processing device having a cabinet; the exit port being positioned on a side of the cabinet; the currency document processing device being adapted to be optionally coupled to one or more currency document receiving units, the one or more currency document receiving units having one or more output receptacles or strapping units, each receiving unit also having a transport mechanism adapted to transport currency documents individually along one or more transport paths, each currency document receiving unit being adapted to receive at least some currency documents processed by the currency document processing device when coupled to the currency document processing device and transport the received currency documents along the one or more transport paths of the currency document receiving unit to the one or more output receptacles or strapping units; wherein the currency document processing device is adapted to be coupled to the one or more currency document receiving units such that when coupled together the currency processing device and the one or more currency document receiving units are configured in a generally U-shaped manner.

Embodiment 154

The currency document processing system of embodiment 153 wherein the currency processing device is adapted to be coupled to the one or more currency document receiving units in a modular fashion and wherein the currency processing device is adapted to operate without being coupled to currency document receiving unit such that when the currency processing device is not coupled to the one or more currency document receiving units the currency processing device is adapted not to route bills to the exit port.

Embodiment 155

A currency document processing device comprising: one or more detectors adapted to retrieve information from a passing currency document which is used to make a judgment about the passing currency document; a plurality of output receptacles adapted to receive at least some of the currency documents; a modular exit port; and a transport mechanism defining one or more transport paths past the one or more detectors, and to the plurality of output receptacles and the exit port; the transport mechanism being adapted to transport each currency document individually along the one or more transport paths; the currency document processing device having a cabinet; the exit port being positioned on a side of the cabinet; the currency document processing device being adapted to be optionally coupled to one or more currency document receiving units, each currency document receiving unit having one or more output receptacles or strapping units, each receiving unit also having a transport mechanism adapted to transport currency documents individually along one or more transport paths, each currency document receiving unit being adapted to receive at least some currency documents processed by the currency document processing device when coupled to the currency document processing device and transport the received currency documents along the one or more transport paths of the currency document receiving unit to the one or more output receptacles or strapping units; wherein the currency document processing device is adapted to be coupled to the one or more currency document receiving units such that when coupled together the currency document processing device and the one or more currency document receiving units are configured in a generally U-shaped manner.

Embodiment 156

The currency document processing system of embodiment 155 wherein the currency processing device is adapted to be coupled to the one or more currency document receiving units in a modular fashion and wherein the currency processing device is adapted to operate without being coupled to the one or more currency document receiving units such that when the currency processing device is not coupled to the one or more currency document receiving units the currency processing device is adapted not to route bills to the exit port.

Embodiment 157

A currency document processing system comprising: a currency handling device having an input receptacle adapted to receive a stack of currency documents, one or more detectors adapted to retrieve information from a passing currency document which is used to make a judgment about the passing currency document, a plurality of output receptacles adapted to receive at least some of the currency documents, and a transport mechanism defining one or more transport paths from the input receptacle and past the one or more detectors, the transport mechanism being adapted to transport each currency document individually along the one or more transport paths, the transport mechanism being adapted to transport at least some of the currency documents into the plurality of output receptacles or to one or more currency document receiving units; and the one or more currency document receiving units having one or more output receptacles or strapping units, each receiving unit also having a transport mechanism adapted to transport currency documents individually along one or more transport paths, each currency document receiving unit adapted to receive at least some currency documents processed by the currency handling device and transport the received currency documents along the one or more transport paths of the currency document receiving unit to the one or more output receptacles or strapping units; wherein the currency handling device and the or more currency document receiving units are configured in a generally S-shaped manner.

Embodiment 158

The currency document processing system of embodiment 157 wherein the currency handling device and the currency document receiving unit reside in an integrated generally S-shaped cabinet.

Embodiment 159

The currency document processing system of embodiment 157 wherein the currency handling device and the one or more currency document receiving units reside in separate cabinets and wherein the cabinets are coupled to each other in a generally S-shaped manner.

Embodiment 160

The currency document processing system of embodiment 159 wherein the currency handling device is adapted to be coupled to the one or more currency document receiving units in a modular fashion and wherein the currency handling device is adapted to operate without being coupled to the one or more currency document receiving units such that when the currency handling device is not coupled to the one or more currency document receiving units the currency handling device is adapted not to route bills to the one or more currency document receiving units.

Embodiment 161

A currency document processing system comprising: a currency handling device having one or more detectors adapted to retrieve information from a passing currency document which is used to make a judgment about the passing currency document, a plurality of output receptacles adapted to receive at least some of the currency documents, and a transport mechanism defining one or more transport paths past the one or more detectors, the transport mechanism being adapted to transport each currency document individually along the one or more transport paths, the transport mechanism being adapted to transport at least some of the currency documents into the plurality of output receptacles or to one or more currency document receiving units; and the one or more currency document receiving units having one or more output receptacles or strapping units, each receiving unit also having a transport mechanism adapted to transport currency documents individually along one or more transport paths, each currency document receiving unit adapted to receive at least some currency documents processed by the currency handling device and transport the received currency documents along the one or more transport paths of the currency document receiving unit to the one or more output receptacles or strapping units; wherein the currency handling device and the one or more currency document receiving units are configured in a generally S-shaped manner.

Embodiment 162

The currency document processing system of embodiment 161 wherein the currency handling device and the one or more currency document receiving units reside in an integrated generally S-shaped cabinet.

Embodiment 163

A currency document processing device comprising: an input receptacle adapted to receive a stack of currency documents; one or more detectors adapted to retrieve information from a passing currency document which is used to make a judgment about the passing currency document; a plurality of output receptacles adapted to receive at least some of the currency documents; a modular exit port; and a transport mechanism defining one or more transport paths from the input receptacle, past the one or more detectors, and to the plurality of output receptacles and the exit port; the transport mechanism being adapted to transport each currency document individually along the one or more transport paths; the currency document processing device having a cabinet; the exit port being positioned on a side of the cabinet; the currency document processing device being adapted to be optionally coupled to one or more currency document receiving units, the one or more currency document receiving units having one or more output receptacles or strapping units, each receiving unit also having a transport mechanism adapted to transport currency documents individually along one or more transport paths, each currency document receiving unit being adapted to receive at least some currency documents processed by the currency document processing device when coupled to the currency document processing device and transport the received currency documents along the one or more transport paths of the currency document receiving unit to the one or more output receptacles or strapping units; wherein the currency document processing device is adapted to be coupled to the one or more currency document receiving units such that when coupled together the currency processing device and the one or more currency document receiving units are configured in a generally S-shaped manner.

Embodiment 164

The currency document processing system of embodiment 163 wherein the currency processing device is adapted to be coupled to the one or more currency document receiving units in a modular fashion and wherein the currency processing device is adapted to operate without being coupled to currency document receiving unit such that when the currency processing device is not coupled to the one or more currency document receiving units the currency processing device is adapted not to route bills to the exit port.

Embodiment 165

A currency document processing device comprising: one or more detectors adapted to retrieve information from a passing currency document which is used to make a judgment about the passing currency document; a plurality of output receptacles adapted to receive at least some of the currency documents; a modular exit port; and a transport mechanism defining one or more transport paths past the one or more detectors, and to the plurality of output receptacles and the exit port; the transport mechanism being adapted to transport each currency document individually along the one or more transport paths; the currency document processing device having a cabinet; the exit port being positioned on a side of the cabinet; the currency document processing device being adapted to be optionally coupled to one or more currency document receiving units, each currency document receiving unit having one or more output receptacles or strapping units, each receiving unit also having a transport mechanism adapted to transport currency documents individually along one or more transport paths, each currency document receiving unit being adapted to receive at least some currency documents processed by the currency document processing device when coupled to the currency document processing device and transport the received currency documents along the one or more transport paths of the currency document receiving unit to the one or more output receptacles or strapping units; wherein the currency document processing device is adapted to be coupled to the one or more currency document receiving units such that when coupled together the currency document processing device and the one or more currency document receiving units are configured in a generally S-shaped manner.

Embodiment 166

The currency document processing system of embodiment 165 wherein the currency processing device is adapted to be coupled to the one or more currency document receiving units in a modular fashion and wherein the currency processing device is adapted to operate without being coupled to the one or more currency document receiving units such that when the currency processing device is not coupled to the one or more currency document receiving units the currency processing device is adapted not to route bills to the exit port.

Embodiment 167

The method of embodiment 106 further comprising the act of placing the strapped stack of bills into at least one storage bin.

According to some embodiments, documents such as bills are transported from the input receptacle 102 to the one or more internal or external output locations while maintaining a constant leading edge throughout the transporting act or transport mechanisms such as those embodiments discussed above in connection with, for example, FIGS. 2 and 4*a*-10*b* and embodiments 0-167. According to some embodiments, documents such as bills are transported from the input receptacle to the one or more internal and/or external output locations such that a wide edge of each document is leading throughout the transporting act or transport mechanism such as those embodiments discussed above in connection with, for example, FIGS. 2 and 4*a*-10*b* and embodiments 0-167.

In some embodiments, documents such as currency bills are transported, scanned, denominated, authenticated, imaged and/or otherwise processed at a rate equal to or greater than 400 documents or bills per minute such as those embodiments discussed above in connection with, for example, FIGS. 2 and 4*a*-10*b* and embodiments 0-167. In other embodiments, documents such as currency bills are transported, scanned, denominated, authenticated, imaged and/or otherwise processed at a rate equal to or greater than 800 documents or bills per minute such as those embodiments discussed above in connection with, for example, FIGS. 2 and 4*a*-10*b* and embodiments 0-167. In other embodiments, documents such as currency bills are transported, scanned, denominated, authenticated, imaged and/or otherwise processed at a rate equal to or greater than 1000 documents or bills per minute such as those embodiments discussed above in connection with, for example, FIGS. 2 and 4*a*-10*b* and embodiments 0-167. In still other embodiments, documents such as currency bills are transported, scanned, denominated, authenticated, imaged and/or otherwise processed at a rate equal to or greater than 1200 documents or bills per minute such as those embodiments discussed above in connection with, for example, FIGS. 2 and 4*a*-10*b* and embodiments 0-167. In still other embodiments, documents such as currency bills are transported, scanned, denominated, authenticated, imaged and/or otherwise processed at a rate equal to or greater than 1500 documents or bills per minute such as those embodiments discussed above in connection with, for example, FIGS. 2 and 4*a*-10*b* and embodiments 0-167. According to some embodiments such as those embodiments discussed above in connection with, for example, FIGS. 2 and 4*a*-10*b* and embodiments 0-167 documents such as currency bills are transported, scanned, denominated, authenticated, imaged and/or otherwise processed at a rate equal to or greater than 400, 800, 1200, and/or 1500 documents or bills per minute while maintaining a same leading edge for each document, such as the wide edge of each document, throughout the transporting act as the documents such as bills are transported from the input receptacle to the one or more internal and/or external output locations.

While many of the above embodiments have been described in conjunction with U.S. currency, systems according to some embodiments may alternatively or additionally process currency of other countries such as the Euro, United Kingdom, France, Germany, Japan, Spain, Canada, Italy, Brazil, Mexico, Taiwan, and Saudi Arabia. Likewise, the above systems may support the processing of multiple types of documents including, for example, checks, deposit slips, header documents, currency bills, substitute currency notes, currency notes, substitute currency media, currency documents, barcoded tickets, etc.

In some embodiments of the document or currency handling systems described above such as those embodiments discussed above in connection with, for example, FIGS. 2 and 4*a*-10*b* and embodiments 0-167, the input receptacle, the transport mechanism, the output receptacles (for embodiments containing output receptacles in the document handling device 100), and the cassettes 118 (for embodiments containing cassettes in the document handling device 100) of document handling device 100, and the transport mechanisms and output locations in the angular transport units 500 and the document receiving units 300 can be sized to accommodate documents of varying sizes and such systems can designed to process various documents such as various international currencies, stock certificates, postage stamps, store coupons, currency bills, substitute currency notes, currency notes, substitute currency media, currency documents, barcoded tickets, etc. According to some embodiments, the entire transport mechanism 104 of the currency handling device 100 may be dimensioned to accommodate the largest currency bills internationally or the largest type of documents to be processed. Accordingly, the document handling device 100 can be used to process the currency or documents of varying sizes.

In various alternative embodiments, the currency handling systems described above such as those embodiments discussed above in connection with, for example, FIGS. 2 and 4*a*-10*b* and embodiments 0-167 including one or more of components 100, 300, and 500 are dimensioned to process a stack of different sized currencies at the same time. For example, one application may require the processing of United States dollars (2.5 inches×6 inches, 6.5 cm×15.5 cm) and Euro currency (as large as 7.17 inches×3.82 inches, 18.2 cm×9.7 cm). According to some embodiments, the document processing systems described above such as those embodiments discussed above in connection with, for example, FIGS. 2 and 4*a*-10*b* and embodiments 0-167 may simultaneously accommodate U.S. and Euro currencies. For example, an application may simply require the segregation of the United States currency from the Euro currency wherein a currency handling device 100 delivers United States currency to a first output receptacle 106 and the Euro currency to a second output receptacle 106. In some embodiments, the currency handling system 200 delivers United States currency to a first set of one or more output receptacles or locations and Euro currency to a second set of one or more output receptacles and locations, for example, with each denomination of U.S. and Euro currency having a separate output receptacle. In some embodiments, each of the currency handling systems described above such as those embodiments discussed above in connection with, for example, FIGS. 2 and 4*a*-10*b* and embodiments 0-167 processes a mixed stack of U.S. ten and twenty dollar bills and Euro one hundred and two hundred Euro notes wherein the currency documents are denominated, counted, and authenticated. In such embodiments, the U.S. ten and twenty dollar bills are delivered to first and second output receptacles or locations, respectively, and the Euro one hundred and two hundred Euro notes are delivered to third and fourth output receptacles or locations, respectively. In some embodiments such as those embodiments discussed above in connection with, for example, FIGS. 2 and 4*a*-10*b* and embodiments 0-167, the currency handling system denominates, counts, and/or authenticates six different types of currency wherein, for example, Canadian currency is delivered to a first set of one or more output receptacles or locations, United States currency is delivered to a second set of one or more output receptacles or locations, Japanese currency is delivered to a third set of one or more output receptacles or locations, British currency is delivered to a fourth set of one or more output receptacles or locations, Mexican currency is delivered to a fifth set of output receptacles or locations, and Euro currency is delivered to a sixth set of one or more output receptacles or locations. In some embodiments, no call bills or other denominations of currency, such as Mexican currency for example, may be directed to a separate output receptacle or location such as a reject receptacle such as the output receptacle 106*b* shown in FIG. 3*b*. In some embodiments, suspect bills are delivered to a separate, distinct locations such as a distinct reject receptacle such as the output receptacle 106*a* shown in FIG. 3*b*.

In some embodiments of the document or currency processing systems described above such as those embodiments discussed above in connection with, for example, FIGS. 2 and 4*a*-10*b* and embodiments 0-167, the user can via a user interface vary or set the type of documents to be delivered to the various output locations with the handling device 100 and the document receiving units 300.

In some embodiments such as those embodiments discussed above in connection with, for example, FIGS. 2 and 4*a*-10*b* and embodiments 0-167, the document or currency handling system is also adapted to count the number and/or aggregate value of all the currency bills or currency documents processed and/or the number and/or aggregate value of each individual denomination of currency bills or currency document processed and/or the number and/or aggregate value of each individual denomination of currency bills or currency document delivered to one or more or all of the output locations and to store such information in a memory. According to some embodiments, this information can be communicated to a user or operator via a user-interface and/or communicated to an external computer or external device or network.

In some embodiments such as those embodiments discussed above in connection with, for example, FIGS. 2 and 4*a*-10*b* and embodiments 0-167, the currency processing system is capable of denominating, authenticating, stacking, and/or facing for strapping purposes batches of bills containing several different international currencies. For example, in one embodiment, a user may desire to segregate, denominate, authenticate, and stack for strapping purposes U.S. $20, $50, $100 bills and Canadian $20, $50, $100 bills. The U.S. $20, $50, $100 dollar bills may be directed to a first set of three output locations such as output receptacles and/or strapping units and the Canadian $20, $50, $100 bills may be directed to a second set of three output locations such as output receptacles and/or strapping units. Accordingly, the currency handling device 100 denominates each of the currency bills before directing the bills to the appropriate output location. According to some embodiments, the bills are also authenticated. Authentic U.S. $20, $50, $100 bills and Canadian $20, $50, $100 are directed to the appropriate output locations and those bills which are not authenticated, suspect bills, are routed to one or more different output locations, that is, output locations other than those in either the first or second set of output locations. Additionally, in other alternative embodiments, the processing system may include additional output locations such as, for example, modular output receptacles so that, for example, U.S. $5 and $10 bills are processed in the same manner along side the U.S. $20, $50, $100 bills and Canadian $20, $50, $100 bills.

While the concepts disclosed herein are susceptible to various modifications and alternative forms, specific embodiments thereof have been shown by way of example in the drawings and herein described in detail. It should be understood, however, that it is not intended to limit the inventions to the particular forms disclosed, but on the contrary, the intention is to cover all modifications, equivalents, and alternatives falling within the spirit and scope of the inventions as defined by the appended claims.

The invention claimed is:

1. A currency document processing system for processing a stack of currency documents including currency bills, each bill having a respective denomination, the system comprising:

a currency handling device having an input receptacle configured to receive currency documents including bills to be processed, an evaluating unit comprising one or more detectors configured to retrieve information from a passing bill which is used to denominate the passing bill, a plurality of output receptacles configured to receive at least some of the bills processed by the evaluating unit, and a transport mechanism defining a transport path between the input receptacle, past the evaluating unit, and the plurality of output receptacles, the transport mechanism being configured to transport each bill individually along the transport path, the currency handling device being configured to route bills into the plurality of output receptacles or to transport bills out of the handling device based on the denomination of the bills as determined from the information obtained from the one or more detectors so that an individual one of the output receptacles contains bills having the same denomination;

a first currency document receiving unit configured to receive at least some bills processed by the evaluating unit, the first currency document receiving unit having a flat top lying in a first generally horizontal plane; and a first angular transport unit, the angular transport unit configured to receive bills from the currency handling device and transport bills individually to the first currency document receiving unit, the angular transport unit having a transport mechanism configured to rotate bills from approximately forty five degrees (45°) to approximately one hundred thirty-five degrees (135°) about a vertical axis as the bills are transported individually through the angular transport unit, the first angular transport unit having a flat top lying in the first generally horizontal plane.

2. The system of claim 1, wherein the handling device, the first currency document receiving unit, and the first angular transport unit form a generally L-shaped system.

3. The system of claim 1, wherein the first angular transport unit has a bottom and wherein the distance between the top and the bottom of the first angular transport unit is about 3½ feet.

4. The system of claim 1, wherein the first currency document receiving unit comprises a first strapping unit for strapping stacks of bills.

5. The system of claim 4 further comprising:

a second strapping unit for strapping stacks of bills, the second strapping unit having a flat top lying in the first generally horizontal plane; and a second angular transport unit, the second angular transport unit configured to receive bills from the first strapping unit and transport bills to the second strapping unit, the second angular transport unit having a transport mechanism configured to rotate bills from approximately forty-five degrees (45°) to approximately one hundred thirty-five degrees (135°) about a vertical axis as the bills are transported through the second angular transport unit, the second angular transport unit having a flat top lying in the first generally horizontal plane.

6. The system of claim 5, wherein the handling device, the first strapping unit, the first angular transport unit, and the second strapping unit, and the second angular transport unit form a generally U-shaped system.

7. The system of claim 5 configured to transport U.S. currency bills through the system in a wide-edge leading manner.

8. The system of claim 1, wherein the first angular transport unit comprises a first bill rotating section, a second bill rotating section, and an intermediate section between the first and second bill rotating sections, wherein the first bill rotating section is configured to rotate bills approximately 90° about a first horizontal axis, the intermediate section is configured to rotate bills from approximately 45° to approximately 135° about a vertical axis, and the second bill rotating section is configured to rotate bills approximately 90° about a second horizontal axis, wherein the first horizontal axis is generally normal to the second horizontal axis, and the first horizontal axis and the second horizontal axis are each generally normal to the vertical axis.

9. The system of claim 8, wherein the first angular transport unit is configured to receive bills in a generally horizontal plane from the currency handling device and to transport bills in a generally horizontal plane to the first currency document receiving unit.

10. The system of claim 8 configured to denominate bills and transport bills through the system at a rate equal to or greater than 800 bills per minute.

11. The system of claim 10 configured to transport U.S. currency bills through the system in a wide-edge leading manner.

12. The system of claim 1 configured to denominate bills and transport bills through the system at a rate equal to or greater than 800 bills per minute.

13. The system of claim 1, wherein the first angular transport unit is configured to receive bills in a generally horizontal plane from the currency handling device and to transport bills in a generally horizontal plane to the first currency document receiving unit.

14. The system of claim 13 configured to transport bills through the system at a rate equal to or greater than 800 bills per minute.

15. The system of claim 14 configured to transport U.S. currency bills through the system in a wide-edge leading manner.

16. The currency document processing system of claim 1 wherein the first currency document receiving unit comprises a cabinet having a flat top lying in the first generally horizontal plane, the first currency document receiving unit cabinet top having a depth; and wherein the first angular transport unit comprises a cabinet having a flat top lying in the first generally horizontal plane, the first angular transport unit cabinet top having a depth at least as great as the depth of the first currency document receiving unit cabinet top.

17. The currency document processing system of claim 16 wherein the depth of the first currency document receiving unit cabinet top is about 20 inches.

18. The currency document processing system of claim 16 wherein the depth of the first angular transport unit cabinet has a first side configured to be adjacent to the first currency document receiving unit and wherein the first angular transport unit cabinet top has an edge of the first side of the cabinet that is about 20 inches.

19. The currency document processing system of claim 16 wherein the first currency document receiving unit cabinet top has an area of about 5 square feet.

20. The currency document processing system of claim 16 wherein the first angular transport unit cabinet top has an area greater than the area of the first currency document receiving unit cabinet top.

21. The currency document processing system of claim 16 wherein the area of the first angular transport unit cabinet top and the area of the first currency document receiving unit cabinet top are each at least about 5 square feet and the areas collectively provide a large, contiguous counterspace for an operator of the system.

22. The currency document processing system of claim 1 wherein the transport mechanisms of the currency handling device and first angular transport unit are configured to transport bills in a manner such that the forward speed of the bills remains uniform over each bill as the bills are transported out of the currency handling device and through first angular transport unit.

23. The currency document processing system of claim 1 wherein the transport mechanisms of the currency handling device and first angular transport unit are configured to transport bills in a manner such that a leading edge of a bill does not change as each bill is transported through the currency handling device and first angular transport unit.

24. An angular transport unit for use with a U.S. currency processing system, the angular transport unit comprising:

an input port;

an output port;

a first transport section configured to receive U.S. currency bills traveling one at a time in a first direction along a first axis from the input port;

a second transport section configured to rotate the bills approximately 90° about the first axis as the bills move in the first direction, the second transport section comprising at least one guide configured to support a U.S. currency bill as the bill rotates about the first axis;

a third transport section configured to rotate the bills from approximately 45° to approximately 135° about a second axis generally normal to the first axis causing the bills to move in a second direction along a third axis;

a fourth transport section configured to rotate the bills approximately 90° about the third axis as the bills move in the second direction;

a fifth transport section configured to transport the bills in the second direction to the output port; and a cabinet having a top lying in a first generally horizontal plane, wherein the transport sections reside in the cabinet.

25. The angular transport unit of claim 24 wherein the third transport section is configured to rotate the bills approximately 90° about a generally vertical axis causing the bills to move in a second generally horizontal direction along a second generally horizontal axis, the first axis being normal to the second generally horizontal axis, the second generally horizontal axis being generally normal to the vertical axis.

26. The angular transport unit of claim 24 wherein the cabinet has a bottom and wherein the distance between the top and the bottom of the cabinet is about 3½ feet.

27. The angular transport unit of claim 24, wherein the first, second, third, fourth, and fifth transport sections are configured to transport U.S. currency bills at a rate of at least about 800 bills per minute.

28. The angular transport unit of claim 27 wherein the first, second, third, fourth, and fifth transport sections are configured to transport U.S. currency bills in a wide-edge leading manner.

29. The angular transport unit of claim 28 further wherein the second transport section comprises a first guide and a second guide configured to support a U.S. currency bill as the bill rotates about the first axis and wherein the fourth transport section comprises a third guide and a fourth guide configured to support a U.S. currency bill as the bill rotates about the third axis.

30. The angular transport unit of claim 24 wherein the first and third axes are generally horizontal axes, wherein the second axis is generally vertical, and wherein:

the first transport section is configured to receive currency bills traveling one at a time in a first generally horizontal direction along the first generally horizontal axis from the input port;

the second transport section is configured to rotate the bills approximately 90° about the first generally horizontal axis as the bills move in the first generally horizontal direction, the second transport section comprising at least one guide configured to support a U.S. currency bill as the bill rotates about the first generally horizontal axis;

the third transport section is configured to rotate the bills from approximately 45° to approximately 135° about the second generally vertical axis causing the bills to move in a second generally horizontal direction along the third generally horizontal axis, the first generally horizontal axis being normal to the second generally vertical axis, the third generally horizontal axis being generally normal to the second generally vertical axis;

the fourth transport section configured to rotate the bills approximately 90° about the third generally horizontal axis as the bills move in the second generally horizontal direction; and the fifth transport section configured to transport the bills in the second generally horizontal direction to the output port.

31. The angular transport unit of claim 30 wherein the third transport section is configured to rotate the bills approximately 90° about the generally vertical axis causing the bills to move in the second generally horizontal direction along the third generally horizontal axis, the first generally horizontal axis being normal to the third generally horizontal axis.

32. The angular transport unit of claim 30, wherein the first, second, third, fourth, and fifth transport sections are configured to transport U.S. currency bills at a rate of at least about 400 bills per minute.

33. The angular transport unit of claim 32 wherein the first, second, third, fourth, and fifth transport sections are configured to transport U.S. currency bills in a wide-edge leading manner.

34. The angular transport unit of claim 33 further wherein the second transport section comprises a first guide and a second guide configured to support a U.S. currency bill as the bill rotates about the first axis and wherein the fourth transport section comprises a third guide and a fourth guide configured to support a U.S. currency bill as the bill rotates about the third axis.

35. A modular U.S. currency bill connecting unit comprising:

a free-standing, modular cabinet configured to rest on a floor surface and configured to be coupled to a first U.S. currency bill unit and a second U.S. currency bill unit such that when coupled to the first and second units, the connecting unit and the first and second units are configured in a generally L-shaped manner;

an input port configured to receive U.S. currency bills from the first currency bill unit when the first currency bill unit is coupled to the cabinet;

an output port configured to permit U.S. currency bills to be transported to the second currency bill unit when the second currency bill unit is coupled to the cabinet; and a transport mechanism configured to receive U.S. currency bills from the input port and transport them serially to the output port.

36. The currency bill connecting unit of claim 35 wherein the cabinet has a bottom and wherein the distance between the top and the bottom of the cabinet is about 3½ feet.

37. The currency bill connecting unit of claim 35 wherein the cabinet has a top lying in a first generally horizontal plane and wherein the second U.S. currency bill unit has a flat top and wherein the cabinet is configured to be coupled to the second currency bill unit such that when coupled to the second unit, the top of the second currency bill unit lies in the first generally horizontal plane.

38. The currency bill connecting unit of claim 37 wherein the first U.S. currency bill unit has a flat top and wherein the cabinet is configured to be coupled to the first currency bill unit such that when coupled to the first unit, the top of the first currency bill unit lies in the first generally horizontal plane.

39. The connecting unit of claim 38 wherein the cabinet has a bottom and wherein the distance between the top and the bottom of the cabinet is about 3½ feet.

40. The currency bill connecting unit of claim 38 wherein the first currency bill unit and the second currency bill unit are strapping units.

41. The connecting unit of claim 40 configured to transport bills through the connecting unit at a rate of at least about 400 bills per minute.

42. The connecting unit of claim 41 configured to transport bills through the connecting unit in a wide-edge leading manner.

43. The connecting unit of claim 35 configured to transport bills through the connecting unit at a rate of at least about 1000 bills per minute.

44. The connecting unit of claim 43 configured to transport bills through the connecting unit in a wide-edge leading manner.

45. The currency bill connecting unit of claim 35 wherein the cabinet has a top lying in a first generally horizontal plane.

46. The currency bill connecting unit of claim 35 wherein the cabinet is on wheels.

47. The currency bill connecting unit of claim 35 wherein the transport mechanism is configured to rotate bills about at least one horizontal axis and rotate bills from approximately forty five degrees (45°) to approximately one hundred thirty-five degrees (135°) about a vertical axis.

48. The currency bill connecting unit of claim 35 wherein the transport mechanism of is configured to transport bills in a manner such that the forward speed of the bills remains uniform over each bill as the bills are transported through the currency bill connecting unit.

49. The currency bill connecting unit of claim 35 wherein the transport mechanism is configured to transport bills in a manner such that a leading edge of a bill does not change as each bill is transported through the currency bill connecting unit.

50. A modular U.S. currency bill connecting unit comprising:

a cabinet configured to be coupled to a first currency bill unit and a second currency bill unit such that when coupled to the first and second currency bill units, the first currency bill unit and the second bill unit are oriented at approximately ninety (90°) degrees from each other;

an input port configured to receive U.S. currency bills from the first currency bill unit when the first currency bill unit is coupled to the cabinet;

an output port configured to permit U.S. currency bills to be transported to the second currency bill unit when the second currency bill unit is coupled to the cabinet; and a transport mechanism configured to receive U.S. currency bills from the input port and transport them serially to the output port;

wherein the cabinet has a top lying in a first generally horizontal plane.

51. The currency bill connecting unit of claim 50 wherein the cabinet has a bottom and wherein the distance between the top and the bottom of the cabinet is about 3½ feet.

52. The currency bill connecting unit of claim 50 wherein the second currency bill unit has a flat top and wherein the cabinet is configured to be coupled to the second currency bill unit such that when coupled to the second unit, the top of the second currency bill unit lies in the first generally horizontal plane.

53. The currency bill connecting unit of claim 52 wherein the first currency bill unit is a currency handling device and the second currency bill unit is a strapping unit.

54. The currency bill connecting unit of claim 52 wherein the first currency bill unit has a flat top and wherein the cabinet is configured to be coupled to the first currency bill unit such that when coupled to the first unit, the top of the first currency bill unit lies in the first generally horizontal plane.

55. The currency bill connecting unit of claim 54 wherein the first currency bill unit and the second currency bill unit are strapping units.

56. The connecting unit of claim 50 configured to transport bills through the connecting unit at a rate of at least about 800 bills per minute.

57. The connecting unit of claim 56 configured to transport bills through the connecting unit in a wide-edge leading manner.

58. The currency bill connecting unit of claim 50 wherein the cabinet is on wheels.

59. The currency bill connecting unit of claim 50 wherein the transport mechanism is configured to rotate bills about at least one horizontal axis and rotate bills from approximately forty five degrees (45°) to approximately one hundred thirty-five degrees (135°) about a vertical axis.

60. The currency bill connecting unit of claim 50 wherein the transport mechanism of is configured to transport bills in a manner such that the forward speed of the bills remains uniform over each bill as the bills are transported through the currency bill connecting unit.

61. The currency bill connecting unit of claim 50 wherein the transport mechanism is configured to transport bills in a manner such that a leading edge of a bill does not change as each bill is transported through the currency bill connecting unit.

62. A currency document processing system comprising:

a currency handling device having one or more detectors adapted to retrieve information from a passing currency document which is used to make a judgment about the passing currency document, the one or more detectors being configured to retrieve information from a passing currency document which is a currency bill which is used to determine the denomination of the passing currency bill, a plurality of output receptacles adapted to receive at least some of the currency documents, and a transport mechanism defining one or more transport paths from an input receptacle and past the one or more detectors, the transport mechanism being adapted to transport each currency document individually along the one or more transport paths, the transport mechanism being adapted to transport at least some of the currency documents into the plurality of output receptacles or out of the currency handling device through an exit port; and two or more currency document receiving units;

each currency document receiving unit having a transport mechanism adapted to transport currency documents individually along one or more transport paths, each currency document receiving unit adapted to receive at least some currency documents processed by the currency handling device and transport the received currency documents along the one or more transport paths of the currency document receiving unit, each currency document receiving unit having a front;

wherein the currency handling device and the two or more currency document receiving units are configured in a generally U-shaped manner, an area defined within the U-shape of the system providing an area for a human operator of the system to reside.

63. The currency document processing system of claim 62 wherein the two or more currency document receiving units comprise two or more strapping units.

64. The currency document processing system of claim 63 wherein the distance between the input receptacle of the currency handling device and a portion of the front of a second one of the currency document receiving units is about 5⅓ feet.

65. The currency document processing system of claim 62 wherein the distance between the input receptacle of the currency handling device and a portion of the front of a second one of the currency document receiving units is about 5⅓ feet.

66. The currency document processing system of claim 62 wherein the distance between the input receptacle of the currency handling device and a portion of the front of a first one of the currency document receiving units is about 5 feet.

67. The currency document processing system of claim 66 wherein the two or more currency document receiving units comprise two or more strapping units.

68. The currency document processing system of claim 67 wherein the distance between the input receptacle of the currency handling device and a portion of the front of a second one of the currency document receiving units is about 5⅓ feet.

69. The currency document processing system of claim 66 wherein the distance between the input receptacle of the currency handling device and a portion of the front of a second one of the currency document receiving units is about 5⅓ feet.

70. The currency document processing system of claim 66 wherein the currency handling device has a generally rectangular shape as viewed from looking down on the currency handling device.

71. The currency document processing system of claim 62 wherein the document receiving units each has a generally rectangular shape as viewed from looking down on the document receiving units.

72. The currency document processing system of claim 62 wherein the currency handling device has a front surface lying in a generally vertical plane.

73. The currency document processing system of claim 72 wherein the front of one of the currency document receiving units lies in a vertical plane generally parallel to the vertical plane of the front surface of the currency handling device and wherein the front of another of the currency document receiving units lies in a vertical plane generally perpendicular to the vertical plane of the front surface of the currency handling device.

74. The currency document processing system of claim 62 wherein the currency handling device comprises one side of the U-shape, at least one of the currency document receiving units comprises a base side of the U-shape and at least one other of the currency document receiving units comprises one side of the U-shape which is generally parallel to the U-shape side comprising the currency handling device, and wherein currency documents are transported through the currency handling device, the at least one of the currency document receiving units, and the at least one other of the currency document receiving units without changing the leading edge of each currency document.

75. The currency document processing system of claim 62 wherein the distance between the input receptacle of the currency handling device and a portion of the front of a first one of the currency document receiving units is about 5⅓ feet.

76. The currency document processing system of claim 75 wherein the currency handling device has a generally rectangular shape as viewed from looking down on the currency handling device.

77. The currency document processing system of claim 76 wherein the document receiving units each has a generally rectangular shape as viewed from looking down on the document receiving units.

78. The currency document processing system of claim 75 wherein the currency handling device has a front surface lying in a generally vertical plane.

79. The currency document processing system of claim 78 wherein the front of one of the currency document receiving units lies in a vertical plane generally parallel to the vertical plane of the front surface of the currency handling device and wherein the front of another of the currency document receiving units lies in a vertical plane generally perpendicular to the vertical plane of the front surface of the currency handling device.

80. The currency document processing system of claim 75 wherein the currency handling device comprises one side of the U-shape, at least one of the currency document receiving units comprises a base side of the U-shape and at least one other of the currency document receiving units comprises one side of the U-shape which is generally parallel to the U-shape side comprising the currency handling device, and wherein currency documents are transported through the currency handling device, the at least one of the currency document receiving units, and the at least one other of the currency document receiving units without changing the leading edge of each currency document.

81. The currency document processing system of claim 75 wherein the two or more currency document receiving units comprise two or more strapping units.

82. The currency document processing system of claim 62 wherein the currency handling device and the two or more currency document receiving units are all on wheels.

83. The currency document processing system of claim 62 further comprising two angular transport units; and wherein the currency handling device, the two or more currency document receiving units, and the angular transport units are all on wheels.

84. The currency document processing system of claim 62 further comprising two angular transport units; and wherein the two or more currency document receiving units each has a flat top lying in a first generally horizontal plane and wherein each angular transport units has a flat top lying in the first generally horizontal plane.

85. The currency document processing system of claim 84 wherein the first generally horizontal plane is positioned approximately 3½ feet above a bottom of at least one of the angular transport units.

86. The currency document processing system of claim 62 wherein each currency document receiving unit comprises one or more access opening in a front side of the currency document receiving unit facing the area for a human operator to reside to permit a human operator of the system to retrieve bills residing inside the currency document receiving unit during normal operation of the system.

87. The currency document processing system of claim 62 further comprising two angular transport units, each having a transport mechanism configured to transport currency documents individually through the angular transport unit along a transport path; and wherein the transport mechanisms of the currency handling device, the angular transport units, and the currency document receiving units are configured to transport currency documents in a manner such that the forward speed of the currency documents remains uniform over each currency documents as the currency documents are transported out of the currency handling device and through the angular transport units and currency document receiving units.

88. The currency document processing system of claim 62 wherein the transport mechanisms of the currency handling device and the currency document receiving units are configured to transport currency documents in a manner such that the forward speed of the currency documents remains uniform over each currency documents as the currency documents are transported out of the currency handling device and through the currency document receiving units.

89. The currency document processing system of claim 62 further comprising two angular transport units, each having a transport mechanism configured to transport currency documents individually through the angular transport unit along a transport path; and wherein the transport mechanisms of the currency handling device, the angular transport units, and the currency document receiving units are configured to transport currency documents in a manner such that a leading edge of a currency document does not change as each currency document is transported out of the currency handling device and through the angular transport units and currency document receiving units.

90. The currency document processing system of claim 62 wherein the transport mechanisms of the currency handling device and the currency document receiving units are configured to transport currency documents in a manner such that a leading edge of a currency document does not change as each currency document is transported out of the currency handling device and through the currency document receiving units.

91. A currency document processing system comprising:

a currency handling device having one or more detectors adapted to retrieve information from a passing currency document which is used to make a judgment about the passing currency document, the one or more detectors being configured to retrieve information from a passing currency document which is a currency bill which is used to determine the denomination of the passing currency bill, a plurality of output receptacles adapted to receive at least some of the currency documents, and a transport mechanism defining one or more transport paths from an input receptacle and past the one or more detectors, the transport mechanism being adapted to transport each currency document individually along the one or more transport paths, the transport mechanism being adapted to transport at least some of the currency documents into the plurality of output receptacles or out of the currency handling device through an exit port; and one or more currency document receiving units;

each currency document receiving unit having a transport mechanism adapted to transport currency documents individually along one or more transport paths, each currency document receiving unit adapted to receive at least some currency documents processed by the currency handling device and transport the received currency documents along the one or more transport paths of the currency document receiving unit, each currency document receiving unit having a front;

wherein the distance between the input receptacle of the currency handling device and a portion of the front of a first one of the currency document receiving units is about 5⅓ feet.

92. The currency document processing system of claim 91 wherein the two or more currency document receiving units comprise two or more strapping units.

93. The currency document processing system of claim 92 wherein the distance between the input receptacle of the currency handling device and a portion of the front of a second one of the currency document receiving units is about 5 feet.

94. The currency document processing system of claim 92 wherein the currency handling device and the one or more currency document receiving units reside in separate cabinets and wherein the cabinets are coupled to each other in a generally L-shaped manner.

95. The currency document processing system of claim 91 wherein the distance between the input receptacle of the currency handling device and a portion of the front of a second one of the currency document receiving units is about 5 feet.

96. The currency document processing system of claim 91 wherein the currency handling device and the one or more currency document receiving units reside in separate cabinets and wherein the cabinets are coupled to each other in a generally L-shaped manner.

97. A currency document processing system comprising:

a currency handling device having one or more detectors adapted to retrieve information from a passing currency document which is used to make a judgment about the passing currency document, the one or more detectors being configured to retrieve information from a passing currency document which is a currency bill which is used to determine the denomination of the passing currency bill, a plurality of output receptacles adapted to receive at least some of the currency documents, and a transport mechanism defining one or more transport paths from an input receptacle and past the one or more detectors, the transport mechanism being adapted to transport each currency document individually along the one or more transport paths, the transport mechanism being adapted to transport at least some of the currency documents into the plurality of output receptacles or out of the currency handling device through the exit port; and two or more currency document receiving units;

each currency document receiving unit having a transport mechanism adapted to transport currency documents individually along one or more transport paths, each currency document receiving unit adapted to receive at least some currency documents processed by the currency handling device and transport the received currency documents along the one or more transport paths of the currency document receiving unit, each currency document receiving unit having a front;

wherein the distance between the input receptacle of the currency handling device and a portion of the front of a first one of the currency document receiving units is about 5 feet.

98. The currency document processing system of claim 97 wherein the two or more currency document receiving units comprise two or more strapping units.

99. A currency document processing system for processing a stack of currency documents including currency bills, each bill having a respective denomination, the system comprising:

a currency handling device having an input receptacle configured to receive currency documents including bills to be processed, an evaluating unit comprising one or more detectors configured to retrieve information from a passing bill which is used to denominate the passing bill, a plurality of output receptacles configured to receive at least some of the bills processed by the evaluating unit, and a transport mechanism configured to individually transport currency documents from the input receptacle, past the evaluating unit, and to the plurality of output receptacles or out of the handling device, the transport mechanism being configured to transport each currency document individually along one or more transport paths, the currency handling device being configured to route bills into the plurality of output receptacles or to transport bills out of the handling device based on the denomination of the bills as determined from the information obtained from the one or more detectors so that an individual one of the output receptacles contains bills having the same denomination, the currency handling device comprising a free-standing cabinet configured to rest on a floor surface, the currency handling device cabinet housing the transport mechanism and the output receptacles of the currency handling device;

a first currency document receiving unit configured to receive at least some bills processed by the evaluating unit, the first currency document receiving unit comprising a free-standing cabinet configured to rest on a floor surface; and a first angular transport unit, the angular transport unit configured to receive bills from the currency handling device and transport bills individually to the first currency document receiving unit, the angular transport unit having a transport mechanism configured to rotate bills from approximately forty five degrees (45°) to approximately one hundred thirty-five degrees (135°) about a vertical axis as the bills are transported individually through the angular transport unit, the first angular transport unit comprising a free-standing cabinet configured to rest on a floor surface, the first angular transport unit cabinet housing the transport mechanism of the first angular transport unit.

100. The currency document processing system of claim 99 wherein the first angular transport unit is supported on wheels.

101. The currency document processing system of claim 99 wherein the currency handling device, the first currency document receiving unit, and the first angular transport unit are all on wheels.

102. The currency document processing system of claim 99 wherein the first currency document receiving unit has a flat top lying in a first generally horizontal plane and wherein the first angular transport unit has a flat top lying in the first generally horizontal plane.

103. The currency document processing system of claim 99 wherein the first generally horizontal plane is positioned approximately 3½ feet above a bottom of the first angular transport unit.

104. A currency document processing system for processing a stack of currency documents including currency bills, each bill having a respective denomination, the system comprising:

a currency handling device having an input receptacle configured to receive currency documents including bills to be processed, one or more detectors configured to retrieve information from a passing bill which is used to denominate the passing bill, a plurality of output receptacles configured to receive at least some of the bills processed by the currency handling device, and a transport mechanism having one or more transport paths extending from the input receptacle, past the one or more detectors, and to the plurality of output receptacles and to an exit port, the transport mechanism being configured to transport each bill individually along the one or more transport paths, the currency handling device being configured to route bills into the plurality of output receptacles or to transport bills out of the handling device through the exit port based on the denomination of the bills as determined from the information obtained from the one or more detectors so that an individual one of the output receptacles contains bills having the same denomination;

a first currency document receiving unit configured to receive at least some bills processed by the evaluating unit; and a first angular transport unit, the angular transport unit configured to receive bills from the currency handling device and transport bills individually to the first currency document receiving unit, the angular transport unit having a transport mechanism configured to rotate bills about at least one horizontal axis and rotate bills from approximately forty five degrees (45°) to approximately one hundred thirty-five degrees (135°) about a vertical axis as the bills are transported individually through the angular transport unit.

105. The currency document processing system of claim 104 wherein the first currency document receiving unit comprises a flat top lying in a first generally horizontal plane and wherein the first angular transport unit comprises a flat top lying in the first generally horizontal plane.

106. The currency document processing system of claim 105 wherein the area of the first angular transport unit top and the area of the first currency document receiving unit top are each at least about 5 square feet and the areas collectively provide a large, contiguous counterspace for an operator of the system.

107. The currency document processing system of claim 106 wherein the first generally horizontal plane is positioned approximately 3½ feet above a bottom of the first angular transport unit.

108. The currency document processing system of claim 104 wherein the transport mechanisms of the currency handling device and first angular transport unit are configured to transport bills in a manner such that the forward speed of the bills remains uniform over each bill as the bills are transported out of the currency handling device and through first angular transport unit.

109. The currency document processing system of claim 104 wherein the transport mechanisms of the currency handling device and first angular transport unit are configured to transport bills in a manner such that a leading edge of a bill does not change as each bill is transported through the currency handling device and first angular transport unit.

110. A currency document processing system for processing a stack of currency documents including currency bills, each bill having a respective denomination, the system comprising:

a currency handling device having an input receptacle configured to receive currency documents including bills to be processed, one or more detectors configured to retrieve information from a passing bill which is used to denominate the passing bill, a plurality of output receptacles configured to receive at least some of the bills processed by the currency handling device, and a transport mechanism having one or more transport paths extending from the input receptacle, past the one or more detectors, and to the plurality of output receptacles and to an exit port, the transport mechanism being configured to transport each bill individually along the one or more transport paths, the currency handling device being configured to route bills into the plurality of output receptacles or to transport bills out of the handling device through the exit port based on the denomination of the bills as determined from the information obtained from the one or more detectors so that an individual one of the output receptacles contains bills having the same denomination;

a first currency document receiving unit configured to receive at least some bills processed by the evaluating unit; and a first angular transport unit, the angular transport unit configured to receive bills from the currency handling device and transport bills individually to the first currency document receiving unit, the angular transport unit having a transport mechanism configured to rotate bills from approximately forty five degrees (45°) to approximately one hundred thirty-five degrees (135°) about a vertical axis as the bills are transported individually through the angular transport unit;

wherein the transport mechanisms of the currency handling device and first angular transport unit are configured to transport bills in a manner such that a leading edge of a bill does not change as each bill is transported out of the currency handling device and through the first angular transport unit.

111. A currency document processing system for processing a stack of currency documents including currency bills, each bill having a respective denomination, the system comprising:

a currency handling device having an input receptacle configured to receive currency documents including bills to be processed, one or more detectors configured to retrieve information from a passing bill which is used to denominate the passing bill, a plurality of output receptacles configured to receive at least some of the bills processed by the currency handling device, and a transport mechanism having one or more transport paths extending from the input receptacle, past the one or more detectors, and to the plurality of output receptacles and to an exit port, the transport mechanism being configured to transport each bill individually along the one or more transport paths, the currency handling device being configured to route bills into the plurality of output receptacles or to transport bills out of the handling device through the exit port based on the denomination of the bills as determined from the information obtained from the one or more detectors so that an individual one of the output receptacles contains bills having the same denomination, wherein the currency handling device resides in a currency handling device cabinet, the currency handling device cabinet having a front side;

a first currency document receiving unit configured to receive at least some bills processed by the evaluating unit, wherein the first currency document receiving unit resides in a first currency document receiving unit cabinet, the first currency document receiving unit cabinet having a front side and a depth d; and a first angular transport unit, the angular transport unit configured to receive bills from the currency handling device and transport bills individually to the first currency document receiving unit, the angular transport unit having a transport mechanism configured to rotate bills from approximately forty five degrees (45°) to approximately one hundred thirty-five degrees (135°) about a vertical axis as the bills are transported individually through the angular transport unit;

wherein a portion of the front side of the currency handling device is spaced apart from a portion of the front side of the first currency document receiving unit by approximately no more than d; wherein the front side of the currency handling device and the front side of the first currency document receiving unit are adjacent to an area in which a human operator of the system occupies when operating the system.

112. The currency document processing system of claim 111 wherein d is about 20 inches.

113. The currency document processing system of claim 111 wherein the first currency document receiving unit comprises a flat top lying in a first generally horizontal plane and wherein the first angular transport unit comprises a flat top lying in the first generally horizontal plane.

114. The currency document processing system of claim 113 wherein the area of the first angular transport unit top and the area of the first currency document receiving unit top collectively provide a contiguous counterspace for an operator of the system.

115. The currency document processing system of claim 114 wherein the area of the first angular transport unit top and the area of the first currency document receiving unit top are each at least about 5 square feet.

116. The currency document processing system of claim 114 wherein the first generally horizontal plane is positioned approximately 3½ feet above a bottom of the first angular transport unit.

117. The currency document processing system of claim 113 wherein the tops of the currency document receiving units and the tops of the angular transport units each provide a surface area, the surface areas of the angular transport units and currency document receiving units collectively providing a contiguous surface.

118. The currency document processing system of claim 117 wherein the contiguous surface provides a contiguous work surface for an operator of the system.

119. The currency document processing system of claim 118 wherein the surface area of each of the angular transport units and each of currency document receiving units are at least about 5 square feet.

120. The currency document processing system of claim 119 wherein the first generally horizontal plane is positioned approximately 3½ feet above a bottom at least one of the angular transport units.

121. The currency document processing system of claim 118 wherein the first generally horizontal plane is positioned approximately 3½ feet above a bottom at least one of the angular transport units.

122. The currency document processing system of claim 111 wherein the transport mechanisms of the currency handling device and first angular transport unit are configured to transport bills in a manner such that the forward speed of the bills remains uniform over each bill as the bills are transported out of the currency handling device and through first angular transport unit.

123. The currency document processing system of claim 111 wherein the transport mechanisms of the currency handling device and first angular transport unit are configured to transport bills in a manner such that a leading edge of a bill does not change as each bill is transported through the currency handling device and first angular transport unit.

124. The currency document processing system of claim 111 wherein the currency handling device resides in a currency handling device cabinet, the currency handling device cabinet having a front side and an exit side, the exit side of the currency handling device being generally perpendicular to the front side of the currency handling device, the exit side of the currency handling device having a horizontal dimension $d_{chd}$;

wherein the first currency document receiving unit resides in a first currency document receiving unit cabinet, the first currency document receiving unit cabinet having a front side and an inlet side, the inlet side of the first currency document receiving unit being generally perpendicular to the front side of the first currency document receiving unit, the inlet side of the first currency document receiving unit having a horizontal dimension equal to depth d; and wherein the angular transport unit resides in an angular transport unit cabinet having a first and a second opposing pair of generally vertical sides, the first pair of the opposing sides having an input side positioned adjacent to the exit side of the currency handling device, the input side having an input port through which bills may be received from an exit port in the adjacent exit side of the currency handling device, the input side of the angular transport unit cabinet having a horizontal dimension, $d_{atr1}$, wherein the horizontal dimension, $d_{atr1}$, of the angular transport unit is approximately the same as the horizontal dimension $d_{chd}$ of the exit side of the currency handling device;

the second pair of the opposing sides having an exit side positioned adjacent to a side of the first currency document receiving unit, the exit side having an output port through which bills may be transported through an inlet port in the adjacent side of the first currency document receiving unit, the exit side of the angular transport unit cabinet having a horizontal dimension, $d_{atr2}$, wherein the horizontal dimension, $d_{atr2}$, of the angular transport unit is approximately the same as the horizontal dimension d of the inlet side of the first currency document receiving unit, the input side and the exit side of the angular transport unit being generally perpendicular to each other;

the first opposing sides having a second side and the second opposing sides having a second side, wherein each of the second sides have a horizontal dimension, $d_{atr3}$, the horizontal dimensions of the second sides being approximately the same, the second sides being generally perpendicular to each other; and wherein a portion of the adjacent side of the currency handling device is spaced apart from a portion of the adjacent side of the first currency document receiving unit by approximately no more than the square root of $2d_{atr3}^2$.

125. The currency document processing system of claim 124 wherein $d_{atr3}$ is about 28 inches.

126. The currency document processing system of claim 124 wherein the second sides meet at an edge of the cabinet of the angular transport unit.

127. The currency document processing system of claim 124 wherein the horizontal dimension, $d_{atr1}$, of the angular transport unit is approximately the same as the horizontal dimension, $d_{atr2}$, of the angular transport unit.

128. A currency document processing system for processing a stack of currency documents including currency bills, each bill having a respective denomination, the system comprising:

a currency handling device having an input receptacle configured to receive currency documents including bills to be processed, one or more detectors configured to retrieve information from a passing bill which is used to denominate the passing bill, a plurality of output receptacles configured to receive at least some of the bills processed by the currency handling device, and a transport mechanism having one or more transport paths extending from the input receptacle, past the one or more detectors, and to the plurality of output receptacles and to an exit port, the transport mechanism being configured to transport each bill individually along the one or more transport paths, the currency handling device being configured to route bills into the plurality of output receptacles or to transport bills out of the handling device through the exit port based on the denomination of the bills as determined from the information obtained from the one or more detectors so that an individual one of the output receptacles contains bills having the same denomination;

a first currency document receiving unit configured to receive at least some bills processed by the evaluating unit, the first currency document receiving unit having a flat top lying in a first generally horizontal plane, the flat top of the first currency document receiving unit having a width w adjacent to a front of the first currency document receiving unit and a depth d, the front of the first currency document receiving unit being adjacent to an area in which an operator of the system occupies during normal operation of the system; and a first angular transport unit, the angular transport unit configured to receive bills from the currency handling device and transport bills individually to the first currency document receiving unit, the angular transport unit having a transport mechanism configured to rotate bills from approximately forty five degrees (45°) to approximately one hundred thirty-five degrees (135°) about a vertical axis as the bills are transported individually through the angular transport unit, the first angular transport unit having a flat top lying in the first generally horizontal plane;

wherein the flat top of the first angular transport unit and the flat top of the first currency document receiving unit collectively define a contiguous surface having a depth of at least d.

129. The currency document processing system of claim 128 wherein the first currency document receiving unit comprises one or more access opening in the front of the first currency document receiving unit to permit a human operator of the system to retrieve bills residing inside the first currency document receiving unit during normal operation of the system.

130. The currency document processing system of claim 128 wherein d is about 20 inches.

131. The currency document processing system of claim 128 wherein the contiguous surface provides a contiguous work surface for an operator of the system.

132. The currency document processing system of claim 131 wherein the area of the first angular transport unit top and the area of the first currency document receiving unit top are each at least about 5 square feet.

133. The currency document processing system of claim 131 wherein the first generally horizontal plane is positioned approximately 3½ feet above a bottom of the first angular transport unit.

134. The currency document processing system of claim 128 wherein the transport mechanisms of the currency handling device and first angular transport unit are configured to transport bills in a manner such that the forward speed of the bills remains uniform over each bill as the bills are transported out of the currency handling device and through first angular transport unit.

135. The currency document processing system of claim 128 wherein the transport mechanisms of the currency handling device and first angular transport unit are configured to transport bills in a manner such that a leading edge of a bill does not change as each bill is transported through the currency handling device and first angular transport unit.

* * * * *